US006292635B1

(12) United States Patent
Tokairin et al.

(10) Patent No.: US 6,292,635 B1
(45) Date of Patent: Sep. 18, 2001

(54) CONTINUOUS MEDIUM PRINTING APPARATUS

(75) Inventors: Motohiro Tokairin; Eiichi Sugisaki; Tamotsu Nishiura; Amiko Shimizubata, all of Kawasaki (JP)

(73) Assignee: Fujitsu Limited, Kanagawa (JP)

( * ) Notice: Subject to any disclaimer, the term of this patent is extended or adjusted under 35 U.S.C. 154(b) by 0 days.

(21) Appl. No.: 09/531,118

(22) Filed: Mar. 20, 2000

(30) Foreign Application Priority Data

Jul. 7, 1999 (JP) ..... 11-193747

(51) Int. Cl.[7] ..... G03G 15/00; B41J 15/00

(52) U.S. Cl. ..... 399/15; 399/72; 399/75; 399/384

(58) Field of Search ..... 399/15, 38, 43, 399/72, 384, 75; 358/406, 504, 1.17, 1.16; 382/112; 356/388

(56) References Cited

U.S. PATENT DOCUMENTS 5,576,811 * 11/1996 Kobayashi et al. ..... 399/15 X
5,887,223 * 3/1999 Sakai et al. ..... 399/15 X
6,137,967 * 10/2000 Laussermair et al. ..... 399/15 X

FOREIGN PATENT DOCUMENTS 3-36071 2/1991 (JP) .
6-237350 8/1994 (JP) .
7-81191 3/1995 (JP) .
8-25764 1/1996 (JP) .
9-136411 5/1997 (JP) .
9-207416 8/1997 (JP) .
9-216441 8/1997 (JP) .

* cited by examiner

*Primary Examiner*—Sophia S. Chen
(74) *Attorney, Agent, or Firm*—Armstrong, Westerman, Hattori, McLeland & Naughton, LLP

(57) ABSTRACT

According to the present invention, there is provided a continuous medium printing apparatus including a printing section, a determining section, instructing unit, wherein the determining section is controlled in its reading operation for acquiring printed image data from continuous paper in accordance with first instructing signal supplied from the instructing unit, and the printing section is controlled in its printing operation on the continuous paper in accordance with a second instructing signal supplied from the instructing unit. According to the above arrangement, even if a plurality of printers are connected in an on-line fashion and each of the printers is carrying out printing operation with the continuous paper, each printer can be independently settled in the paper size of the continuous paper, the partitioning position of each page, the length and width of the continuous paper, the size of data to be printed, the location of printing of the data to be printed, the resolution thereof while comparing the data to be printed with the printed image data in terms of image matching. Moreover, each printer can be independently controlled in printing and conveying operations and reading and conveying operations so that printing and comparing can be accurately carried out.

28 Claims, 47 Drawing Sheets

FIG. 22(a)

32

| ADDRESS | |
|---|---|
| $1FF | COMMAND INFORMATION |
| $1FE | PRINT SIZE (PAPER SIZE) INFORMATION |
| ∫ | ∫ |
| $1E3 | COMPARING DETERMINATION REFERENCE INFORMATION |
| ∫ | ∫ |
| $001 | INFORMATION DISTANCE BETWEEN PRINTER AND READING UNIT |
| $000 | |

FIG. 22(b)

| SATISFACTORY CASE | UNSATISFACTORY CASE |
|---|---|
| ○○○○○ | ○○○○○ |
| ○○○○○ | ○○○×○ |
| ○○××○ | ○○××○ |
| ○○○○○ | ○○○○○ |
| ○○○○○ | ○○○○○ |

○ : COINCIDENT

× : NOT COINCIDENT

FIG. 23

32

| ADDRESS | |
|---|---|
| $1FF | COMMAND INFORMATION |
| $1FE | PRINT SIZE (PAPER SIZE) INFORMATION |
| ~ | ~ |
| $1E3 | COMPARING DETERMINATION REFERENCE INFORMATION 1 |
| $1E2 | COMPARING DETERMINATION REFERENCE INFORMATION 2 |
| $1E1 | COMPARING DETERMINATION REFERENCE INFORMATION 3 |
| $1E0 | COMPARING DETERMINATION REFERENCE INFORMATION 4 |
| ~ | ~ |
| $001 | INFORMATION DISTANCE BETWEEN PRINTER AND READING UNIT |
| $000 | |

FIG. 25(a)
| ADDRESS | 32 |
|---|---|
| $1FF | COMMAND INFORMATION |
| $1FE | PRINT SIZE (PAPER SIZE) INFORMATION |
| ∿ | ∿ |
| $1DF | INFORMATION INDICATIVE OF PROCESSING UPON DETECTING UNSATISFACTORY PRINTING 1 |
| $1DE | INFORMATION INDICATIVE OF PROCESSING UPON DETECTING UNSATISFACTORY PRINTING 2 |
| ∿ | ∿ |
| $001 | INFORMATION DISTANCE BETWEEN PRINTER AND READING UNIT |
| $000 | |
FIG. 25(b)
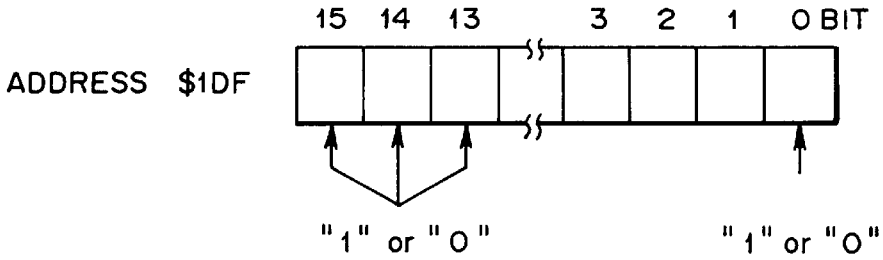
FIG. 25(c)
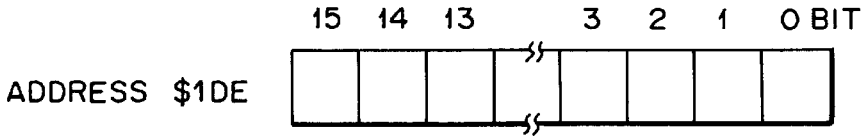

CONTINUOUS MEDIUM PRINTING APPARATUS

BACKGROUND OF THE INVENTION (1) Field of the Invention

The present invention relates to a continuous medium printing apparatus for printing data to be printed on a continuous medium such as a continuous recording paper by using an electrophotograph, for example.

(2) Description of Related Art

There are known several kinds of systems in which image data is printed on a continuous medium (hereinafter sometimes referred to as continuous paper or simply paper). One of these system, or an electrophotograph system is very popular because of its low cost.

FIG. 46 is a schematic diagram of a continues medium printing apparatus in which an electrophotograph system is employed. As shown in FIG. 46, data to be printed sent from an upper controller unit 93 is supplied to a mechanism control unit 91 provided within a printer 90, in which the data to be printed is transferred to a photosensitive body drum (photosensitive drum) 90*e* by an exposing unit 90*d*. In this case, the photosensitive drum 90*e* is rotated in the clockwise direction in FIG. 46. Initially, the photosensitive drum 90*e* has charged its surface uniformly by a pre-charging device 90*c*. When the photosensitive drum 90*e* is exposed under light by the exposing unit 90*d*, then an electrostatic latent image corresponding to the data to be printed is formed on the surface of the photosensitive drum 90*e*. The electrostatic latent image is developed by a developing device 90*g* so as to form a toner image. The toner image on the surface of the photosensitive drum 90*e* is transferred to the paper by means of a transfer electrifying device 90*f* and a conveying body 30*i*.

Thereafter, residual toner is removed by a cleaner unit 90*b*. The photosensitive drum 90*e* has again its surface electrified uniformly by the pre-charging device 90*c* so that the photosensitive drum 90*e* can cope with the next step of transfer process. Meanwhile, continuous paper 92 is conveyed by a conveying tractor (paper conveying mechanism) 90*h*. When the paper reaches a place beneath a fixing device 90*a*, the transferred toner image is fixed by heat applied by the fixing device 90*a*. The paper printed with the image thereon is reserved within a continuous paper reserving unit.

When the printer 90 prints data to be printed supplied from the upper controller unit 93, sometimes a print image drop, a dirt spot or the like occurs due to a folding portion of the continuous paper 92. Therefore, it is necessary for an operator of the printer to check the printed image so that the printing operation can be continued or the dirt spot or the like can be detected even if the image drop or the dirt spot is caused in the printed image.

To this end, there has been proposed an apparatus in which an image having been printed on the continuous paper is read by a reading apparatus, and the printed image data read by the reading apparatus and data to be printed are compared with each other. According to the apparatus, comparison is made by detecting the correspondence between the predetermined paper size and the data to be printed. Proposes with regard to the apparatus can be found in the following five kinds of publications.

Initially, in Japanese Patent Laid-Open Publication No. HEI 7-81191 (hereinafter referred to as a publication 1), there is disclosed a printer equipped with a print result comparing function by which it is determined automatically and at a high speed, whether the printer produced a print result correctly or not. According to the technology disclosed in the publication 1, the printer includes a picked-up area designating means 32 by which an area to be compared with data to be printed is designated from data read as printed image data. The data of the area designated by the picked-up area determining means 32 is recognized as picked-up characters and subjected to the comparison.

In Japanese Patent Laid-Open Publication No. HEI 6-237350 (hereinafter referred to as a publication 2), there is disclosed a facsimile apparatus in which when printing error is detected, causing an error, only the page containing the error is again printed so that the print error is recovered. According to the technology disclosed in the publication 2, the printed text data is read by some device provided in the facsimile apparatus, subjected to check, and a print retrying request is issued on the page containing the error so that printing of the page is retried.

Next, in Japanese Patent Laid-Open publication No. HEI 9-216441 (hereinafter referred to as publication 3), there is disclosed an image defect detecting apparatus in which a defect of a printed image can be positively detected with a short period of time. According to the technology disclosed in the publication 3, image data extracted on the basis of position information about an important area out of image data read in an optical manner, is subjected to comparison with original image data offered to printing, and if it is determined that both the data are not coincident to each other, a defect detecting signal is generated. In this case, there are introduced three methods for attaching the position information of the important area. That is, a method in which a position information is registered in advance, a method in which image data to be attached with the position information is extracted from Page Description Language, and a method in which a shading composed of code information containing the position information of the important area is detected so that it is determined whether the shading of the image is dropped or not.

Further, in Japanese Patent Laid-Open Publication No. HEI 3-36071 (hereinafter referred to as a publication 4), there is disclosed a printer apparatus in which printed result and print data are compared with each other so that error printing can be detected. According to a phase difference control circuit introduced in the publication 4, control is carried out by taking into account the correction on a time it takes for a paper to travel from a printing position to a data reading device. In this way, print error can be detected and reliability in printing operation can be guaranteed at a very high level.

Furthermore, in Japanese Patent Laid-Open Publication No. HEI 8-25764 (hereinafter referred to as a publication 5), there is disclosed a printer apparatus in which print error can be corrected solely by the printer apparatus and number of times of print retrying is restricted. According to the technology disclosed in the publication 5, print error can be corrected in the printer apparatus, so that load of error processing imposed on an apparatus governing the printer apparatus is relieved and efficiency of channels is improved so that error correction process can be carried out for a short period of time. Moreover, the printer apparatus is provided with a counter for restricting the number of times of print retrying so that time consumption in the print retrying is limited to a predetermined level.

Incidentally, when printing is carried out on continuous paper by using these printer apparatus, these printers are placed in a situation in which a plurality of printers are connected to a single printer line so that each printer prints on paper of a different size at a different resolution. Further, data to be printed sent from a controller unit governing the printer apparatus is printed continuously by the plurality of printers. Furthermore, a single printer can print the data on paper of a plurality of sizes at a plurality of resolution levels. Therefore, according to the technologies disclosed in the publications 1 to 5, when each of the plurality of printers prints the data on paper of each different size at each different resolution level, comparison between the data to be printed and actually printed data cannot be carried out in accordance with the paper size and resolution level in each printer.

In addition to the above drawback, when so called loading operation is carried out, i.e., continuous paper is loaded in the printer and the comparing unit, it is necessary for an operator of the apparatus to count the number of pages of the continuous paper placed between the printer and the comparing unit, which fact is a cumbersome operation for the operator. For this reason, there has been proposed a method in which a printer prints a control mark on an area outside a printing area of a printing face of the continuous paper, the comparing unit recognizes the position of the control mark, and a unit of page of the printing face is determined.

According to the above-described method, a mechanism control unit 91 (see FIG. 46) creates data of the control mark, and printing is carried out by synthesizing the data of the control mark and the data to be printed sent from an upper controller unit 93. In this method, if the data to be printed is transmitted to a comparing unit, it becomes possible to compare printed image data read by some device with the data to be printed. However, according to the above method, the data to be printed sent to the comparing unit is added with the data of the control mark by the mechanism control unit 91. Therefore, if some trouble is caused in the mechanism control unit 91, the data to be printed sent to the comparing unit becomes coincident with data having been printed on the continuous paper, which makes it impossible to detect erroneous printing.

On the other hand, there has been proposed a technology in which an operator can settle an allowable level of print quality. That is, the allowable level serves as the degree of allowable defect when detecting the print defect upon comparing the data with each other. The allowable level is variably settled in advance by the operator depending on the degree of importance of the print job. When print defect is detected, the printer selects one of operations, i.e., the printer is instantly stopped and the printer is stopped when a number of pages containing unsatisfactory printing reaches a predetermined number, depending on the setting of the operator.

According to the technology, however, it is necessary for the operator to settle the allowable level for each print job. Therefore, if the setting of the allowable level is erroneously carried out, the comparing unit of the printer can immediately stop upon detection of the print defect. Further, continuous printing can be carried out in spite of the fact that the operator desires to carry out print retrying operation. Conversely, print defect is detected, leading to instant stop of the printer, in spite of the fact that the operator dose not want to stop the print operation. In this way, some drawbacks can be expected.

Further, according to a prior art technology, when the comparing unit compares data to be printed with the print image data to detect a print defect, even if the comparing unit suffers from any trouble and print defect is detected, the printer is not informed of the fact. Thus, the printer continues to print while the print defect is left uncorrected.

In addition to the above drawback, according to the prior art technology, paper conveying control on the side of the printer and paper conveying control on the side of print comparing unit are made synchronous with each other. Therefore, it becomes difficult to carry out accurate print comparing operation regarding a page at which print comparing operation is stopped.

FIG. 47 is a diagram showing the paper conveying speed of the printer in which the paper conveying speed of the printer is made synchronous with the paper conveying speed of the print comparing unit. In FIG. 47, time is plotted in abscissa while speed (millimeter per second) is plotted in ordinate. The speed is positive in the area above the abscissa. Reference symbols P1, P2, P3 and P4 in FIG. 47 are sampled points of timing.

An interval between the reference symbols P1 and P2 in FIG. 47 is an interval in which paper is conveyed in the print conveying direction (paper conveying direction) and operations of reading and comprising are carried out. If print operation is stopped in an interval between the reference symbols P2 and P3, reading operation is carried out from the timing point P3 at which paper has been conveyed by a distance between the printer and the print comparing unit. However, the result becomes uncertain, with the result that the print comparing operation is stopped in a halfway of a page. Then, if printing is resumed, then reading is started. Therefore, accurate print comparing operation is not carried out about the page in which print comparing operation is stopped.

SUMMARY OF THE INVENTION

The present invention is made in view of the above aspect. Therefore, a first object of the present invention is to provide a continuous medium printing apparatus in which even when each of printers connected in an on-line connection manner is carrying out printing operation on continuous paper, a paper size of the continuous paper, a page partitioning position, length and width of the continuous paper, a size of data to be printed, a position for printing and resolution for printing are appropriately variably set at each printer, and data to be printed and print image data can be compared with each other.

Further, a second object of the present invention is to provide a continuous medium printing apparatus in which the paper conveying control of the printer and the paper conveying control of the reading unit of the comparing unit are independently arranged so that accurate print comparing operation can be carried out.

According to the present invention, there is provided a continuous medium printing apparatus including printing means for putting data to be printed into print on a continuous medium, conveying the continuous medium in a print conveying direction, and capable of generating the data to be printed and a first instructing signal regarding the data to be printed, determining means provided in the downstream of the printing means in the print conveying direction of the continuous medium, for reading a printed image on the continuous medium, comparing printed image data read from the printed image with the data to be printed supplied from the outside, and generating a second instructing signal regarding at least the printed image data, and instructing means connected to the printing means and the determining means, for supplying the data to be printed and the first instructing signal sent from the printing means to the determining means, and capable of supplying the second instructing signal from the determining means to the printing means, wherein the determining means is controlled in the reading operation of the continuous medium based on the first instructing signal from the instructing means, and the printing means is informed of at least the status of the determining means in accordance with the second instructing means from the instructing means or controlled in the printing operation of the continuous medium.

According to the above arrangement, even if a plurality of printers are connected to a single printer line, each of the plurality of printers can print on paper of each size and at each resolution. Further, the comparing unit of each printer can carry out comparing operation in accordance with the paper size and resolution. Thus, comparing operation can be carried out appropriately.

Further, the printing means may be arranged to comprise print image forming means for forming a print image on the continuous medium and conveying the continuous medium in the print conveying direction and mechanism control means for sending the first instructing signal.

The mechanism control means may be arranged to comprise printing data receiving means for receiving the data to be printed, mark data creating means for creating data regarding a control mark useful for controlling the start and stop of the reading operation and holding the mark data, and printing data adding means for synthesizing the data to be printed and the data regarding the control mark into a single printing image. Further, the comparing means is arranged to compare data regarding the control mark detected by the reading means with data regarding the control mark sent from the printing means.

Further, the above instructing means may be arranged to comprise third memory means connected to the printing means and the determining means so as to allow the printing means and the determining means to access the third memory means to read and write data. Furthermore, the above instructing means may be arranged to comprise control data sending means for sending a pulse signal composed of pulses with a predetermined time interval.

Further, the first instructing signal is arranged to contain any or all of information indicative of a page partitioning position of the continuous medium, information indicative of a length or a width of the continuous medium, information indicative of a size of the data to be printed, information indicative of a location of the data to be printed, and resolution information.

The determining means may be arranged to comprise reading means provided in the downstream of the printing means in the print conveying direction of the continuous medium and for reading the printed image while conveying the continuous medium, first memory means for holding the data to be printed, second memory means for holding the printed image data, and comparing means connected to the reading means and the second memory means and capable of comparing the printed image data with the data to be printed in terms of image coincidence.

In addition, the first instructing signal may be arranged as a control signal for controlling the determining means in the reading operation. Further, the first instructing signal may be arranged as a start signal which the printing means sends to the reading means for notifying the reading means of the start of reading the printed image when the printing is achieved by a predetermined length on the continuous medium.

The continuous medium printing apparatus may be arranged such that the reading means detects a control mark for controlling the start and stop of the reading operation from the printed image of the continuous medium so that the printing means controls the reading means.

According to the above arrangement, combination of the above-described control data can be arbitrarily selected so that each printer can appropriately change the setting of paper size of the continuous paper, the page partitioning position, the length and width of the continuous paper, the size of the data to be printed, the position of printing of the data to be printed, and the resolution.

Further, the first instructing signal may be arranged as a timing signal which makes the printing means start the printing operation after the amount of light irradiated on the continuous medium reaches a predetermined value in the reading means. According to the arrangement, the printing means can be prevented from being lowered in the processing speed, and hence the reading operation becomes stable.

Further, the first instructing signal may be arranged as an informing signal for prohibiting the comparing means from doing comparing operation on a perforation portion formed at a regular interval for folding the continuous medium. According to the arrangement, the comparing operation can be accurately carried out. Moreover, if the paper is provided with the perforation for folding the paper, the printer can cope with the perforation, and hence the printer can print on a various kinds of paper.

The first instructing signal may be arranged as a halting condition notifying signal for notifying the comparing means of the halting condition when the comparing means detects unsatisfactory printing by the comparing result. Further, the first instructing signal may be arranged as a data deletion notifying signal for notifying the comparing means of deletion of the data to be printed when the printing means stops printing.

According to the above arrangement, the operator need not carry out setting operation, and hence printing efficiency can be prevented from being deteriorated due to erroneous setting operation.

Further, the second instructing signal may be arranged as a control signal for controlling the printing operation of the printing means. Furthermore, the second instructing signal may be arranged as a quality signal indicative of the result of comparison made by the comparing means. According to the arrangement, it becomes possible to carry out recovery printing operation, and hence printing processing can be carried out without delay.

Further, the determining means may be arranged to comprise preprint information storing means capable of holding data of a plurality of printed images containing preprint information of ruled lines, characters, symbols and soon, and preprint information registration designating means for inputting one kind of preprint information selected by an operator from the plurality of printed images stored in the preprint information storing means, and the comparing means may be arranged to make comparison by using the selected one kind of the preprint information, the data to be printed and the printed image data. The preprint information storing means may be arranged such that, after the continuous medium is loaded in the printing means and the reading means, the preprint information storing means acquires the printed image of the preprint information of the loaded continuous medium.

According to the above arrangement, the operator need not register the preprint information each time a new roll of continuous paper is loaded. Therefore, it becomes possible to shorten the time it takes to start printing, obviate the time to register the preprint information and improve the operability of the printer.

In addition, the first instructing signal may be arranged as a comparing determination reference information useful when the comparing means compares the data to be printed with the printed image data supplied to the comparing means. The comparing determination reference information may be set for each of a plurality of regions deriving from partitioning the continuous medium in the print conveying direction and the direction perpendicular to the print conveying direction.

According to the above arrangement, an appropriate print quality can be set and hence the reading processing speed can be prevented from being lowered.

Further, the comparing means may be arranged to comprise detecting means for generating a difference value indicative of a difference between a planed printing distance of the continuous medium extracted from the first instructing signal and a distance actually printed on the continuous medium and counted by the reading means, and halting signal inputting means for inputting a halting signal for halting the operation of the printing means to the printing means when the difference value sent from the detecting means exceeds a predetermined value. According to the above arrangement, it becomes possible to decrease the possibility of causing jam, suppress an erroneous comparing operation, and prevent the processing speed of the printing means from being lowered.

Further, the second instructing signal may be arranged as a control signal for controlling the printing operation of the printing means. Furthermore, the second instructing signal may be arranged as a quality signal indicative of the result of comparison made by the comparing means. Further, the determining means may be arranged to comprise print data transmission retrying means arranged to transmit the printed image data of an unsatisfactorily printed page from the determining means to the printing means when the comparing means issues a comparing result indicating that the printing quality is unsatisfactory. Furthermore, the reading means may be arranged such that when the comparing means reveals unsatisfactory comparing result, the continuous medium can be moved back from the inside of the comparing means to the outside of the same to a position where an operator is allowed to examine the printed material with the eyesight and stops the printing operation of the printing means.

According to the arrangement, it becomes possible to carry out recovery printing operation, and hence printing processing can be carried out without delay.

In addition, the continuous medium printing apparatus may be arranged to comprise a preprocessing section for conveying the continuous medium to the printing means, and the preprocessing unit may be arranged to comprise detecting means for detecting a connecting perforation indicating a position where the tail end of the preceding continuous medium and the beginning end of the following continuous medium are connected to each other and capable of generating a detecting signal, and preprocessing section control means for sending information of the connecting perforation to the mechanism control means in accordance with the detecting signal from the detecting means, wherein the mechanism control means prohibits the printing means from printing a page attached with the connecting perforation while prohibits the comparing means from doing comparison in at least non-printed areas of the preceding and following pages of the connecting perforation.

According to the above arrangement, printing operation can be carried out continuously.

Further, the continuous medium printing apparatus may be provided with a post-processing section for cutting the continuous medium in the downstream in the print conveying direction of the determining means, and the comparing means may be arranged to comprise offset instructing signal generating means for generating an offset instructing signal instructing the offset operation of the continuous medium based on the control mark after cutting the continuous medium and supplying the offset instructing signal to the post-processing section.

According to the above arrangement, even if other apparatus such as the post-processing section is added to the printer system, the post-processing will be involved in the control system of the printer system. Therefore, operability can be improved.

Further, the continuous medium printing apparatus may be arranged such that when the printing means halts the printing operation, the continuous medium is conveyed to a position indicated by the control mark in the direction inverse to the print conveying direction and then the reading means reads the continuous medium. Furthermore, the continuous medium printing apparatus may be arranged to comprise buffer amount detecting means for detecting a slack amount of the continuous medium between the printing means and the determining means, and the reading means is arranged such that when the slack amount detected by the buffer amount detecting means becomes equal to or smaller than a predetermined value, then the reading means halts the reading operation upon the first detection of the control mark after the detection of that the slack amount becomes equal to or smaller than a predetermined value.

According to the above arrangement, when the printing and comparing operations are stopped and thereafter printing is resumed, the printing and comparing operations can be accurately carried out about the page at which the printing and comparing operations were stopped.

BRIEF DESCRIPTION OF THE DRAWINGS

FIG. 20(*b*) is a diagram showing an example of paper information allocation according to the third modification of the first embodiment of the present invention;

FIG. 22(*a*) is a diagram showing an example of data allocation in the dual port memory according to a fourth modification of the first embodiment of the present invention;

FIG. 22(*b*) is a diagram useful for explaining a method for determining the comparing result according to the fourth modification of the first embodiment of the present invention;

FIG. 23 is a diagram showing an example of data allocation in the dual port memory according to a fifth modification of the first embodiment of the present invention;

FIG. 25(*a*) is a diagram showing an example of data allocation in the dual port memory according to a sixth modification of the first embodiment of the present invention;

FIG. 25(*b*) is a diagram showing an example of utilization of processing information upon detecting unsatisfactory printing according to the sixth modification of the first embodiment of the present invention;

FIG. 25(*c*) is a diagram showing another example of utilization of processing information upon detecting unsatisfactory printing according to the sixth modification of the first embodiment of the present invention;

FIG. 27(*b*) is a diagram showing an example of utilization of temporary halt request information according to the ninth modification of the first embodiment of the present invention;

FIG. 29(*b*) is a diagram showing an example of utilization of resolution information according to the tenth modification of the first embodiment of the present invention;

FIG. 31(*b*) is a timing chart of a printing operation executing period signal according to the eleventh modification of the first embodiment of the present invention;

FIG. 31(*c*) is a timing chart of an unsatisfactory result indicating signal according to the eleventh modification of the first embodiment of the present invention;

FIG. 35(*b*) is a diagram showing an example of utilization of connecting portion vacant printing information according to the second embodiment of the present invention;

FIG. 40(*b*) is a timing chart of an offset indicating signal according to the third embodiment of the present invention;

DESCRIPTION OF THE PREFERRED EMBODIMENTS

Embodiments of the present invention will hereinafter be described with reference to the drawings.

(A) Description of a First Embodiment of the Present Invention

Figure 1:
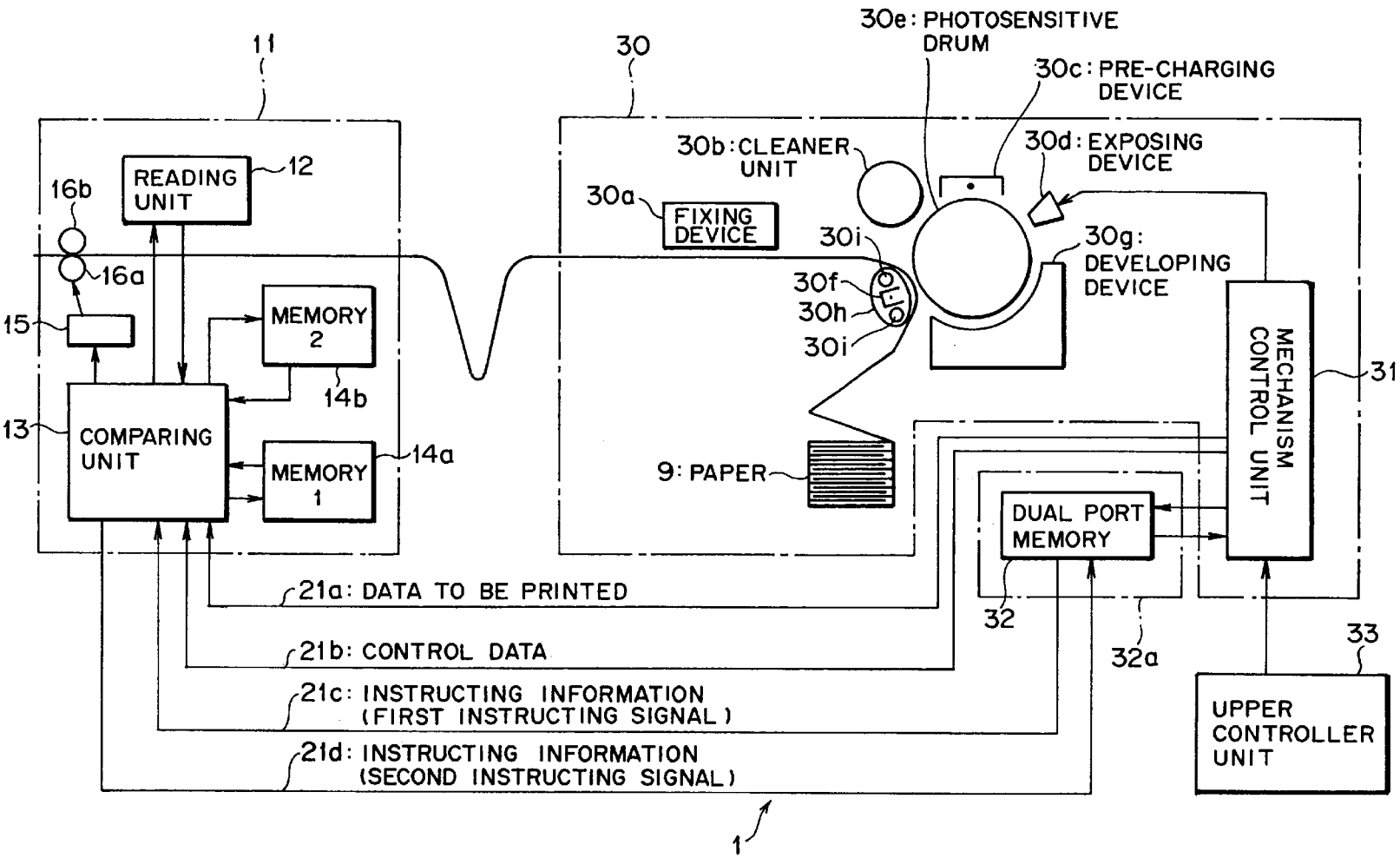
FIG. 1 is a diagram showing an arrangement of a continuous medium printing apparatus according to a first embodiment of the present invention.

FIG. 1 is a diagram showing an arrangement of a continuous medium printing apparatus according to the first embodiment of the present invention. As shown in FIG. 1, the continuous medium printing apparatus 1 comprises an upper controller unit 33, a printing section (printing means) 30, a determining section (determining means) 11 and designating means 32*a*. The continuous medium printing apparatus 1 shown in FIG. 1 functions as a print data comparing system in which data to be printed sent from the upper controller unit 33 is printed on continuous medium such as continuous paper sequentially at a high rate.

In the arrangement shown in FIG. 1, the continuous paper (continuous medium) 9 is loaded in a predetermined position within the printing section 30 and a predetermined position within the determining section 11. The continuous paper 9 is fed in a paper conveying direction to the left side of FIG. 1 so that a predetermined amount of slack is kept between the printing section 30 and the determining section 11 and printed data can be read by the determining section 11.

The arrangement of the continuous medium printing apparatus 1 is employed in other embodiments and modifications of the present invention unless particularly specified. Further, in the following description, the printing section 30 may be referred to as a printer or a printer apparatus. Further, the print conveying direction may be referred to as a scanning direction. However, these terms have the same meaning.

The upper controller unit 33 is utilized for sending data to be printed to the printing section 30. The term "data to be printed" means originally created data that shall be printed. Further, a term "print data" means data deriving from synthesizing the data to be printed and other control data together. Furthermore, if the print data is printed on the continuous paper 9 and the printed image is read by a reading unit 12, then the data deriving from the reading is referred to as "printed image data". These terms will have the above meanings in the following description unless not specified.

The printing section 30 is arranged to print the data to be printed on the continuous paper 9, convey the paper in the print conveying direction, and generate the data to be printed and a first instructing signal regarding the data to be printed. The printing section 30 includes, in addition to a photosensitive drum 30*e*, a pre-charging device 30*c*, an exposing device 30*d*, a mechanism control unit (mechanism control means) 31, a developing device 30*g*, a transfer electrifying device 30*f*, a fixing device 30*a*, a cleaner unit 30*b*, and a conveying tractor (paper conveying mechanism) 30*h* surrounding the photosensitive drum 30*e*.

The first instructing signal is arranged to include information of page partitioning position of the continuous paper 9, information of the length and width of the continuous paper 9, information of the size of the data to be printed, information of position of the data to be printed, and information of a part of or a whole of resolution information. The first instructing signal is utilized as a control signal for controlling the reading operation carried out by the determining section 11.

The photosensitive drum 30*e* forms a print image on the continuous paper while rotating in the print conveying direction of the continuous paper 9. In this case, the print conveying direction is the clockwise direction in FIG. 1. The pre-charging device 30*c* is utilized for uniformly electrifying the photosensitive drum 30*e*. The exposing device 30*d* is utilized for forming an electrostatic latent image corresponding to the data to be printed on the surface of the photosensitive drum 30*e* by exposing the surface to light.

The developing device 30*g* is utilized for forming a toner image by developing the electrostatic latent image. The transfer electrifying device 30*f* is disposed so as to oppose the photosensitive drum 30*e* with the continuous paper interposed therebetween, and utilized for transfer the toner onto the photosensitive drum 30*e*. Further, the conveying tractor 30*h* is formed of a conveying body 30*i* and conveyer belt (not shown) and provided so that the conveyer belt surrounds the transfer electrifying device 30*f*. Moreover, the fixing device is utilized for fixing the toner image transferred on the continuous paper 9 by applying heat, pressure, light and so on. The cleaner unit 30*b* is utilized for removing toner which is not transferred to the continuous paper 9 but left on the photosensitive drum 30*e*, from the photosensitive drum 30*e*.

The photosensitive drum 30*e*, the pre-charging device 30*c*, the exposing unit 30*d*, the mechanism control unit 31, the developing device 30*g*, the transfer electrifying device 30*f*, the conveying tractor 30*h*, the conveying body 30*i*, the fixing device 30*a*, and the cleaner unit 30*b* function as print image forming means. The print image forming means forms a print image on the continuous paper 9 and conveys the continuous paper 9 in the print conveying direction.

In this way, as the photosensitive drum 30*e* rotates in the clockwise direction, printing is carried out on the continuous paper 9. More specifically, the photosensitive drum 30*e* is electrified so that the surface thereof has a uniform potential by means of the pre-charging device 30*c*. An electrostatic latent image corresponding to the data to be printed is formed on the surface of the photosensitive drum 30*e* by means of the exposing device 30*d*. The electrostatic latent image is developed by the developing device 30*g* to form a toner image on the surface of the photosensitive drum 30*e*. Then, the toner image formed on the photosensitive drum 30*e* is transferred by the transfer electrifying device 30*f* onto the continuous paper 9.

On the other hand, the continuous paper 9 is conveyed by the conveying tractor 30*h*. The toner image transferred onto the continuous paper 9 is fixed by the fixing device 30*a* with heat, pressure, light and so on. The toner not transferred to be left on the surface of the photosensitive drum 30*e* is removed from the photosensitive drum 30*e* by the cleaner unit 30*b*. Then, the photosensitive drum 30*e* has the surface thereof uniformly electrified again by the pre-charging device 30*c* as a preparation for the next transfer process.

The mechanism control unit 31 is arranged to send the first instructing signal. That is, in order to send the first instructing signal, the mechanism control unit 31 writes information indicative of the size of an image to be printed, data size information indicative of a dot number in the scanning direction and a dot number in the sub-scanning direction of the data to be printed, information indicative of a distance from the transfer position of the printer to the position at which printed image is read, and so on, into a dual port memory 32. Examples showing how such information is written into the dual port memory 32 will be described later on. In this case, the term "sub-scanning direction" means a direction perpendicular to the print conveying direction.

In addition to the above operation, the mechanism control unit 31 controls the developing device 30*g*, pre-charging device 30*c*, the transfer electrifying device 30*f*, drive of the cleaner unit 30*b*, the fixing device 30*a*. In this way, under the print instruction of the upper controller unit 33, the mechanism control unit 31 supplies data to be printed to the photosensitive drum 30*e*.

The determining means 11 is provided in the downstream of the continuous paper 9 in the print conveying direction. The determining means 11 reads a printed image on the continuous paper 9 and compares the read printed image data with the data to be printed supplied from the instructing means 32*a* in terms of image coincidence. The determining means 11 further generates a second instructing signal regarding the printed image data. In order to carry out the above operations, the determining means 11 includes a reading unit (reading means) 12, a first memory (first memory means) 14*a*, a second memory (second memory means) 14*b*, a comparing unit (comparing means) 13, a reading unit conveying control unit (paper conveying control circuit) 15, and a paper conveying mechanism 16*a*, 16*b*.

The reading unit 12 is provided in the downstream of the continuous paper 9. The reading unit 12 is arranged to read a printed image formed on the continuous paper 9 while conveying the continuous paper 9. The function of the reading unit is accomplished by a CCD (Charge Couple Device) camera, for example. The first memory 14*a* is arranged to hold the data to be printed. The second memory 14*b* is arranged to hold printed image data. The functions of the first memory 14*a* and the second memory 14*b* are realized by a RAM (Random Access Memory), for example. In the figure, the first memory 14*a* is denoted as a memory 1 and the second memory 14*b* is denoted as a memory 2.

The comparing unit 13 is connected to the reading unit 12 and the second memory 14*b*, whereby the comparing unit 13 can compare the printed image data with the data to be printed. This function is realized by a software, for example. The reading unit conveying control unit 15 controls conveying control of the paper conveying mechanism 16*a*, 16*b*. This function can be realized by a paper conveying control circuit, for example. Further, the paper conveying mechanism 16*a*, 16*b* is arranged to convey the continuous paper 9 in the print conveying direction under control of the reading unit conveying control unit 15. The paper conveying mechanism 16*a*, 16*b* may be made up with a cylindrical roller or the like, for example.

The instructing means 32*a* is formed of a dual port memory 32, connected to the printing section 30 and the determining section 11 so that the data to be printed and the first instructing signal are supplied from the printing section 30 to the determining section while the second instructing signal is supplied from the determining section 11 to the printing section 30. Four kinds of data lines 21*a*, 21*b*, 21*c*, 21*d* are provided between the mechanism control unit 31 and the comparing unit 13.

In this way, the determining section 11 is controlled in the reading operation of the continuous paper 9 by the first instructing signal supplied from the instructing means 32*a*, and the printing section 30 is informed of the state of the determining section 11 or controlled in the printing operation of the continuous paper 9 by the second instructing signal supplied from the determining section 11 by way of the instructing means 32*a*. The second instructing signal will be more fully described later on.

The dual port memory 32 is connected to both of the printing section 30 and the determining section 11 so that the dual port memory 32 can serve as a third memory means. That is, the dual port memory 32 permits the printing section 30 and the determining section 11 to access the dual port memory 32 to read and write data.

Figure 2:
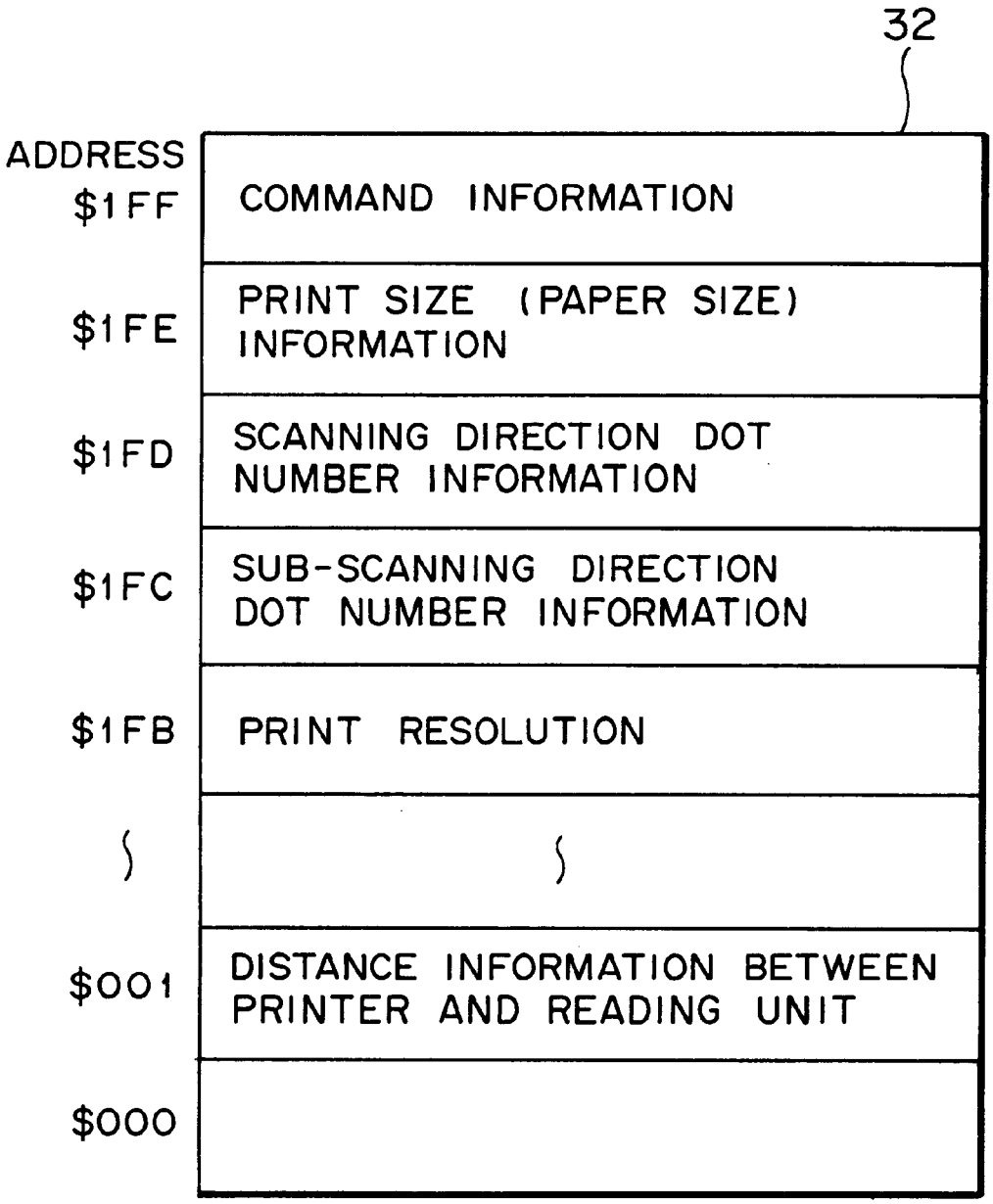
FIG. 2 is a diagram showing an example of data allocation in a dual port memory according to the first embodiment of the present invention.

FIG. 2 is a diagram showing an example of data allocation in the dual port memory 32 according to the first embodiment of the present invention. According to the data allocation of the dual port memory 32 shown in FIG. 2, each region is allocated with control information. That is, the first instructing signal sent from the printing section 30, i.e., command information, print size (paper size) information, information indicative of the dot number in the scanning direction, information indicative of the dot number in the sub-scanning direction, information indicative of print resolution, information indicative of the distance between the printer (printing section 30) to the reading unit 12, and so on, are written in the regions of the dual port memory 32.

The command information corresponds to a trigger signal for starting the printing operation. The print size represents the size of the data to be printed, the size of the continuous paper 9, and the number of pages of the continuous paper 9. The information indicative of the dot number in the scanning direction informs of that the number of dots in the scanning direction within a unit page is 100 dpi (Dot per Inch), for example. Similarly, the information indicative of the dot number in the sub-scanning direction informs of the number of dots in the sub-scanning direction. Further, the information indicative of print resolution represents the resolution of the print face. For example, resolution such as of 240 dpi, 300 dpi is informed as the resolution.

Further, the information indicative of the distance between the printing section 30 to the reading section 12 represents, for example, the distance between a position at which the print image is transferred in the printing section 30 to a position at which reading is started in the reading unit 12. The distance may be represented in a form of a length or a number of pages of the continuous paper 9 between the positions. The distance information can be arbitrary set. The first instructing signal containing the distance information is sent from the printing section 30 to the reading unit 12 each time printing has been carried out on a predetermined length of the continuous paper 9. Therefore, the first instructing signal functions as a start signal for starting the reading operation of the printed image on the continuous paper 9. The information is formed of a plurality of bits and the contents of instruction is determined depending on the value represented by the bits. For example, if 1/60 in. of the print size information is denoted by 1 LSB (Least Significant Bit), 11 in. can be denoted as "0294" on the basis of hexadecimal notation.

In this way, the reading unit 12 counts the signal sent from the printing section 30 each time the print face of the predetermined length or predetermined number of pages has been printed. Further, the reading unit 12 compares the counted value with the read length or read number of pages, and starts reading operation of the printed image on the continuous paper 9. Thus, operations can be carried out at a high precision.

Further, according to the above arrangement, the information indicative of the paper size and print size, information indicative of the dot number in the scanning direction, the information indicative of the dot number in the sub-scanning direction, and the information indicative of the print resolution can be changed dynamically at every page. That is, since the dual port memory 32 is provided so that the first instructing signal is sent from the dual port memory 32 to the comparing unit 13, the printing section 30 can issue various kinds of instructions to the comparing unit 13.

The data line 21*a* (see FIG. 1) connects the mechanism control unit 31 and the comparing unit 13 to each other so that the data to be printed is sent from the mechanism control unit 31 to the comparing unit 13. Similarly, the data line 21*b* connects the mechanism control unit 31 and the comparing unit 13 to each other so that a pulse signal composed of a plurality of pulses with a predetermined time interval is sent from the mechanism control unit 31 to the comparing unit 13. The data line 21*b* functions as a control data sending means. Owing to the pulse signal with the predetermined time interval, the comparing unit 13 can recognize the distance that the continuous paper 9 has traveled. The operation thereof will be more fully described later on.

The data line 21*c* connects the dual port memory 32 with the comparing unit 13 so that the first instructing signal can be sent from the dual port memory 32 to the comparing unit 13. Examples useful for explaining the concrete utilization will hereinafter be introduced with the description of various embodiments and modifications.

Similarly, data line 21*d* connects the dual port memory 32 with the comparing unit 13 so that the second instructing signal can be sent from the comparing unit 13 to the dual port memory 32. The second instructing signal contains at least printed image data. Thus, the second instructing signal is utilized for informing of the state of the determining section 11 or utilized as a control signal for controlling the printing operation carried out by the printing section 30. Accordingly, the second instructing signal is sent from the determining section 11 to the printing section 30. The second instructing signal will hereinafter be more concretely described with various embodiments and modifications.

The continuous paper 9 having the face printed in the printing section 30 is conveyed to the reading unit 12. In the reading unit 12, the printed image of the continuous paper 9 is read as image data by a CCD camera. The acquired printed image data is stored in the second memory 14*b*. On the other hand, the data to be printed sent from the printing section 30 is stored in the first memory 14*a*. Then, the comparing unit 13 compares the data to be printed stored in the first memory 14*a* with the printed image data stored in the second memory 14*b*.

In order to make the comparing unit 13 compare the data to be printed with the printed image data, the mechanism control unit 31 sends the data to be printed supplied from the upper controller unit 33 to the comparing unit 13 through the data line 21*a*. Further, the mechanism control unit 31 writes the first instructing signal into the dual port memory 32. The first instructing signal written into the dual port memory 32 is read by the comparing unit 13 through the data line 21*c*.

Figure 3:
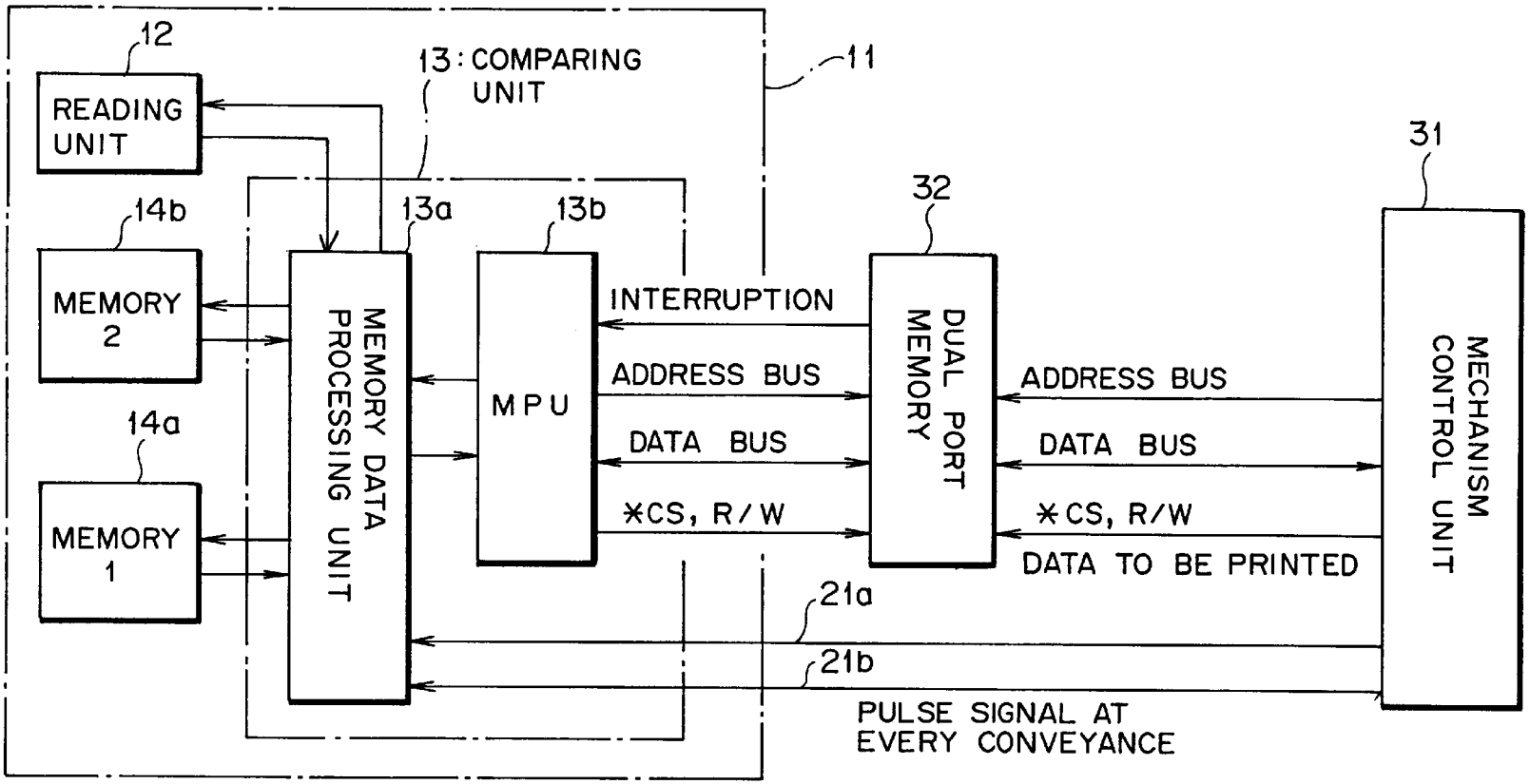
FIG. 3 is a diagram useful for explaining an operation of the dual port memory according to the first embodiment of the present invention.

FIG. 3 is a diagram useful for explaining an operation of the dual port memory 32 according to the first embodiment of the present invention. The comparing unit 13 provided within the determining section 11 shown in FIG. 3 includes a memory data processing unit 13*a* and an MPU (Micro Processing Unit) 13*b*. The memory data processing unit 13*a* manages the data to be printed at every page. This function can be realized by a software, for example. Further, the MPU 13*b* is arranged to detect interruption or carry out arithmetic operation. Other known matter will not be described in detail.

The dual port memory 32 is connected to the MPU 13*b* within the comparing unit 13 and the mechanism control unit 31. The dual port memory 32 and the MPU 13*b* are connected to each other through various kinds of signal lines such as an interruption line, an address bus, a data bus, a chip select signal line (denoted as *CS), and a read/write enable signal line (denoted as R/W). Further, the dual port memory 32 and the mechanism control unit 31 are connected to each other through various signal lines such as an address bus, a data bus, a chip select signal line (denoted as *CS) and a read/write enable signal line (denoted as R/W)

When a piece of information is written into the dual port memory 32 at a specific address, the interruption signal indicative of that the information is written into the dual port memory 32 is sent to the MPU 13*b*. When the MPU 13*b* receives the interruption signal from the dual port memory 32, the MPU 31*b* starts reading the data to be printed which has been written in the first memory 14*a* through the memory data processing unit 13*a*. Further, the MPU 13*b* starts reading the printed image data which has been written in the second memory 14*b* through the memory data processing unit 13*a*. If the first memory 14*a* is accessed at a regular interval to effect polling, it becomes possible to confirm that rewriting has been done.

Meanwhile, the mechanism control unit 31 and the memory data processing unit 13*a* are directly connected to each other through the data lines 21*a* and 21*b*.

Thus, the data to be printed sent from the upper controller unit 33 (see FIG. 1) is directly transferred from the mechanism control unit 31 through the data line 21*a* to the comparing unit 13. Further, the MPU 13*b* provided within the comparing unit 13 stores the data to be printed into the first memory 14*a* in accordance with the data size information indicative of the dot number in the scanning direction, the dot number in the sub-scanning direction of the data to be printed sent from the mechanism control unit 31. Then, the memory data processing unit 13*a* carries out data management at every page, whereby the data to be printed undergoes storing processing into the memory.

Now, operation carried out when the paper conveying speed at the printing section 30 is coincident with the paper conveying speed at the reading unit 12 will be described with reference to FIG. 4 and FIG. 5(*a*) to FIG. 5(*d*).

Figure 4:
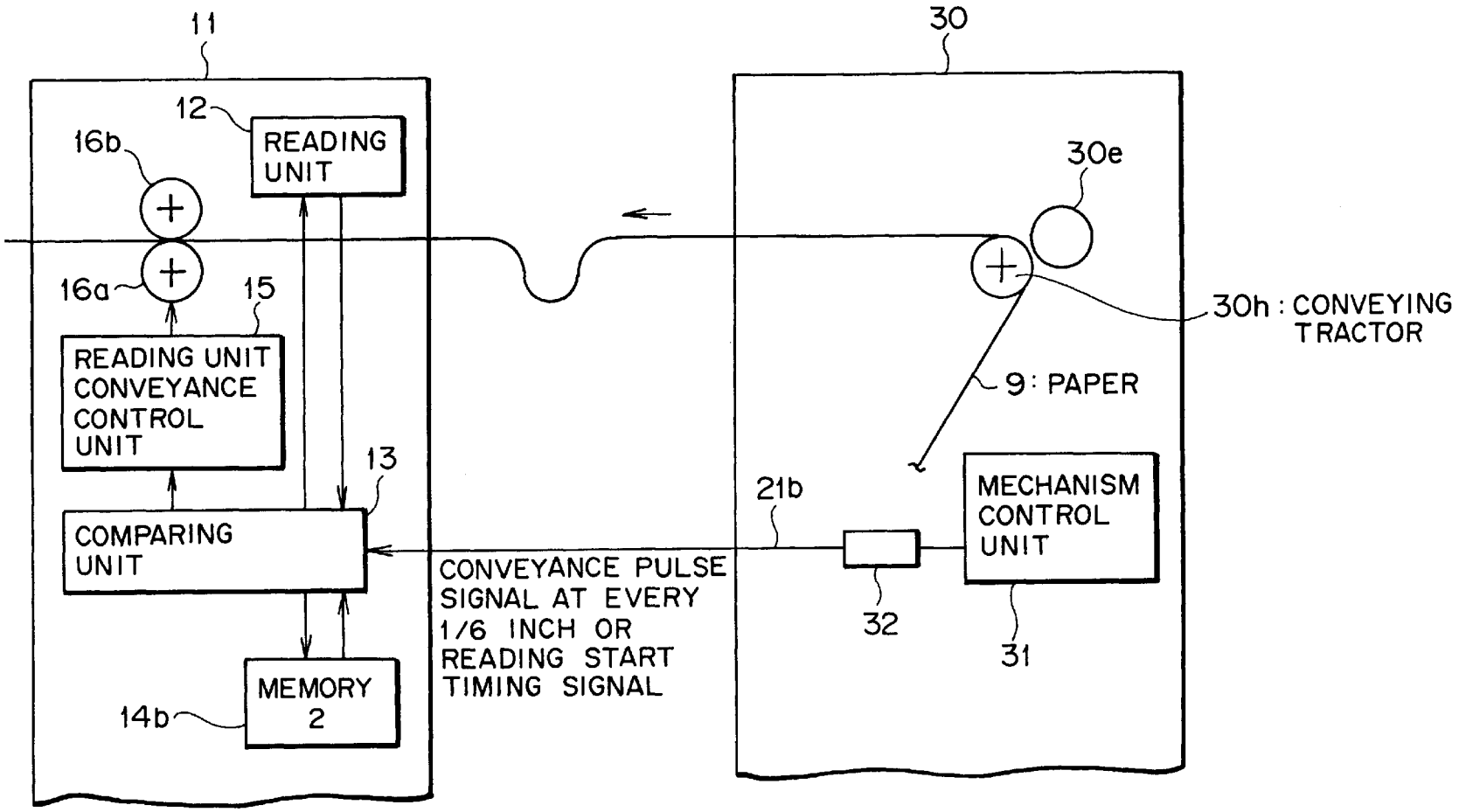
FIG. 4 is a diagram useful for explaining a method for establishing synchronism in the read start timing according to the first embodiment of the present invention.

FIG. 4 is a diagram useful for explaining a method for establishing synchronism in the read start timing according to the first embodiment of the present invention. As shown in FIG. 4, the continuous paper 9 is loaded in the printer system so as to extend from the printing section 30 to the determining section 11. The continuous paper 9 is conveyed by the conveying tractor 30*h* provided within the printing section 30. The continuous paper 9 is further conveyed by the paper conveying mechanism 16*a*, 16*b* within the determining section 11. Parts shown in FIG. 4 attached with the same reference numerals as those in FIG. 1 are respectively identical. Therefore, they will not be further described and only parts necessary to be described are illustrated.

The mechanism control unit 31 provided within the printing section 30 sends control data through the dual port memory 32 and the data line 21*b* to the comparing unit 13 provided within the determining section 11. The comparing unit 13 supplies a control signal to the reading unit conveying control unit 15 based on the control data. The reading unit conveying control unit 15 controls the paper conveying mechanisms 16*a*, 16*b* in the rotation thereof based on the control signal. As will be described later on, the control data is formed of conveying pulse signal data at every ⅙ in. or reading start timing signal data. Owing to the control data, the conveying speed of the printing section 30 and the conveying speed of the reading section 12 are brought into synchronism with each other.

Figures 5A, 5B, 5C, 5D:
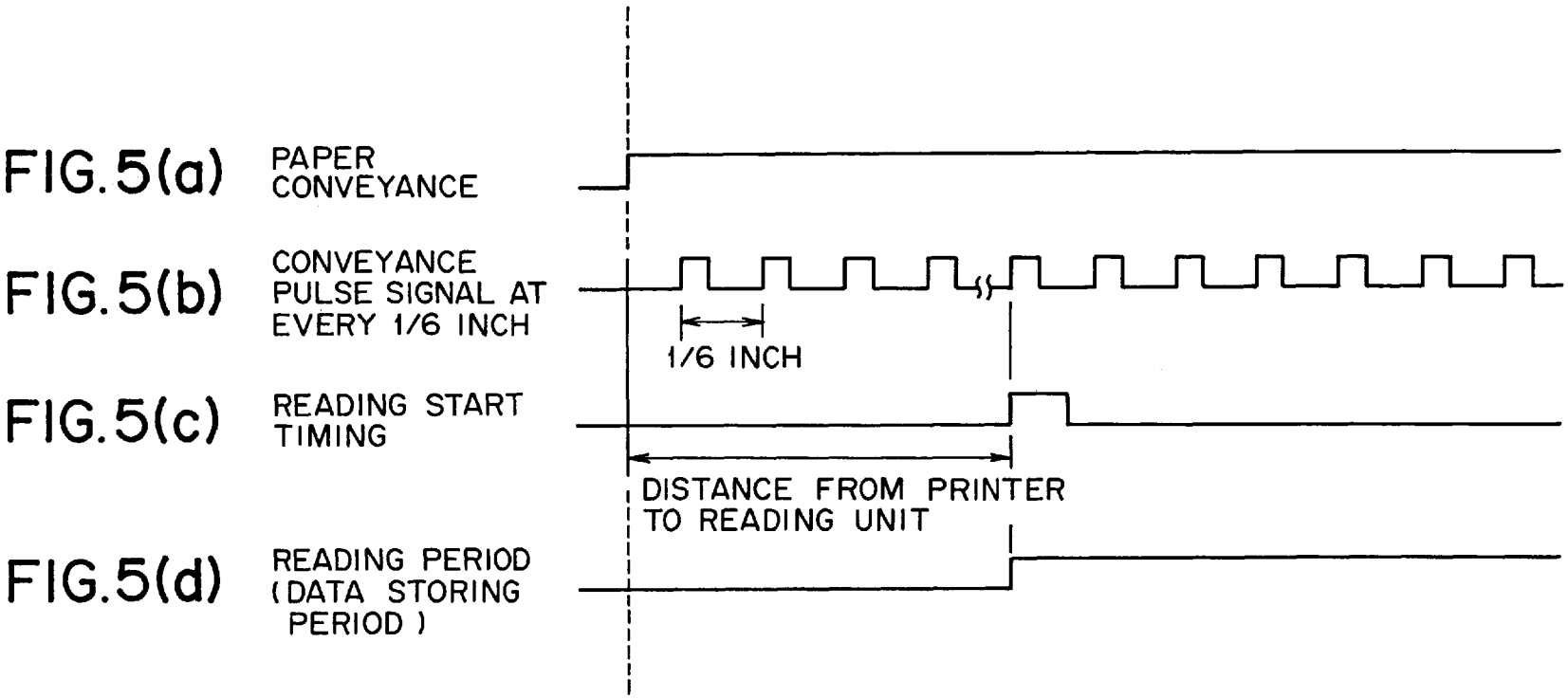
FIG. 5(*a*) to FIG. 5(*d*) are timing charts each showing the read start timing according to the first embodiment of the present invention.

FIG. 5(*a*) to FIG. 5(*d*) are timing charts showing the reading start timing according to the first embodiment of the present invention, in which there is shown a case where the paper conveying speed of the printing unit 30 is coincident with the paper conveying speed of the reading unit 12. The signals shown in FIG. 5(*a*) to FIG. 5(*d*) are based on a positive logic. The signal denoted as "paper transportation" in FIG. 5(*a*) is a paper conveying enable signal of the continuous paper 9 (denoted as "paper" in FIG. 5(*a*) ). The pulse signal composed of pulses standing at every ⅙ in. paper conveying shown in FIG. 5(*b*) is a time signal counted at every conveying of the continuous paper 9. When the signal is sent from the printing section 30 to the determining section 11, it becomes possible to measure the distance which the continuous paper 9 has traveled.

The signal with a notation of "reading start timing" shown in FIG. 5(*c*) is a start signal supplied from the printing section 30 to the determining section 11. When the signal status becomes the high level, then the reading unit 12 starts reading operation. Further, the start signal is arranged to become high after the time has elapsed from the timing when the paper transportation signal shown in FIG. 5(*a*) becomes high to the timing when the continuous paper 9 has traveled the distance between the printing section 30 to the reading unit 12. The signal with a notation of "reading period" shown in FIG. 5(*d*) indicates a timing period (data storing period) during which the reading unit 12 reads the printed image on the continuous paper 9 and the read printed image data stored in the second memory 14*b*. The signal shown in FIG. 5(*d*) is in synchronism with the reading start timing shown in FIG. 5(*c*).

The comparing unit 13 is supplied with the first instructing signal through the data line 21*c* and the pulse signal through the data line 21*b*. When the comparing unit 13 counts the number of pulses and detects that the counted number of pulses becomes coincident with a number of pulses corresponding to a traveling distance which has been notified in advance, then reading is started. In this way, the read data starts undergoing management as the printed image data.

As described above, when the paper conveying speed of the printing section 30 is identical to the paper conveying speed of the reading unit 12, the determining section 11 can count the number of pulses so as to detect the predetermined travel distance of the continuous paper 9. Moreover, the determining section 11 can be informed of the reading start signal accurately. Therefore, it becomes possible to recognize the timing when the read printed image data shall be stored into the second memory 14*b*, with the result that the printed image data of the continuous paper 9 can be subjected to the management.

If the continuous paper 9 is fed at the same speed in both of the printing section 30 and the reading unit 12, the control can be carried out in another mode. That is, the control is carried out in a mode in which print management is carried out at every page. That is, since the mechanism control unit 31 of the printing section 30 also controls the conveying of the continuous paper 9, after the continuous paper 9 has traveled the predetermined distance, the comparing unit 13 may be informed of a timing when printed image reading is started on the continuous paper 9 or a timing when the read data is stored into the second memory 14*b*. When the comparing unit 13 receives the timing signal which is supplied from the mechanism control unit 31 and useful for starting the reading operation of the printed image on the continuous paper 9, the comparing unit 13 makes the reading unit 12 start reading. Further, when the comparing unit 13 receives the timing signal for storing the read data into the second memory 14*b*, the printed image data from the reading unit 12 is stored into the second memory 14*b*.

In this way, since the determining section 11 can be accurately informed of the reading start signal, the determining section 11 can accurately detect the timing when the data shall be stored into the second memory 14*b*. Therefore, the printed image data acquired from the continuous paper 9 can well conform to the management.

Next, if the paper conveying speed in the printing section 30 is different from the paper conveying speed in the reading unit 12, then data management is carried out at every page. The case where the paper conveying speed in the printing section 30 is different from the paper conveying speed in the reading unit 12, includes a case where a unit for controlling the paper conveying is independently provided as a system arrangement or a case where it is difficult to perfectly coincide both of the paper conveying speeds with each other. In these cases, the paper conveying speed difference will become large as an accumulated error upon printing the paper continuously. In more concretely, if the paper conveying speed in the printing section 30 (see FIG. 4) is different from the paper conveying speed in the reading unit 12 and the conveying timings thereof are not synchronous with each other, the following drawbacks are expected. That is, if the paper conveying speed is in the reading unit 12 is faster than the paper conveying speed in the printing section 30, then the continuous paper 9 is pinched between the printer section 30 and the reading unit 12, with the result that the continuous paper will be torn. Conversely, if the paper conveying speed in the printing section 30 is faster than the paper conveying speed in the reading unit 12, then the slack amount of the continuous paper 9 is increased, with the result that malfunction is expected.

For this reason, the printing system is arranged as follows. That is, the paper conveying speed of the continuous paper 9 in the reading unit 12 is set faster than the paper conveying speed in the printing section 30. The continuous paper 9 is conveyed by a predetermined distance in response to a pulse signal of every ⅙ in. feeding of the paper, as for example shown in FIG. 5(*b*). In the reading unit 12, the printed image formed on the continuous paper 9 is read. In this way, the printed image data can be managed at every page.

According to the above arrangement, the accumulated error will not be caused on the continuous paper 9, with the result that the printing operation can be carried out with stability. Further, control can be effected in both of the cases in which the paper conveying speeds are identical to each other or different from each other, with the result that operation can be carried out reliably.

Now description will be made on a mode in which the printing section 30 controls the determining section 11 by using a control mark attached on the continuous paper 9.

Figure 6:
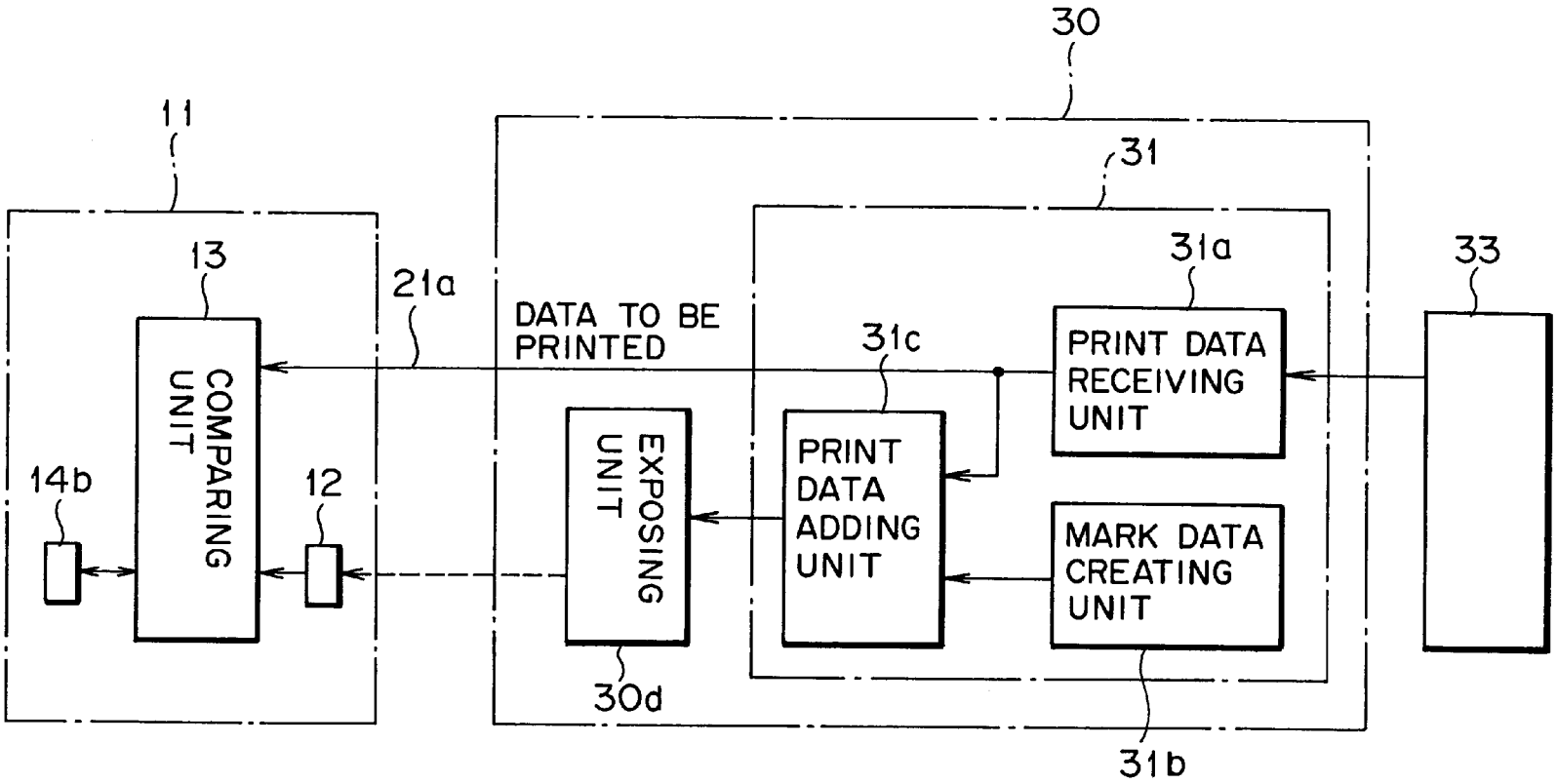
FIG. 6 is a diagram useful for explaining a method for generating print data according to the first embodiment of the present invention.

FIG. 6 is a diagram useful for explaining a method for generating print data according to the first embodiment of the present invention. The mechanism control unit 31 shown in FIG. 6 includes a print data receiving unit (print data receiving means) 31*a*, a mark data creating unit (mark data creating means) 31*b*, and a print data adding unit (print data adding means) 31*c*.

The print data receiving unit 31*a* is arranged to receive data to be printed. The mark data creating unit 31*b* is arranged to create and hold data regarding the control mark useful for controlling the start and stop of the reading operation. The print data adding unit 31*c* is arranged to synthesize the data to be printed and the data regarding the control mark together so as to form a print image. The synthesized print image is supplied to the exposing unit 30*d* as print data. The above function can be implemented by a software, for example.

According to the above arrangement, the data to be printed sent from the upper controller unit 33 is supplied to the print data receiving unit 31*a* provided within the printing section 30. The print data receiving unit 31*a* supplies the data to be printed to the comparing unit 13 and the print data adding unit 31*c*. Further, the print data adding unit 31*c* is supplied with the data to be printed and the data of the control mark sent from the mark data creating unit 31*b* so that the data are added together to form a print image. The synthesized print image is supplied to the exposing unit 30*d* as print data. The printed image is exposed under light in the exposing unit 30*d* so that the print data is printed on the continuous paper 9. Thus, the printed data is supplied from the exposing unit 30*d* to the determining section 11 as a dotted line shown in the figure, while the data to be printed is supplied to the determining section 11.

The reading unit 12 reads printed image on the continuous paper 9 and supplies the read printed image data to the comparing unit 13. The comparing unit 13 registers the data of the control mark in the second memory 14*b* in advance. When the comparing unit 13 is supplied with the printed image data from the reading unit 12, the comparing unit 13 carries out a pattern matching operation on the printed image data with the data of the control mark, thereby extracting only the printed image data that shall be read actually. Thus, a pattern except for the control mark portion is compared with a pattern sent from the mechanism control unit 31 and stored in the first memory 14*a*. That is, the comparing unit 13 has a function to identify the control mark, in addition to the above-described functions. The function for identifying the control mark is effected in such a manner that the pattern of the mark is registered in the second memory 14*b* in advance and the comparing unit 13 compares the mark pattern with the printed image data.

Figure 7:
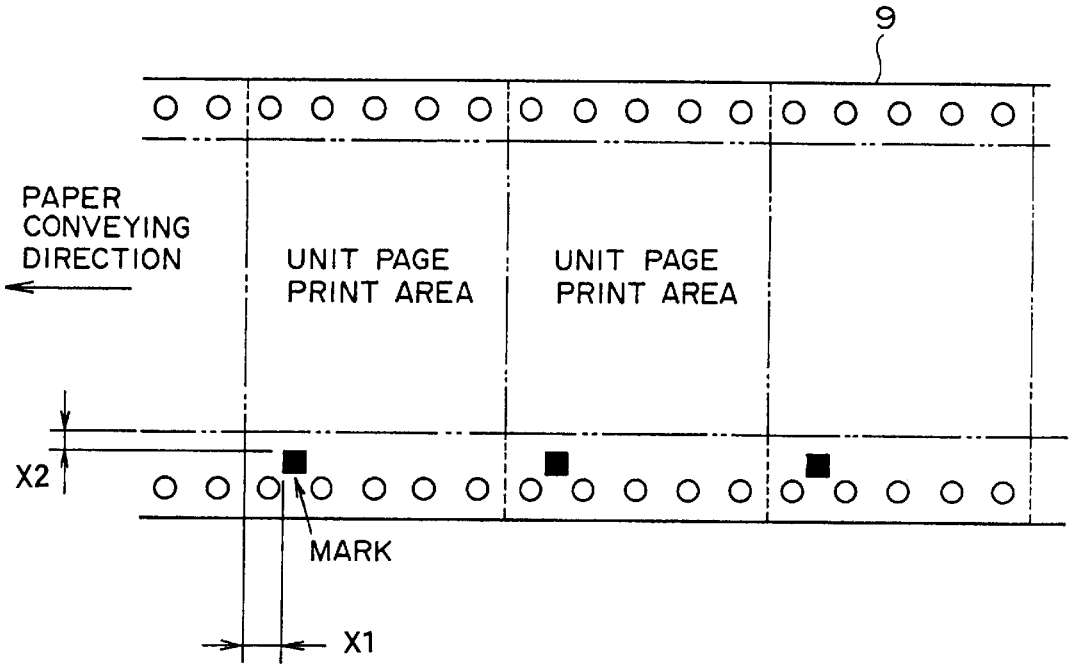
FIG. 7 is a diagram showing the relationship between an print area on continuous paper and a mark print position according to the first embodiment of the present invention.

FIG. 7 is a diagram showing the relationship between the print area on the continuous paper 9 and a mark print position according to the first embodiment of the present invention. The direction from the right to the left of FIG. 7 is a direction in which the paper is conveyed (print conveying direction). The continuous paper 9 can be divided into three kinds of regions in parallel with the print conveying direction. That is, the continuous paper 9 has regions in which perforation for conveying the paper is provided, at both the sides, or the upper end side and the lower end side thereof. Between the regions, there is provided a print region, and the control mark of solid square is provided in the lower side region. The reading unit 12 detects the control mark, which serves for controlling the start and stop of the reading operation, from the printed image on the continuous paper 9, whereby the printing section 30 controls the reading unit 12.

Reference symbols denoted as X1, X2 represent a value indicative of the position at which the control mark is located (unit is inch). These values can be arbitrarily set. Further, the control mark is not included in the data to be printed supplied from the upper controller 33.

The printing section 30 prints the control mark on each page upon initiating printing the page. In more concretely, the data to be printed supplied from the upper controller unit 33 is sent to the print data receiving unit 30*a*. Further, the mark data creating unit 31*b* creates data of the control mark. The print data adding unit 31*c* adds the data to be printed and data regarding the control mark together to synthesize a single print image. The synthesized print image data is supplied to the exposing unit 30*d* as shown in FIG. 1. Then, an electrostatic latent image of the data to be printed is formed on the surface of the photosensitive drum 30*c*. Thus, printing is carried out. Further, the continuous paper 9 having an image printed thereon in the exposing unit 30*d* is conveyed to the determining unit 11 as shown by the dotted line in FIG. 6, and the comparing unit 13 carries out comparison between the data.

On the other hand, the print data receiving unit 31*a* shown in FIG. 6 send the received data to be printed to the reading unit 12 through the data line 21*a*. The printed image on the continuous paper 9 is read by the reading unit 12 and the acquired print image data is stored in the second memory 14*b*. The comparing unit 13 extracts a mark pattern corresponding to the mark pattern data registered in advance, from the printed image data by using the pattern matching algorism. Data to be read on a unit of page on the print face of the continuous paper 9 is selected in accordance with the position of the control mark. Thus, the printed image data except for the mark pattern and the data to be printed stored in the first memory 14*a* are compared with each other.

As described above, the control mark is printed outside the ordinary print region, and hence the data of the control mark is not included in the data to be printed sent from the upper controller unit 33. Therefore, if the data sent from the printing section 30 is compared with the data of the printed image, then it becomes possible to detect an abnormal print portion if caused in the printing section 30. Moreover, the comparing unit 13 can recognize the control mark and the data to be printed, and hence can detect abnormal printing upon carrying out comparison.

Figure 8:
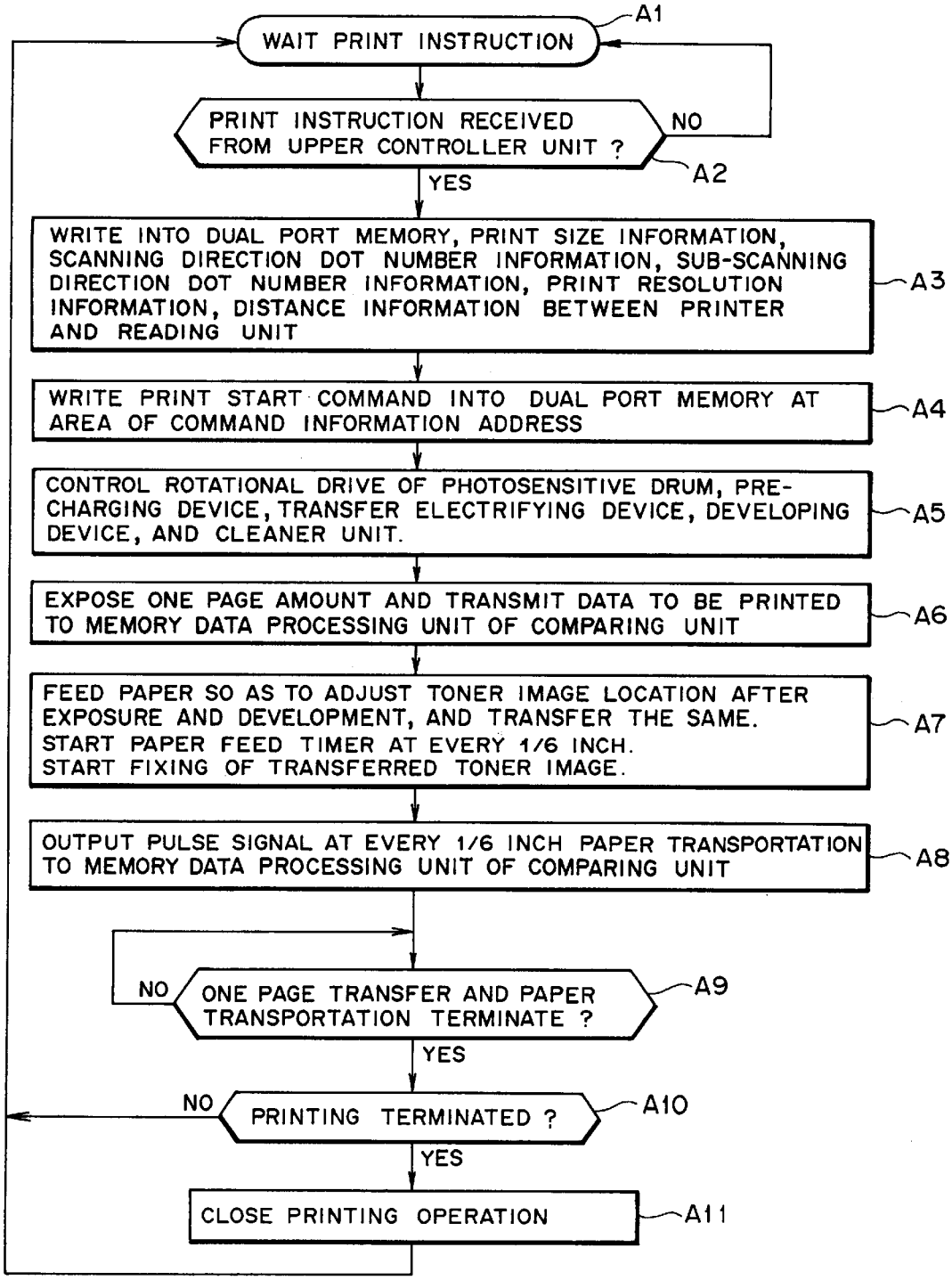
FIG. 8 is a flowchart showing operations of printing, reading and comparing carried out by a print unit according to the first embodiment of the present invention.

With the above-described arrangement, printing, reading and comparison are carried out. FIG. 8 is a flowchart showing the operation of the printing, reading and comparison carried out by the printing section 30 according to the first embodiment of the present invention. Initially, the printing section is placed in a waiting mode at step A1. At step A2, the printing section 30 takes NO route unless the printing section 30 receives any print instruction from the upper controller unit 33, and returns to step A1. If the printing section 30 receives a print instruction from the upper controller unit 33, the printing section 30 takes YES route to go to step A3. At step A3, the mechanism control unit 31 writes, into the dual port memory 32, various information such as the print size information, information of dot number in the scanning direction, information of dot number in the sub-scanning direction, (information of) print resolution, information of distance between the printer (printing unit 30) and the reading unit 12.

At step A4, a command of print start (print initiation) is written into the dual port memory 32 at a region corresponding to the address of the command information (see FIG. 2). At step A5, the photosensitive drum 30*e*, the pre-charging device 30*c*, the transfer electrifying device 30*f*, the developing device 30*g*, the cleaner unit 30*b* are controlled so as to carryout printing.

At step A6, the printing section 30 carries out an exposing step for one page amount of print face, and then sends the data to be printed to the memory data processing unit 13*a* provided within the comparing unit 13 (see FIG. 3). At step A7, after exposing and developing the toner image, the printing section 30 conveys the paper (continuous paper 9) to the next stage for image transfer so as to adjust the conveying amount of paper to the location of the toner image. Further, at the step A7, a timer for counting every ⅙ in. conveying is triggered for paper conveying. Thus, the toner image is started to be transferred to the continuous paper 9 and fixed thereon.

At step A8, a pulse signal is supplied to the memory data processing unit 13*a* provided within the comparing unit 13 at every ⅙ in. paper conveying.

At step A9, it is determined whether the one page amount of transfer and paper conveying have been done or not. If it is determined that the one page amount of transfer and paper conveying have not been done yet, then No route is taken and the transfer operation and paper conveying operation are continued. If it is determined that the one page amount of transfer and paper conveying is completed, YES route is taken. At step A10, it is determined whether the whole printing operation has been done or not. If it is determined that the whole printing operation has not been done yet, then NO route is taken and the processing returns to the routine beginning with step Al again. If it is determined that the whole printing is completed, then YES route is taken and the print operation is halted at step A11.

In this way, the printing section 30 informs the comparing unit 13 of the paper size and the size of data to be printed at every page. Therefore, even if printed image data of a plurality of pages are continuously sent from the printing section 30 to the comparing unit 13, the comparing unit 13 can determine accurately the data of each page. Accordingly, it becomes possible to carry out continuous processing at a high rate. Moreover, read data can be brought into comparison at every page, and hence error can be positively prevented.

Figure 9:
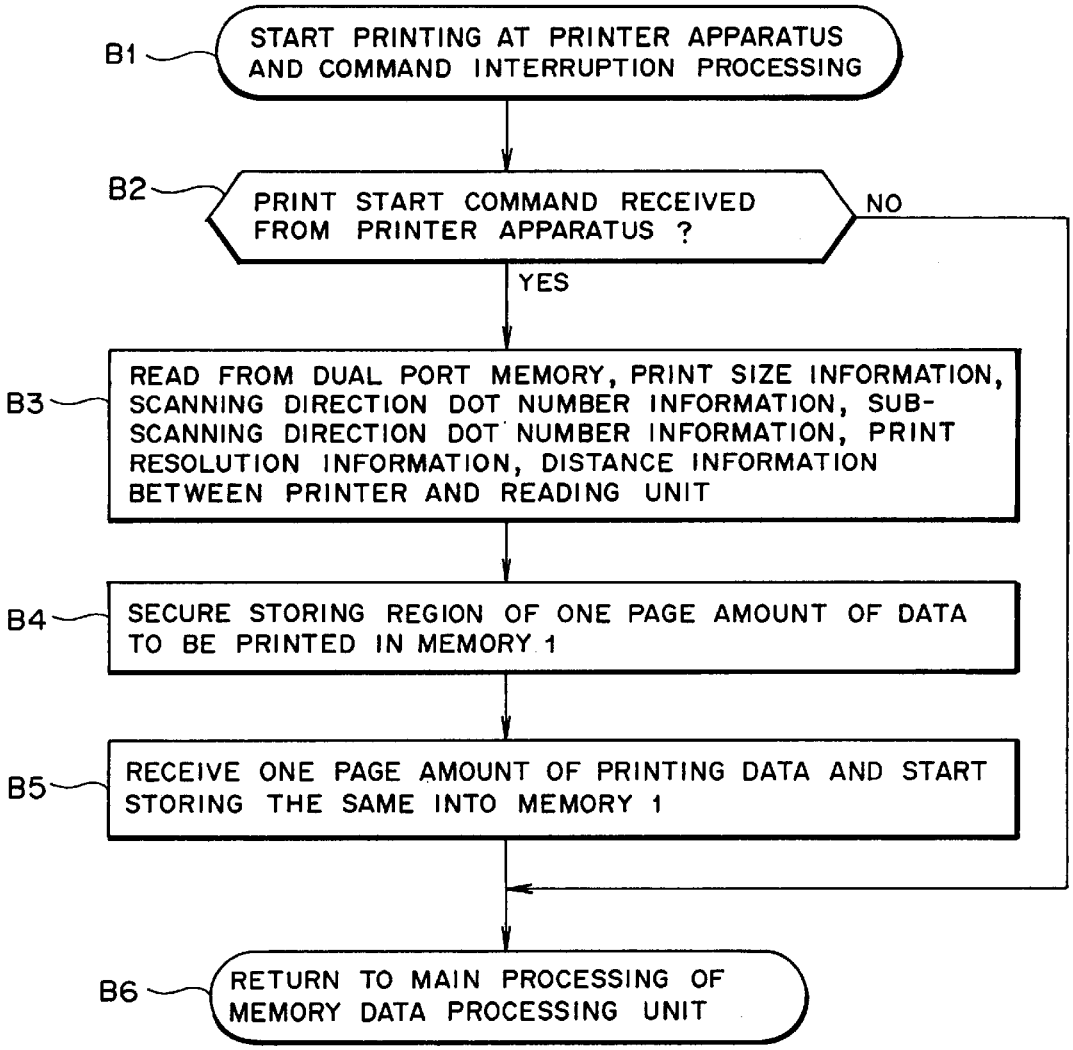
FIG. 9 is a flowchart showing a processing operation carried out by a comparing unit according to the first embodiment of the present invention.

FIG. 9 is a flowchart showing the processing operation carried out in the comparing unit 13 according to the first embodiment of the present invention. The routine shown in FIG. 9 beginning with step B1 is executed when the printer effects a print start command interruption processing on the comparing unit 13. Initially, if the comparing unit 13 receives the print start command sent from the printer at step B2, then YES route is taken. At step B3, the comparing unit 13 reads print size information, information of dot number in the scanning direction, information of dot number in the sub-scanning direction, (information of) print resolution, information of distance between the printer (printing section 30) to the reading unit 12, from the dual port memory 32.

Subsequently, at step B4, the comparing unit 13 secures a storing region for data to be printed of one page amount in the first memory 14*a* (memory 1). At step B5, the comparing unit 13 receives the data to be printed of one page amount, and starts storing the data to be printed into the first memory 14*a*. At step B6, the processing goes to the main processing routine of the memory data processing unit 13*a*. In the notation of steps B4 and B5, the first memory 14*a* is denoted as memory 1. Further, if the comparing unit 13 does not receive the print start command from the printer at step B2, then No route is taken and the processing goes to the main processing routine of the memory data processing unit 13*a* from step B6.

Figure 10:
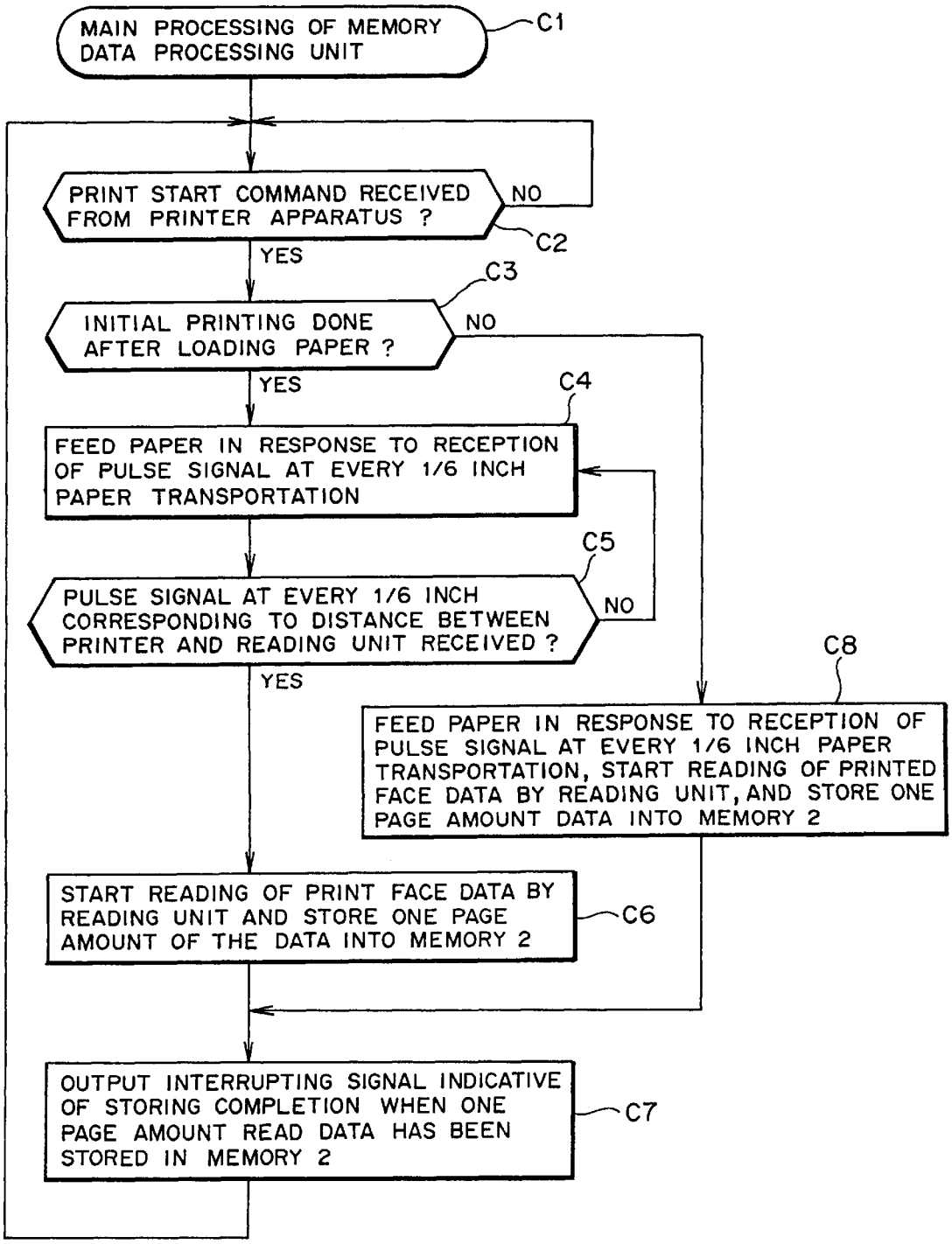
FIG. 10 is a flowchart showing a main processing of a main data processing unit according to the first embodiment of the present invention.

FIG. 10 is a flowchart showing a main processing of the main data processing unit 13*a* according to the first embodiment of the present invention. At step C1 shown in FIG. 10, the main data processing unit 13*a* provided within the comparing unit 13 starts the main processing. At step C2, the main data processing unit 13*a* determines whether the print start command from the printer has been already received or not. If the print start command has been received, then YES route is taken, and processing goes to step C3. If the command has not been received yet, then NO route is taken and the same processing is done continuously.

At step C3, the main data processing unit 13*a* determines whether or not the print command is the first printing after loading the paper. If it is determined the printing is the first printing, then YES route is taken. At step C4, the main data processing unit 13*a* conveys the paper in response to the pulse signal of every ⅙ in. paper conveying. At step C5, the main data processing unit 13*a* determines whether the pulse signal of the every ⅙ in. paper conveying corresponding to the distance from the printer to the reading unit 12 has been received or not.

At step C5, if it is determined that the main data processing unit 13*a* has not received the pulse signal corresponding to the distance between the printer to the reading unit 12 yet, then NO route is taken and the processing returns to step C4. If it is determined that the main data processing unit 13*a* has received the pulse signal corresponding to the distance between the printer to the reading unit 12, then YES route is taken. At step C6, the main data processing unit 13*a* starts reading the printed image data of the reading unit 12 so that the printed image data of one page amount is stored in the second memory 14*b* (memory 2). If the main data processing unit 13*a* has stored the read one page amount printed image data into the second memory 14*b*, then, at step C7, the main data processing unit 13*a* generates an interruption signal indicating that the data storing is completed.

At step C3, if the main data processing unit 13*a* determines that the print command is not the first print after the paper is loaded, NO route is taken and the processing goes to step C8. At step C8, paper conveying is carried out in accordance with the pulse signal of every ⅙ in. paper conveying, data reading of the printed image data is started by the reading unit 12, and the printed image data of one page amount is stored into the second memory 14*b*.

In this way, the comparing unit 13 can carry out an arithmetic operation based on the printed page size information sent from the printing section 30, and read data corresponding to the print size from the second memory 14*b*. Further, the reading unit 12 can start reading based on a predetermined timing signal, and hence the comparing unit 13 can carry out comparison so as to correspond to the data to be printed.

Figure 11:
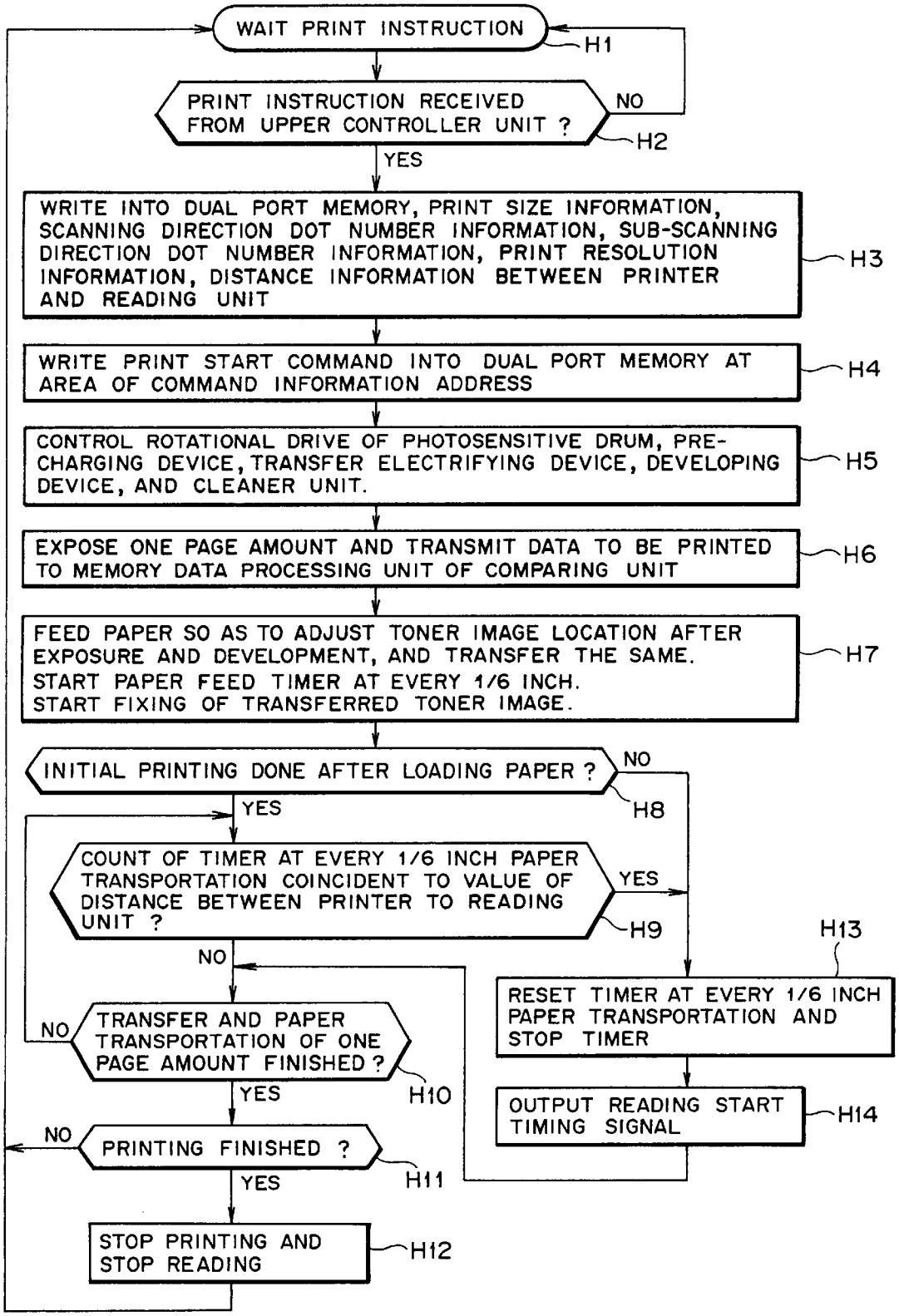
FIG. 11 is a flowchart showing operations of printing, reading and comparing of a mechanism control unit according to the first embodiment of the present invention.

If the printing section 30 and the reading unit 12 convey the continuous paper 9 at the same speed, the processing is carried out as follows. FIG. 11 is a flowchart showing operations of printing, reading and comparing of the mechanism control unit 31 according to the first embodiment of the present invention. At step H1 shown in FIG. 11, the mechanism control unit 31 is placed in a waiting mode for waiting for a print instruction. At step H2, if the mechanism control unit 31 does not receive any print instruction from the upper controller unit 33, No route is taken to return to step H1. If the mechanism control unit 31 receives a print instruction from the upper controller unit 33, then YES route is taken to go to step H3. At step H3, the mechanism control unit 31 writes various information such as print size information, dot number information in the scanning direction, dot number information in the sub-scanning direction, (information of) print resolution, information of distance between the printer (printing section 30) to the reading unit 12 into the dual port memory 32.

At step H4, the mechanism control unit 31 writes the print start command into the dual port memory 32 at an address of command information. At step H5, the mechanism control unit 31 carries out control for printing. In more concretely, the mechanism control unit 31 controls the photosensitive drum 30*e* in its rotation, the pre-charging device 30*c*, the transfer electrifying device 30*f*, the developing device 30*g*, and the cleaner unit 30*b*.

At step H6, the mechanism control unit 31 executes exposing of one page amount and transmits the data to be printed to the memory data processing unit 13*a* provided within the comparing unit 13 (see FIG. 3). At step H7, the mechanism control unit 31 conveys the paper so that the toner image having undergone the exposure process and developing process is shifted to an appropriate position, and then transfers the image to the paper. Further, at step H7, the mechanism control unit 31 starts the timer of every ⅙ in. paper conveying, and also starts fixing of the transferred toner image.

At step H8, the mechanism control unit 31 determines whether the print command is the first one after the paper is loaded. If it is determined that the print command is the first one, YES route is taken to go to step H9. At step H9, the mechanism control unit 31 determines whether or not the count value of the timer for every ⅙ in. paper conveying reaches the value of distance between the printer and the reading unit 12. If it is determined that the value reaches the distance, No route is taken to go to step H10. At step H10, the mechanism control unit 31 determines whether the one page amount transfer and paper conveying have been done or not. If it is determined that the paper conveying is completed, YES route is taken to go to step H11. At step H11, it is determined whether the printing is completed or not. If it is determined that the printing is completed, YES route is taken to go to step H12. At step H12, the mechanism control unit 31 carries out print halting processing and reading halting processing. Then, the processing returns to step H1 to initiate the operations of printing, reading and comparing of the mechanism control unit 31. If at step H10 one page amount of transfer and paper conveying are not completed, NO route is taken to return to step H9. At step H11, if the printing is not completed, NO route is taken to return to step H1 and the operations of printing, reading and comparing of the mechanism control unit 31 is again started.

If No route is taken at step H8 and YES route is taken at step H9, the processing goes to step H13 in which the mechanism control unit 31 clears the count of the time of every ⅙ in. paper conveying and halting the timer. At step H14, the mechanism control unit 31 generates a reading start timing signal to carry out the process of step H10.

As described above, it becomes possible to calculate the time it takes for the printed image corresponding to the data to be printed upon starting the printing to travel the distance from the printing section 30 to the reading position of the reading unit 12. Therefore, it is possible to determine the reading start timing of the printed image for the reading unit 12.

Further, as described above, information concerning the paper size or the size of data to be printed at every page is transmitted between the printing section 30 and the comparing unit 13. Thus, processing can be carried out continuously at a high rate and error can be positively prevented. Moreover, the reading operation is started in response to the timing signal transmitted between the printing section 30 and the reading unit 12. Therefore, comparison can be carried out appropriately. Furthermore, with the control using the control mark, the operator can load the paper 9 without difficulty.

As described above, even if a plurality of printers are connected to a single printer line, each of the plurality of printers can print on paper with each paper size and at each resolution. Further, comparing operation can be carried out in each printer in accordance with the paper size and resolution.

(A1) Description of a First Modification of the First Embodiment of the Present Invention The control mark employed in the first embodiment may be variably positioned on the continuous paper 9 upon printing.

The present modification has the same arrangement as that of the continuous medium printing apparatus of the first embodiment (see FIG. 1). Therefore, the arrangement thereof will not be described.

Figure 12:
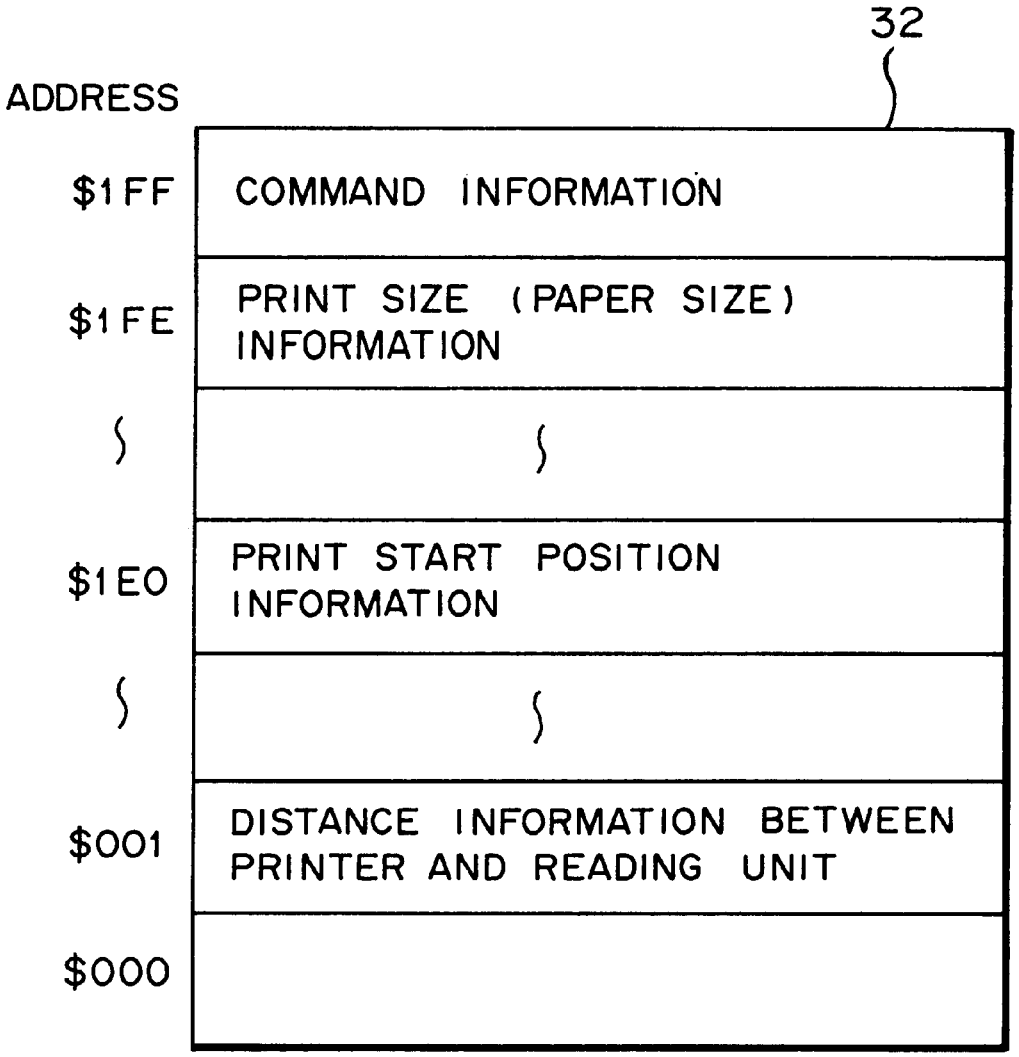
FIG. 12 is a diagram showing an example of data allocation in the dual port memory according to a first modification of the first embodiment of the present invention.

FIG. 12 is a diagram showing an example of data allocation in the dual port memory 32 according to the first modification of the first embodiment of the present invention. As shown in FIG. 12, print start position information is written in the dual port memory 32 at an address $1E0. The reading unit 12 is informed by the print start position information of an amount of deviation of the location of the print image data on the continuous paper 9 with respect to the normal print location.

Figure 13:
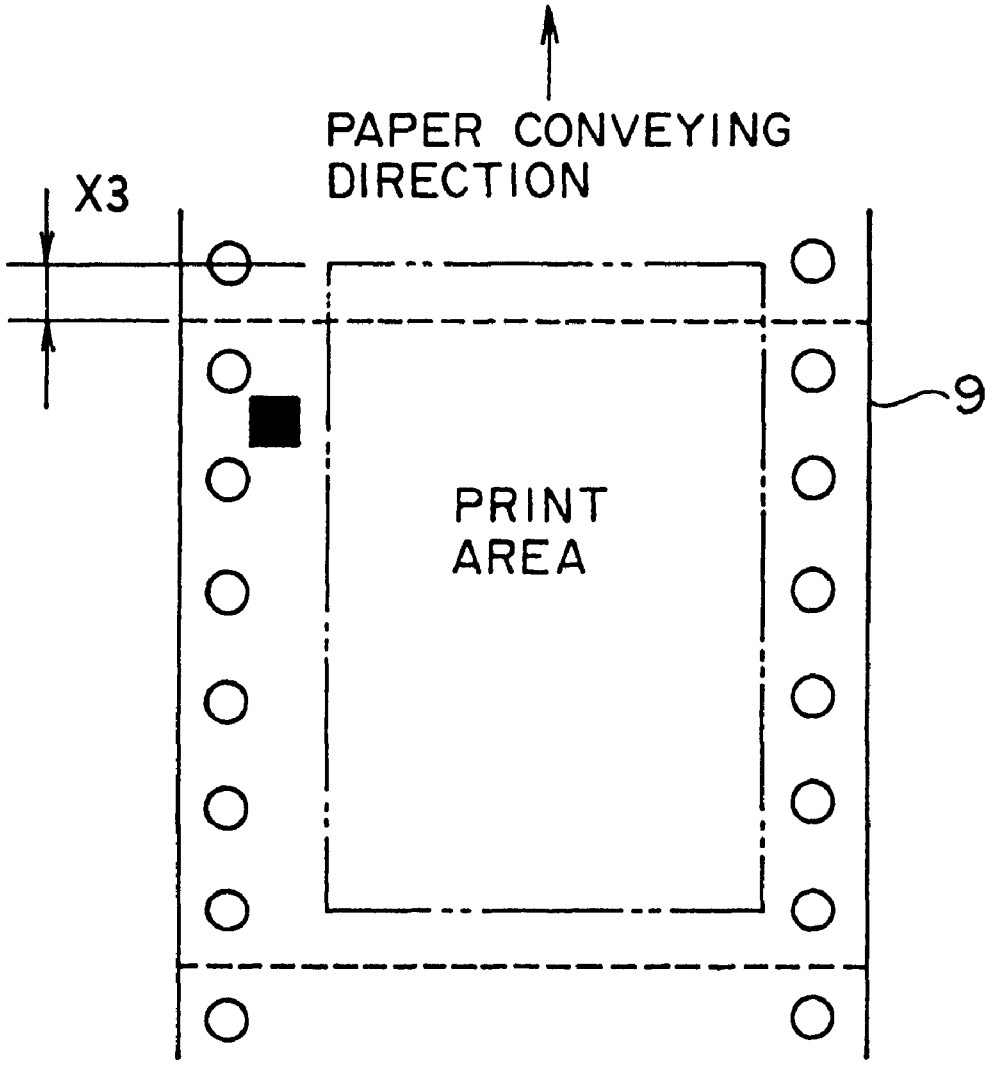
FIG. 13 is a diagram showing the relationship between a print area and a mark print position on a continuous paper according to the first modification of the first embodiment of the present invention.

FIG. 13 is a diagram showing the relationship between the print area and the mark print position on the continuous paper 9 according to the first modification of the first embodiment of the present invention. The print area shown in FIG. 13 is deviated from the page partitioning position by X3 (inch). In this case, the print area reaches the reading position earlier as compared with a case where the print area is ordinarily located. The value of X3 serves as an indication indicating before how much distance relative to the page partitioning position the reading unit 12 shall start reading. Similarly to the above-described first embodiment, the control mark of a solid square is attached to region different from the print area prepared for each page.

The value of X3 can be variably set within a range from 1 in. to −1 in. relative to an ordinary location, and numerical notation is made in such a manner that 1LSB is made to correspond to 1/24 in. For example, if X3=1 in., then the print start position information is denoted as "000(HEX)" and if X3=3/24, the print start position information is denoted as "003(HEX)" . Thus, the reading unit 12 starts reading at a position before 1 in. or 3/24 in., respectively. Conversely, if the print area is deviated in the direction apart from the reading unit 12, for example, if X3=−1 in., then the print start position information is denoted as "003(HEX)" where (HEX) represents that the figures are denoted based on hexadecimal notation system.

As described above, data representing the relationship between the position for the data to be printed sent from the mechanism control unit 31 and the control mark position and data representing positional relationship with the page of the continuous paper 9 are sent from the dual port memory 32 to the comparing unit 13.

According to the above arrangement, if the printing section 30 changes the information written in the dual port memory 32, then the relationship between the position of data to be printed and the position of the control mark can be changed. Further, the reading unit 12 can read the printed image in accordance with the changed position. Thereafter, a mark pattern registered in advance can be extracted from the printed image data stored in the second memory 14*b* by using a pattern matching algorism. The printed image data of read one page amount can be identified in accordance with the control mark position.

According to the above arrangement, in both of the case in which the paper conveying speed of the printing section 30 is the same as the paper conveying speed of the reading unit 12 and the case in which they are different from each other, if the comparing unit 13 is informed of the positional relationship between the page under printing and page under reading, then it becomes possible to correct the timing when the printed image data read by the reading unit 12 is stored into the second memory 14*b*. In this way, it becomes possible to manage the data to be printed and the printed image data and compare the data to be printed and the printed image data with each other at every page.

As described above, the control mark is printed outside the region in which the ordinary printing is carried out. In other words, the control mark is printed at an area different from the area for the data to be printed. Therefore, it becomes possible to detect that the printing section 30 prints abnormally.

Moreover, as described above, the printed position is read by the reading unit 12 and it is determined whether the instruction concerning the print position is accurately carried out or not. Therefore, if the printing section 30 supplies information indicating that how much distance the printing position is shifted by with respect to the control mark, to the comparing unit 13, then the comparing unit 13 can compare the data to be printed with the data acquired by reading the printed image by using the control mark as a reference.

Therefore, according to the above arrangement, if the data to be printed is printed at a position shifted with respect to the control mark and hence the positional relationship between the data to be printed and the control mark is varied, determination can be made correctly when the comparing unit 13 compares the data to be printed with the data acquired by reading the printed image. Accordingly, it becomes possible to prevent a wrong determination deriving from the shift of the printed data.

Further, as described above, if the positional relationship on the continuous paper 9 contains a positional shift, the positional shift is compensated upon carrying out comparing processing and the printed image data can be managed at a unit of page. Therefore, a circuit for setting the print position of the control mark can be obviated. Accordingly, the comparing processing can be carried out without increasing a scale of the circuit.

(A2) Description of a Second Modification of the First Embodiment According to the Present Invention The continuous paper 9 may not necessarily have a blank face but be printed with a ruled line, letters symbols and so on. These printed images are known as a preprint. If the continuous paper 9 is printed with an image of preprint in advance, the reading unit 12 may acquire the preprint information in addition to the printed image data corresponding to the data to be printed, and the data added together will be stored into the second memory 14*b*. Therefore, if the comparing unit 13 compares the data to be printed, which is stored in the first memory 14*a*, with the printed image data stored in the second memory 14*b*, the comparing unit 13 can detect discrepancy between the data to be printed and the printed image data, which causes a chance to make a wrong determination.

Figure 14:
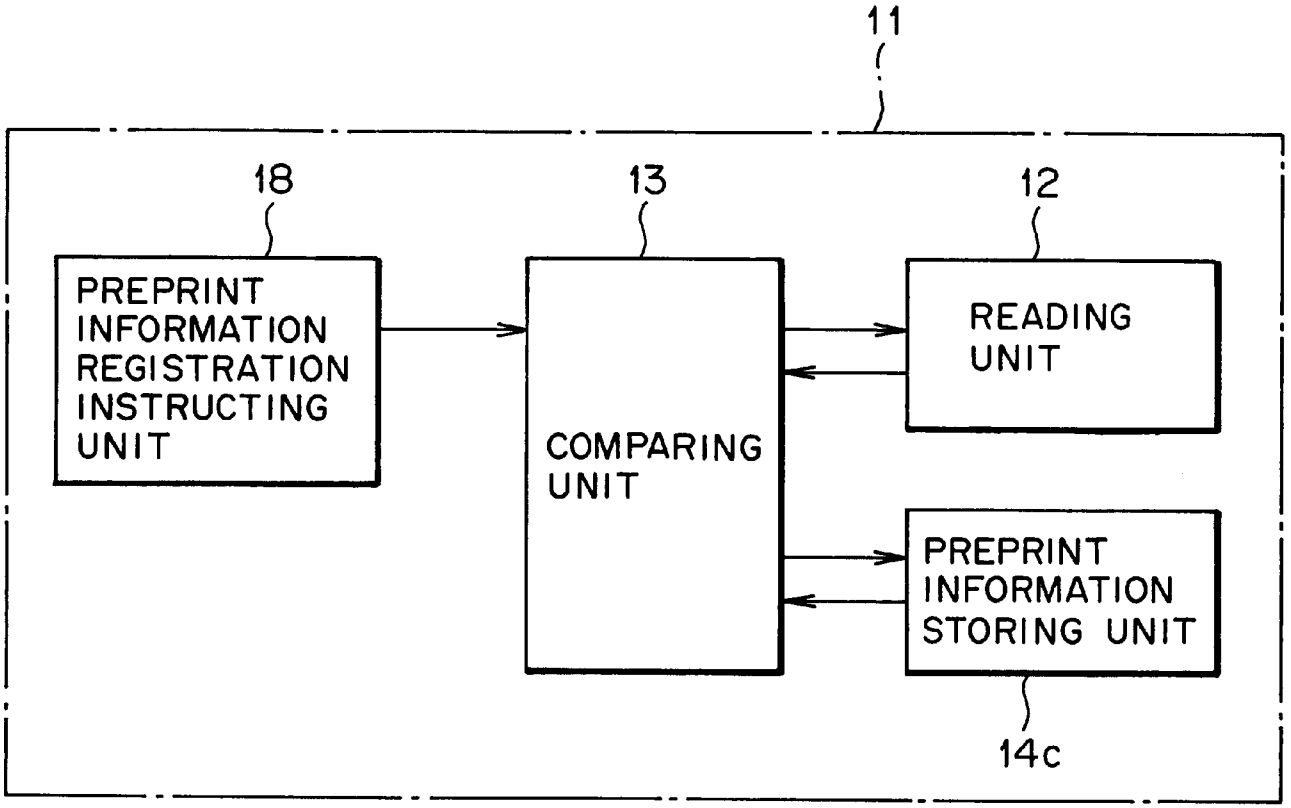
FIG. 14 is a diagram showing an arrangement of a determining unit according to a second modification of the first embodiment of the present invention.

FIG. 14 is a diagram showing an arrangement of the determining section 11 according to the second modification of the first embodiment of the present invention. The determining section 11 shown in FIG. 14 is arranged to include, in addition to the reading unit 12 and the comparing unit 13, a preprint information storing unit (preprint information storing means) 14*c* and a preprint information registration instructing unit (preprint information registration instructing means) 18.

Also, the continuous medium printing apparatus of the present modification has the same arrangement as the arrangement shown in FIG. 1. Therefore, further description thereof will be omitted. In addition, since the reading unit 12 and the comparing unit 13 are similar to those described above, they will not be described.

The preprint information storing unit 14*c* is arranged to store therein each of preprint information of a plurality of kinds of printed images composed of a ruled line, a character, a symbol or the like. The function thereof can be implemented by a third memory (not shown) such as a hard disk. Further, the preprint information storing unit 14*c* is arranged such that after the continuous paper 9 is loaded in the printing section 30 and the reading unit 12, the preprint information storing unit 14*c* acquires the print image of the preprint information of the loaded continuous paper 9.

The preprint information registration instructing unit 18 is utilized for inputting therein a kind of preprint information selected by an operator from the plurality of print images memorized in the preprint information storing unit 14*c*. The function thereof can be implemented by a registration panel by which the operator carries out directly the input operation.

Figure 15:
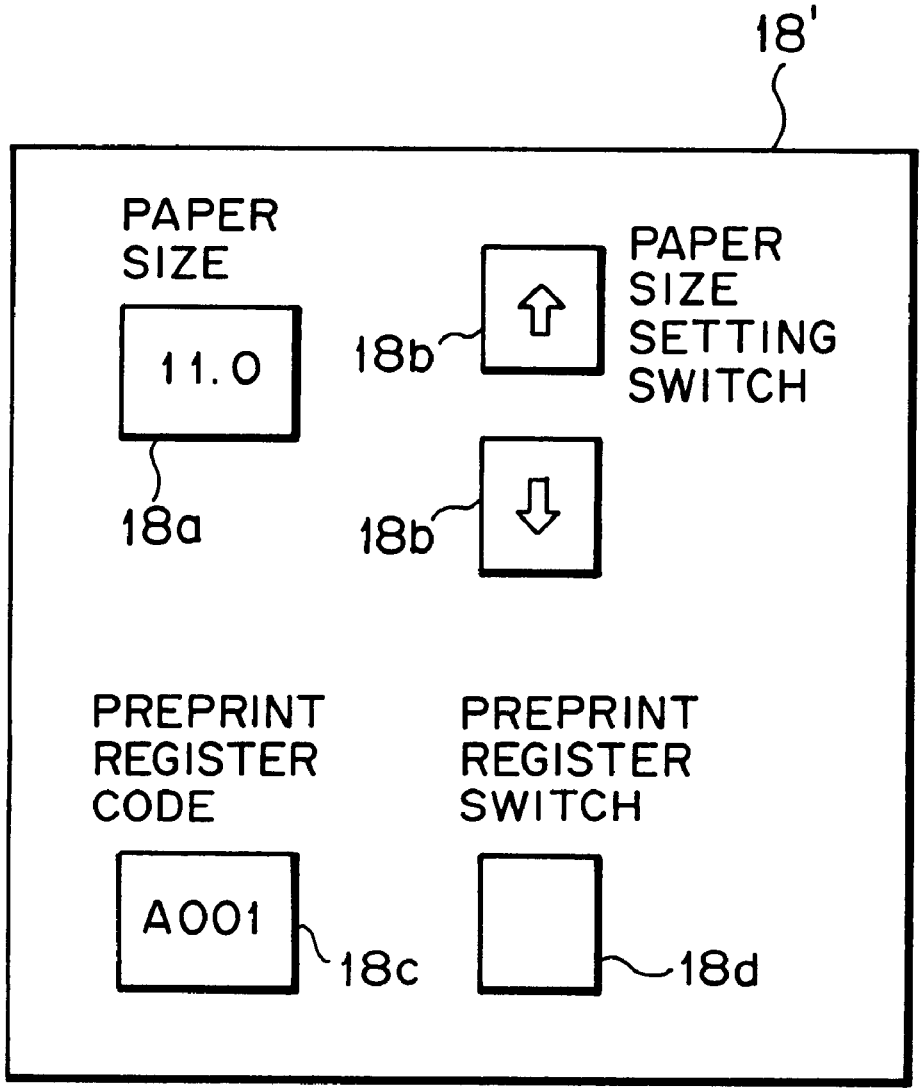
FIG. 15 is a schematic diagram of a preprint registering panel according to the second modification of the first embodiment of the present invention.

FIG. 15 is a schematic diagram of a preprint registration panel according to the second modification of the first embodiment of the present invention. The preprint registration panel 18' shown in FIG. 15 includes two kinds of display units 18*a*, 18*c*, a paper size setting switch 18*b*, and a preprint register switch 18*d*. The display unit 18*a* is utilized for displaying the paper size such as 11.0 in. or the like and if the operator sets the paper size by using the paper size setting switch 18*b*, the display unit 18*a* changes its display depending on the set paper size. The display unit 18*c* is utilized for displaying a preprint registration code such as a code of A001 or the like. When the operator sets a registration code by using the preprint register switch 18*d*, the display unit 18*c* changes its display depending on the set code.

The preprint information registration processing is carried out in such a manner that the preprint information registration instructing unit 18 (see FIG. 14) issues a registration instruction to the comparing unit 13, the reading unit 12 reads the preprint information, the read preprint information is stored into the preprint information storing unit 14*c*, and the comparing unit 13 reads the preprint information when the comparing unit carries out the comparison. Further, the comparing unit 13 compares the selected one kind of preprint information and the data to be printed with the printed image data. The preprint registration code can be entered directly by the operator with a keyboard of a personal computer (not shown).

In this way, the operator registers the preprint information of the continuous paper 9 which does not undergo the print processing in advance by using the above-described preprint registration panel 18'. When the comparing unit 13 carries out the comparing operation, the comparing unit 13 adds the contents of the first memory 14*a* and the preprint information together on a bit map basis, and the data deriving from the addition is compared with the data stored in the second memory 14*b*. Thus, the printed paper is subjected to the determination for determining whether the print result is satisfactory or not.

Figure 16:
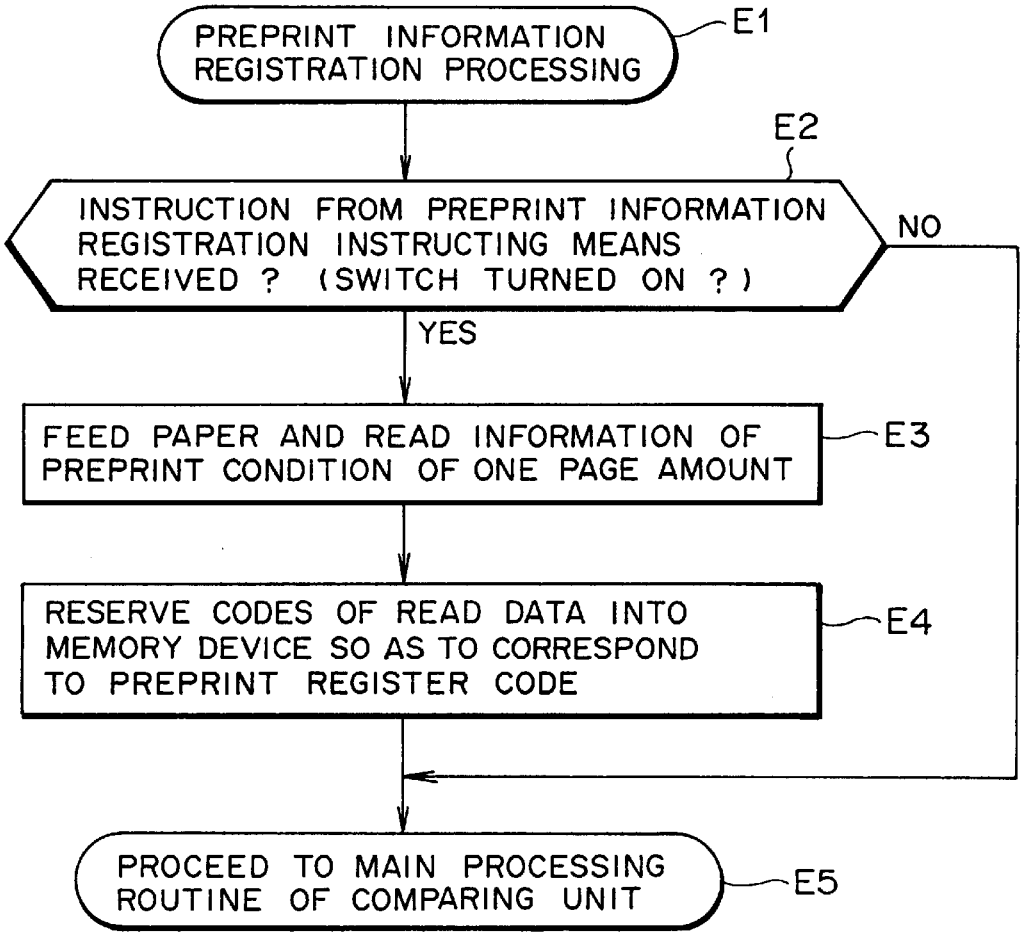
FIG. 16 is a flowchart showing the comparing operation of the comparing unit according to the second modification of the first embodiment of the present invention.

With the above-described arrangement, comparing operation using the preprint information is carried out. FIG. 16 is a flowchart showing the comparing operation of the comparing unit 13 according to the second modification of the first embodiment of the present invention. At step E1 shown in FIG. 16, registration processing of the preprint information is started. At step E2, the comparing unit 13 determines whether or not any instruction or a switch-on signal is received from the preprint information registration instructing unit 18. If it is determined that the instruction or the signal has been received, then YES route is taken to go to step E3. At step E3, the comparing unit 13 conveys the continuous paper 9 to read a preprint condition of one page amount. At step E4, the comparing unit 13 stores the code of the read data into a memory device (a hard disk or the like, not shown) so as to correspond to the preprint registration code. At step E5, the processing goes to the main processing routine of the comparing unit 13. At step E2, if the comparing unit 13 does not receive the instruction or the switch-on signal from the preprint information registration instructing unit 18, then NO route is taken to carry out the processing of step E5.

Figure 17:
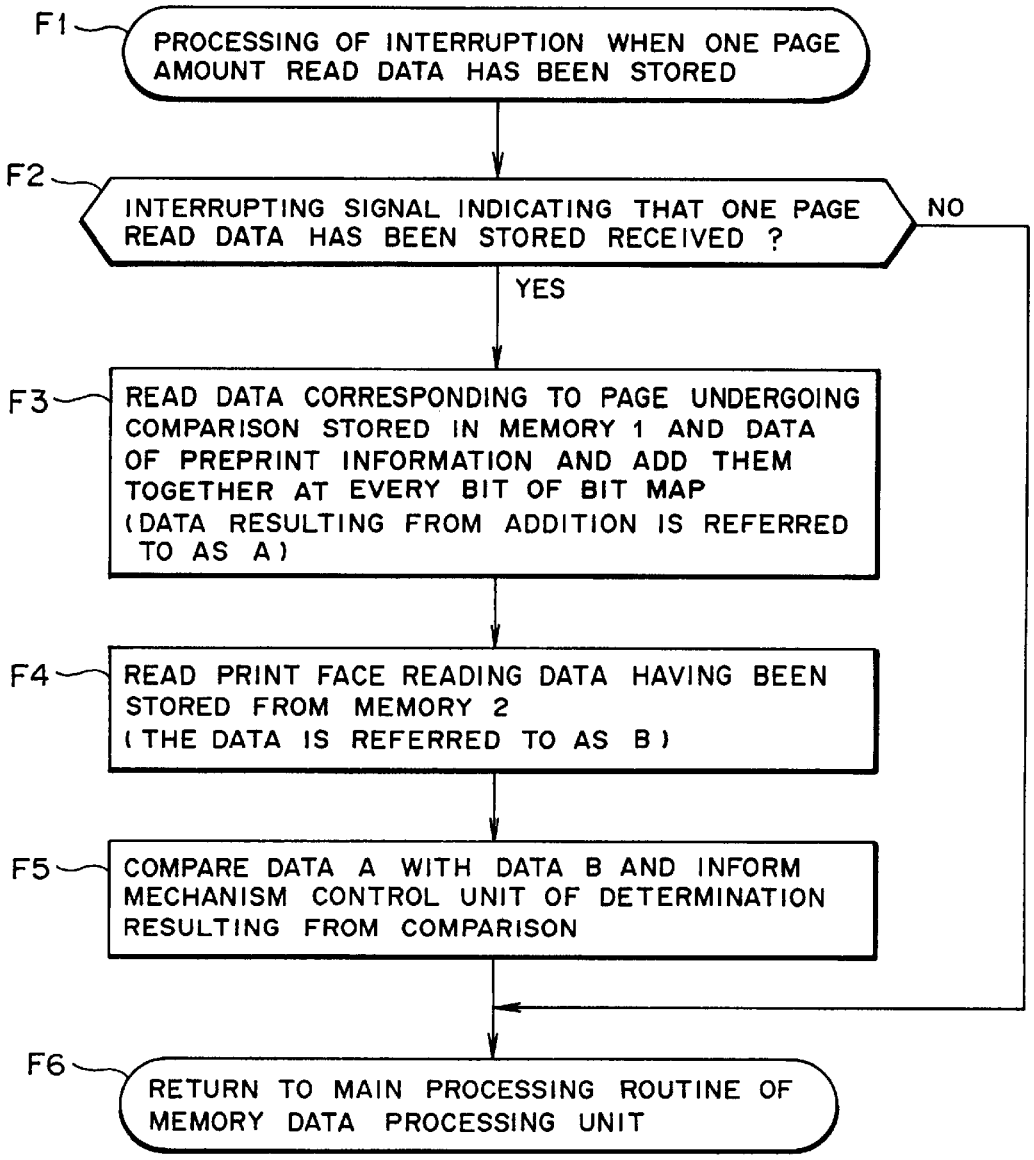
FIG. 17 is a flowchart showing the main processing operation of the comparing unit according to the second modification of the first embodiment of the present invention.

FIG. 17 is a flowchart showing the processing operation of the main processing of the comparing unit 13 according to the second modification of the first embodiment of the present invention. The routine shown in FIG. 17 is started at step F1 when one page amount of read data has been completely stored and interruption processing is carried out.

At step F2, if the comparing unit 13 receives a signal of interruption indicating that the one page amount of read data has been stored, then YES route is taken to go to step F3. At step F3, the comparing unit 13 reads the data corresponding to the page under comparison from the first memory 14*a* and the data of the preprint information, and adds the data together in a bit map basis to obtain data A deriving from the addition. At step F4, the comparing unit 13 reads from the second memory 14*b*, the print face read data (printed image data) having been stored therein to obtain data B. At step F5, the comparing unit 13 compares the data A and data B with each other, and supplies the determined comparing result to the mechanism control unit 31 of the printer and the processing goes to the main processing routine of the memory data processing unit 13*a* from step F6.

As described above, even if the continuous paper 9 is a preprinted paper, when the comparing unit 13 compares the data to be printed with the printed image data, the reading unit 12 reads not only the printed image data but the preprint information. Then, the preprint information is utilized as data for comparison with the data to be printed. Therefore, determination on the comparison can be appropriately carried out.

If the continuous paper 9 is loaded into the printing section 30, the preprint information can be read before printing is started. That is, before printing is started, paper with no printed face except for the preprint information thereon is loaded into the printer system so that the continuous paper extends from the printing section 30 to the reading unit 12. Thus, the reading unit 12 can read the preprint information.

Figure 18:
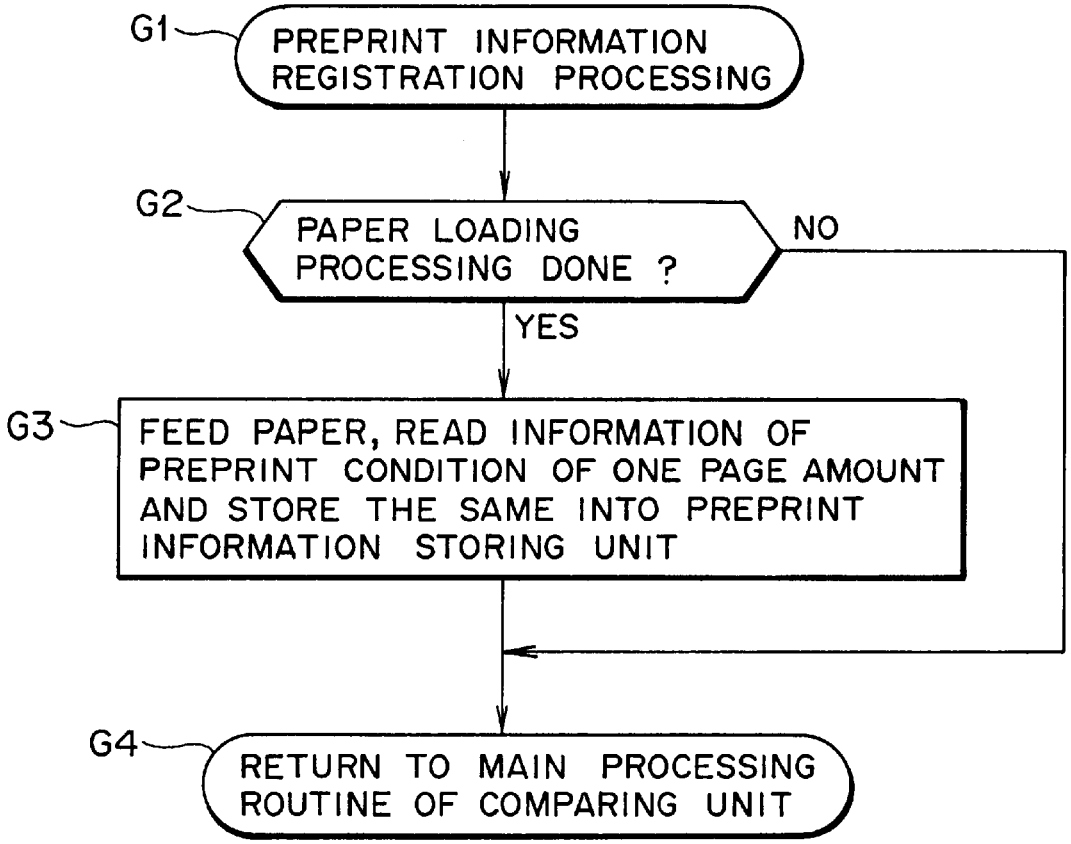
FIG. 18 is a flowchart showing a second comparing operation of the comparing unit according to the second modification of the first embodiment of the present invention.

FIG. 18 is a flowchart showing a second comparing operation of the comparing unit 13 according to the second modification of the first embodiment of the present invention. The routine of the registration processing of the preprint information shown in FIG. 18 begins with step G1. At step G2, the comparing unit 13 determines whether the paper loading operation is carried out or not. If it is determined that the paper loading processing is done, then YES route is taken to go to step G3. At step G3, the comparing unit 13 conveys paper, reads the preprint condition of one page amount, and stores the data acquired by the reading into the preprint information storing unit 14*c*. At step G4, the processing proceeds to the main processing routine of the comparing unit 13 (see FIG. 17). At step G2, if it is determined that the paper loading processing has not been done yet, then NO route is taken to go to the main processing routine of the comparing unit 13 by way of step G4.

As described above, when the operator loads the continuous paper 9 into the reading unit 12, the comparing unit 13 reads the preprint information and holds the information. Therefore, when printing is started, comparison with the data to be printed can be carried out by taking the preprint information into account. Accordingly, comparison can be effected appropriately even on the initially utilized paper with a preprinted image.

Further, as described above, the preprint information is registered in advance and the printing section 30 supplies information indicating the kind of paper to be printed, to the comparing unit 13. Therefore, the reading unit 12 can compare the read data with the data to be printed while correcting the read data by the preprint data. Accordingly, it becomes possible to make a correct determination.

Since the preprint information is read upon loading the paper, it becomes unnecessary for the operator to register the preprint information each time the continuous paper 9 is newly loaded. Therefore, it becomes possible to shorten the time it takes to start the printing, obviate the time for registering the preprint information, and improve the operability.

Figure 19:
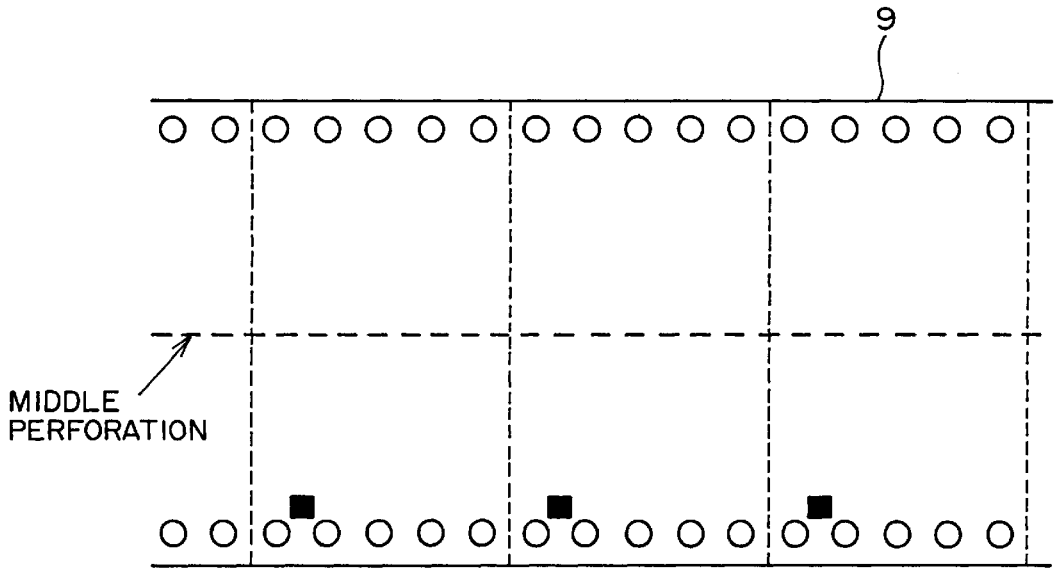
FIG. 19 is a schematic diagram of a continuous paper having a perforation according to a third modification of the first embodiment of the present invention.

(A3) Description of a Third Modification of the First Embodiment According to the Present Invention FIG. 19 is a schematic diagram of the continuous paper 9 having a perforation according to the third modification of the first embodiment of the present invention. As shown in FIG. 19, the continuous paper 9 has a perforation (hereinafter referred to as middle perforation) for folding the paper at the center in parallel with the print conveying direction of the paper 9. Since the reading unit 12 employs a CCD camera, there is a chance that the reading unit 12 recognizes the middle perforation as a dirt spot or a part of the printed image. Therefore, it is necessary to exclude the chance that the middle perforation portion is perceived as an object of comparison.

Also the present modification has the same arrangement as that of the continuous medium printing apparatus 1 (see FIG. 1) of the first embodiment. Therefore, the arrangement thereof will not be described. According to the present modification, the printing section 30 informs the comparing unit 13 of that the print paper contains the middle perforation by means of the first instructing signal.

Figure 20A:
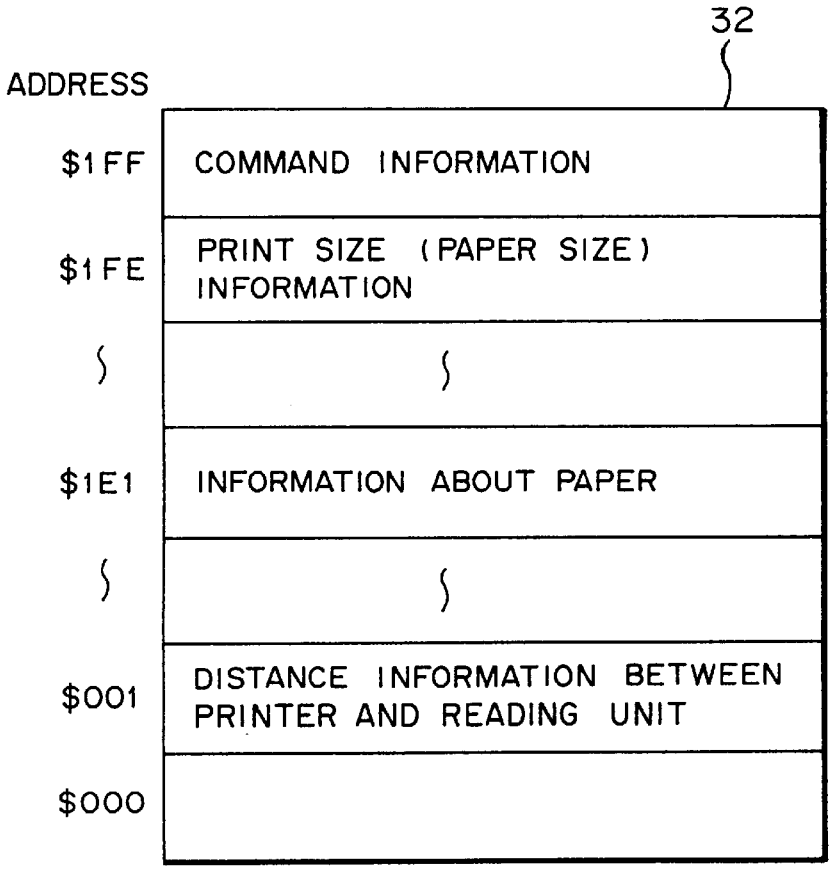
FIG. 20(*a*) is a diagram showing an example of data allocation in the dual port memory according to the third modification of the first embodiment of the present invention.
Figure 20B:
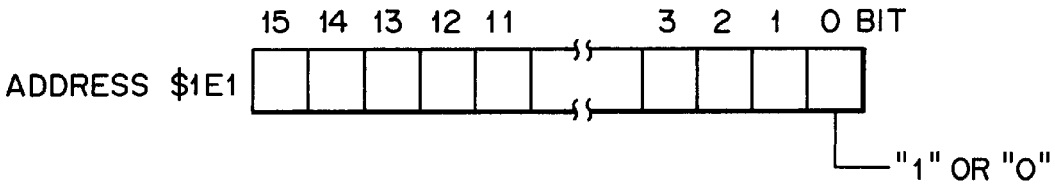

FIG. 20(*a*) is a diagram showing an example of data allocation in the dual port memory 32 according to the third modification of the first embodiment of the present invention. Further, FIG. 20(*b*) is a diagram showing an example of a paper information allocation according to the third modification of the first embodiment of the present invention. The paper information region at an address of $1E1 shown in FIG. 20(*a*) corresponds to the paper information region shown in FIG. 20(*b*). The paper information region is formed of 16 bits. If a figure of "1" is entered into a digit of zero bit, which means that the paper contains the middle perforation. If a figure of "0" is entered into the same digit, which means that the paper does not contain the middle perforation.

Therefore, it follows that the first instructing signal is arranged to serve as an informing signal for prohibiting the comparing unit 13 from taking the middle perforation formed at a regular interval in the continuous paper 9 into account when carrying out the comparing operation.

If "1" is entered into the digit of zero bit, the comparing unit 13 neglects the perforation portion for comparison. In other words, when the comparing unit 13 compares the data to be printed stored in the first memory 14*a* with the printed image data stored in the second memory 14*b*, the comparing unit 13 carries out comparing operation on areas other than the region of the middle perforation portion.

Figure 21:
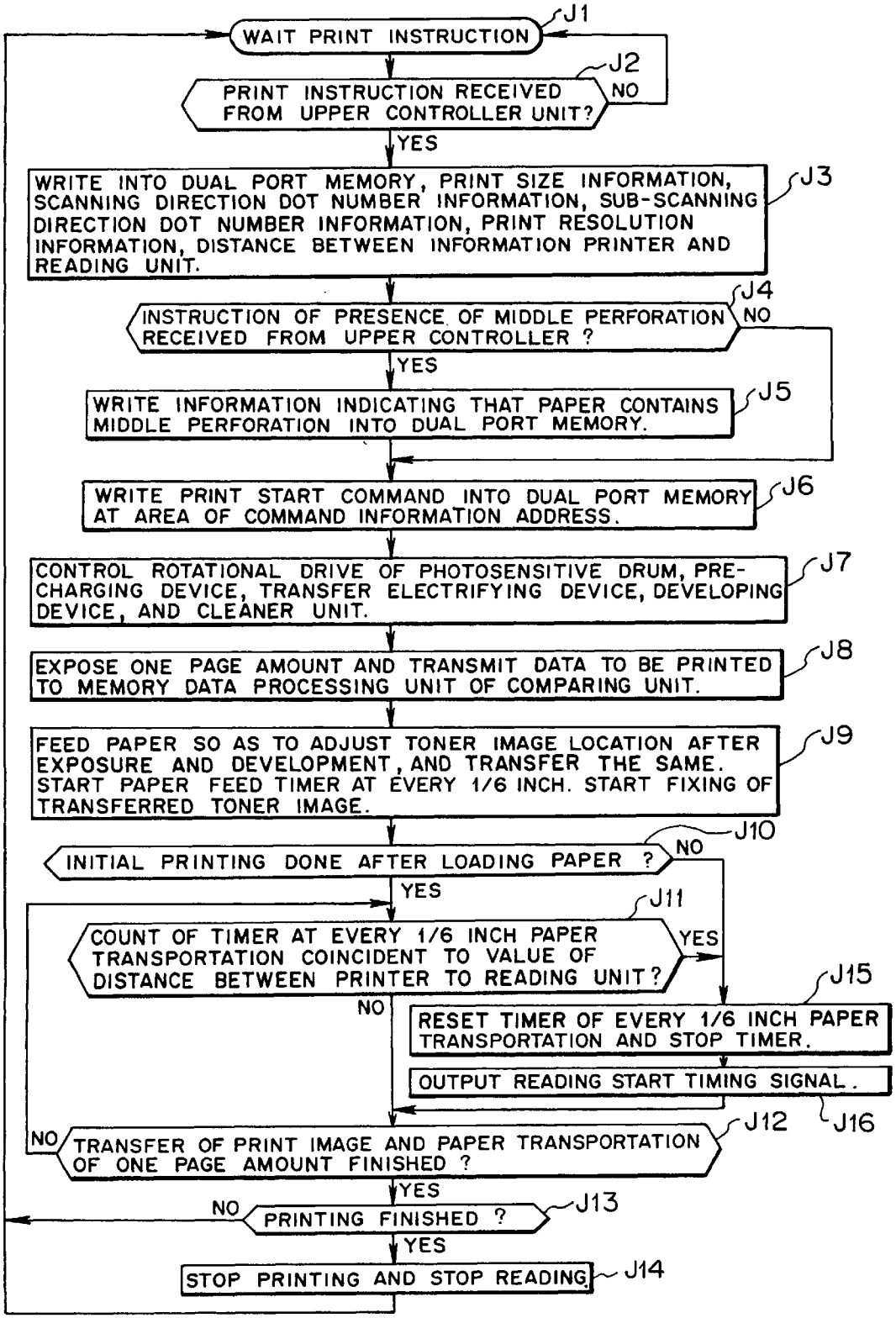
FIG. 21 is a flowchart showing operations of printing, reading and comparing according to the third modification of the first embodiment of the present invention.

With the arrangement described above, printing, reading and comparing operations are carried out. FIG. 21 is a flowchart showing operations of the printing, reading and comparing according to a third modification of the first embodiment of the present invention. At step J1, the mechanism control unit 31 is placed in a waiting mode for awaiting a print instruction. At step J2, the mechanism control unit 31 takes NO route if the mechanism control unit 31 does not receive the print instruction from the upper controller unit 33, and the processing returns to step J1. If the mechanism control unit 31 receives the print instruction from the upper control unit 33, YES route is taken to go to step J3. At step J3, the mechanism control unit 31 writes various information such as print size information, dot number information in the scanning direction, dot number information in the sub-scanning direction, (information of) print resolution, distance information from the printer (printing unit 30) to the reading unit 12, and so on, into the dual port memory 32.

At step J4, if the mechanism control unit 31 receives a signal indicating that the paper contains the middle perforation, from the upper controller unit 33, YES route is taken to go to step J5. At step J5, the mechanism control unit 31 writes information of that the paper contains the middle perforation, into the dual port memory 32. At step J6, the mechanism control unit 31 writes a print start command into the dual port memory 32 at an address of command information. At step J4, if the mechanism control unit 31 does not receive a signal indicating that the paper contains the middle perforation for the upper controller unit 33, NO route is taken to go directly to step J6, and processing of step J6 is carried out.

Further, at step J7, control is effected on the photosensitive drum 30*e* in its rotation, pre-charging device 30*c*, the transfer electrifying device 30*g*, and the cleaner unit 30*b*. At step J8, the mechanism control unit 31 carries out exposing of one page amount and transmits data to be printed to the memory data processing unit 13*a* (see FIG. 3) provided within the comparing unit 13. At step J9, the mechanism control unit 31 conveys the paper so as to adjust the location of the toner image having undergone the exposure and development process, and transfers the toner image onto the paper. Further, at step J9, the mechanism control unit 31 starts the timer of every ⅙ in. paper conveying and starts fixing of the transferred toner image.

At step J10, the mechanism control unit 31 determines whether or not the print operation is the first one after the paper is loaded. If it is determined that the print operation is the first one, YES route is taken to go to step J11. At step J11, the mechanism control unit 31 determines whether or not the counted value of the timer of every ⅙ in. paper conveying reaches the value of distance between the printer to the reading unit 12. If it is determined the value does not reach the distance, NO route is taken to go to step J12. At step J12, the mechanism control unit 31 determines whether one page amount of toner image transfer and paper conveying have been done or not. If it is determined that the paper conveying is done, YES route is taken to go to step J13. At step J13, it is determined whether the printing operation has been completed or not. If it is determined the printing operation has been completed, processing goes to step J14 in which print halting processing and reading halting processing are carried out. Then, processing returns to step J1 and the whole routine is again started from the first step. Similarly, at step J13, if printing is not completed, NO route is taken to return to step J1. At step J12, if one page amount of toner image transfer and paper conveying have not been completed, NO route is taken to go to step J11 in which the corresponding processing is carried out.

At step J10, if it is determined that the print operation is not the first operation after the paper is loaded, NO route is taken to go to step J15. At step J15, the mechanism control unit 31 clears the value counted by the timer of every ⅙ in. paper conveying and halts the timer. Similarly, at step J11, if the value counted by the timer of every ⅙ in. paper conveying reaches the value indicative of the distance between the printer to the reading unit 12, YES route is taken to go to step J15. Then, the process of step J15 is carried out. At step J16, the mechanism control unit 31 generates a reading start timing signal and the processing proceeds to step J12 in which process of step J12 is carried out.

As described above, the upper control unit 33 informs the mechanism control unit 31 of that the printing job shall be carried out with the continuous paper 9 containing the middle perforation. Therefore, it becomes possible to select the continuous paper on the basis of the correspondence between the kind of the print job and the kind of the continuous paper to be printed. Moreover, if the mechanism control unit 31 writes information indicating whether the paper contains the middle perforation or not, into the dual port memory 32, it becomes possible to inform the comparing unit 13 of that the print job is a job with the continuous paper 9 containing the middle perforation or not.

As described above, if the utilized paper is a paper having the middle perforation, the printing section 30 informs the comparing unit 13 of that the paper contains the middle perforation. Therefore, the comparing unit 13 will not detect discrepancy due to the presence of the middle perforation, with the result that an accurate comparison can be carried out. Further, the printer can cope with the continuous paper 9 having the perforation for folding the paper, it becomes possible to increase the kind of paper that the printer can deal with.

(A4)Description of a Fourth Modification of the First Embodiment of the Present Invention The first instructing signal may be arranged to serve as comparing determination reference information utilized when the comparing unit 13 compares the data to be printed supplied thereto with the printed image data. That is, if the printing section 30 deals with a print job requiring a stringent reference, the comparing unit 13 correspondingly shall compare and evaluate the comparing result stringently. On the other hand, if the printing section 30 deals with a print job requiring a loose reference, the comparing unit 13 correspondingly may compare and determine the comparing result loosely. The print job in which comparing result shall be evaluated stringently is such one that the job is to print important documents. According to the fourth modification, the comparing determination reference information can be selectively determined.

Also, the present fourth modification has the same arrangement as that of the continuous medium printing apparatus 1 (see FIG. 1) of the first embodiment. Therefore, the arrangement thereof will not be described.

FIG. 22(*a*) is a diagram showing an example of data allocation in the dual port memory 32 according to the fourth modification of the first embodiment of the present invention. As shown in FIG. 22(*a*), the comparing determination reference information is written in the dual port memory 32 at an address of $1E3, whereby the level of stringency can be changed. Also, the present modification has the same arrangement as that of the first modification. Therefore, the arrangement thereof will not be described.

FIG. 22(*b*) is a diagram useful for explaining a method for determining the comparing result according to the fourth modification of the first embodiment of the present invention. As shown in FIG. 22(*b*), there are shown two printed image data diagrams. In these diagrams, a symbol of ○ represents a dot in which the data to be printed and the printed image data are coincident with each other while a symbol of X represents a dot in which the data to be printed and the printed image data are not coincident with each other. As shown in the left diagram of FIG. 22(*b*), the printed image data contains two dots in which the data to be printed and the printed image data are not coincident with each other, while in the right diagram of FIG. 22(*b*), the printed image data contains three dots in which the data to be printed and the printed image data are not coincident with each other.

If the value of the comparing determination reference information is set to "0003", the printed image data shown in the left diagram is determined as satisfactory while the printed image data shown in the right diagram is determined as unsatisfactory. Thus, as the value of the comparing determination reference information becomes small, the determination becomes stringent. Further, the value of the comparing determination reference information is set to "0001" or more.

With the above-described arrangement, the upper controller unit 33 supplies the comparing determination reference information to the mechanism control unit 31 depending on the contents of the print job. In accordance with the comparing determination reference information, the mechanism control unit 31 writes the comparing determination reference information into the dual port memory 32 and also supplies the information to the comparing unit 13 in a unit of page.

The comparing unit 13 compares the data to be printed stored in the first memory 14*a* with the printed image data stored in the second memory 14*b* in accordance with the comparing determination reference information so that determination whether the printed result is satisfactory or not is carried out. In more concretely, when the comparing unit 13 compares the data to be printed and the printed image data with each other in terms of comparison on each dot, if the comparing unit 13 detects a discrepancy dot, or a dot at which the data are not coincident with each other, the comparing unit 13 evaluates the number of dots at which the discrepancy dot is continuously appears. Then, the comparing unit 13 compares the number of continuously arrayed dots at which the data discrepancy appears with the comparing determination reference information set in advance. If the number of continuously arrayed dots at which the discrepancy appears exceeds the value of the comparing determination reference information, the comparing unit 13 determines that the printed result is unsatisfactory.

As set forth above, if the document to be printed is not important, the comparing determination reference information is not so stringently set. Conversely, if the document to be printed is important, the comparing determination reference information is stringently set. Accordingly, it becomes possible to prevent the printing system from being stopped due to the comparison based on an unreasonably stringent reference for printing not so important documents.

Further, as described above, the comparing determination reference information can be automatically set in the comparing unit 13 depending on the print job. Therefore, determination reference can be changed in accordance with the print job. Moreover, since the comparing determination reference information can be set at a unit of page, print quality can be appropriately set, and the reading processing rate can be prevented from being deteriorated.

(A5) Description of a Fifth Modification of the First Embodiment of the Present Invention While in the fourth modification of the first embodiment the comparing determination reference information is set in a unit of page, the comparing determination reference information may be set for each portion of a page depending on the importance of the portion of the page. For example, if a single page is formed of a bill at the left half of the page and a correspondence at the right half of the page, and hence the page contains a plurality of portions with a different importance, it is desirable to set the comparing determination reference information depending on the portions.

Also the present modification has the same arrangement as that of the continuous medium printing apparatus 1 of the first embodiment (see FIG. 1), the arrangement thereof will not be described.

FIG. 23 is a diagram showing an example of data allocation in the dual port memory 32 according to the fifth modification of the first embodiment of the present invention. As shown in FIG. 23, the comparing determination reference information 1 is stored in the dual port memory 32 at an address of $1E3. Similarly, comparing determination reference information 2, comparing determination reference information 3, comparing determination reference information 4 are stored in the dual port memory 32 at addresses of $1E2, $1E1, $1E0, respectively. When the comparing unit 13 carries out comparison, the page under comparison is divided into two or more portions and comparing determination reference is set for each portion so that the print quality is not excessively high. Thus, determination on print result can be carried out in a manner similar to that of the fourth modification.

Figure 24:
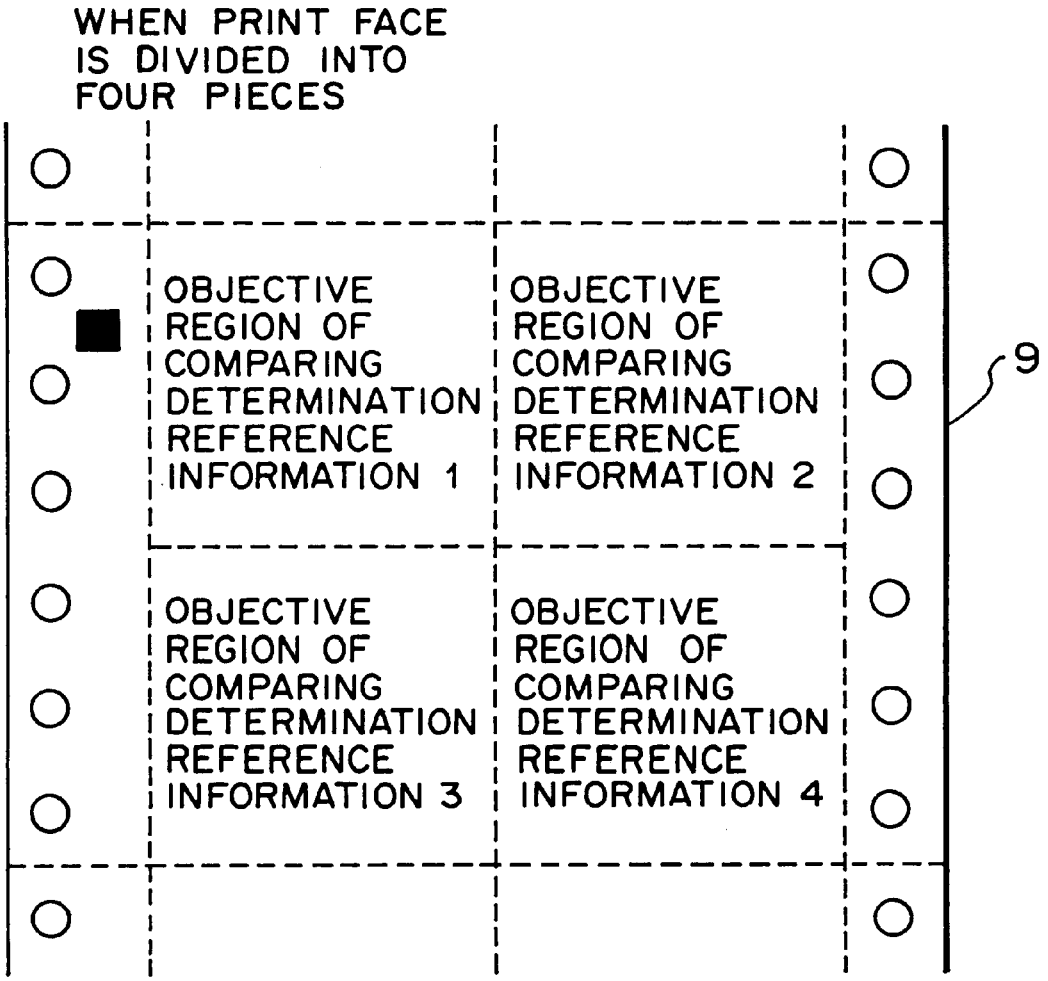
FIG. 24 is a schematic diagram of continuous paper according to the fifth modification of the first embodiment of the present invention.

FIG. 24 is a schematic diagram of the continuous paper 9 according to the fifth modification of the first embodiment of the present invention. As shown in FIG. 24, each page of the continuous paper 9 is divided into four portions, and these portions correspond to an area for the comparing determination reference information 1, an area for the comparing determination reference information 2, an area for the comparing determination reference information 3, an area for the comparing determination reference information 4, respectively. Thus, the comparing determination reference information is set for each area deriving from dividing the page into a plurality of portions by a boundary in the scanning direction (print conveying direction) and the sub-scanning direction (direction perpendicular to the print conveying direction).

With the above arrangement, the plurality of comparing determination reference information are supplied from the upper controller unit 33 through the mechanism control unit 31 to the dual port memory 32 and written into the dual port memory 32 depending on the contents of the print job. Further, the comparing unit 13 compares the data to be printed stored in the first memory 14*a* with the printed image data stored in the second memory 14*b* based on the plurality of comparing determination reference information, and it is determined whether the print result is satisfactory or not for each area.

As described above, since the comparing determination reference information can be set depending on the print job, it becomes possible to flexibly set the determination reference upon comparison.

In addition to that the plurality of comparing determination reference information can be set in the unit of page or area within the page, a stringent determination reference can be set for a part of the page and loose one can be set for the rest of the page. Therefore, proper print quality can be maintained for every area of the page, with the result that it becomes possible to prevent the reading processing rate from being lowered.

(A6) Description of a Sixth Modification of the First Embodiment of the Present Invention The first instructing signal may be arranged to serve as a halting condition notifying signal for notifying the halting condition of the comparing unit 13 when the comparison reveals that the print result is unsatisfactory. Also, the present modification has the same arrangement as that of the continuous medium printing apparatus 1 (see FIG. 1) of the first embodiment. Therefore, the arrangement thereof will not be described.

FIG. 25(*a*) is a diagram showing an example of data allocation in the dual port memory 32 according to the sixth modification of the first embodiment of the present invention. As shown in FIG. 25(*a*), processing information upon detecting unsatisfactory printing 1 and processing information upon detecting unsatisfactory printing 2 are written in the dual port memory 32 at addresses of $1DF and $1DE, respectively. These information serve as the halting condition notifying signal.

FIG. 25(*b*) is a diagram showing an example of utilization of processing information 1 upon detecting unsatisfactory printing according to the sixth modification of the first embodiment of the present invention. As shown in FIG. 25(*b*), if "1" is entered at zero bit of the address of $1DF, which means that unsatisfactory printing detecting function is disabled. On the other hand, if "0" is entered at the same place, which means that unsatisfactory printing detecting function is requested. Similarly, if "1" is entered at thirteenth bit of the same address, which means that it is requested to attach any mark indicating that unsatisfactory printing is detected. On the other hand, if "0" is entered at thirteenth bit of the same address, which means that it is not requested to attach any mark indicating that unsatisfactory printing is detected. If "1" is entered at fourteenth bit of the same address, which means that it is requested to carry out halting processing when the number of unsatisfactorily printed pages reaches a predetermined number. On the other hand, if "0" is entered at fourteenth bit of the same address, which means that it is not requested to carry out halting processing even when the number of unsatisfactorily printed pages reaches the predetermined number. Further, if "1" is entered at the fifteenth bit of the same address, which means that it is requested to carry out halting processing immediately after an unsatisfactorily printed page is detected. On the other hand, if "0" is entered at fifteenth bit of the same address, which means that it is not requested to carry out halting processing immediately after an unsatisfactorily printed page is detected.

FIG. 25(*c*) is a diagram showing an example of utilization of processing information 2 upon detecting unsatisfactory printing according to the sixth modification of the first embodiment of the present invention. As shown in FIG. 25(*c*), there is provided a region of address of $1DE in which there is set a number of pages of unsatisfactory printing which has been set at the fourteenth bit shown in FIG. 25(*c*). The value of processing information 2 is a set number which represents a continuously counted number of pages of unsatisfactory printing when unsatisfactory printing is detected. For example, if it is requested that continuous three sheets of unsatisfactorily printed pages are threshold value for determining unsatisfactory printing operation, a number of "0002" is set to the processing information 2 for detecting the unsatisfactory printing.

With the above arrangement, similarly to the fourth modification and the fifth modification of the first embodiment, the upper controller unit 33 supplies instruction indicating how to deal with unsatisfactory printing upon detecting the unsatisfactory printing to the mechanism control unit 31 in accordance with the print job. The instruction is written into the dual port memory 32 by the mechanism control unit 31 and supplied to the comparing unit 13.

In this way, if the comparing unit 13 detects unsatisfactory printing, there are provided some choices of operations such as that the printing operation is halted immediately after detecting the unsatisfactory printing, the printing operation is halted only when a predetermined number of unsatisfactorily printed pages are continuously counted, any mark is attached to the unsatisfactorily printed page, and so on. In this way, the level of stringency for detecting the unsatisfactory printing can be flexibly selected.

Further, as described above, it becomes possible to eliminate setting operation done by an operator and to prevent the printing efficiency from being lowered due to an erroneous setting.

(A7) Description of a Seventh Modification of the First Embodiment of the Present Invention The first instructing signal may be arranged to serve as a data deletion notifying signal informing the comparing unit 13 of data deletion of the data to be printed when the printing section 30 halts printing. That is, when the printing section 30 halts the printing operation, deleting operation of read data is carried out as follows. Also, the present modification has the same arrangement as that of the continuous medium printing apparatus 1 of the first embodiment (see FIG. 1). Therefore, the arrangement thereof will not be described.

Figure 26:
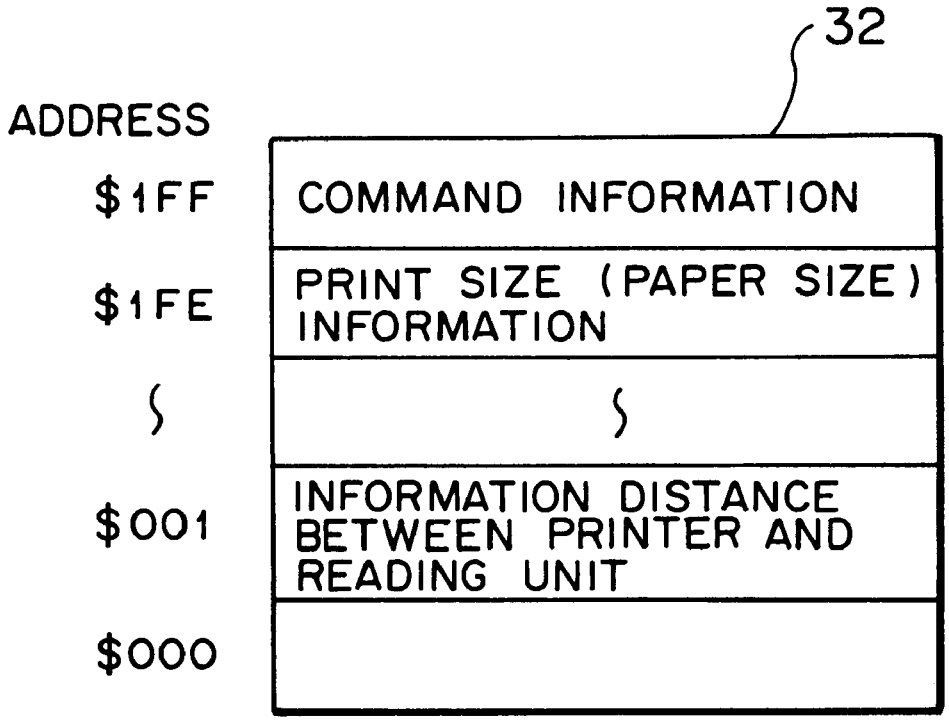
FIG. 26 is a diagram showing an example of data allocation in the dual port memory according to a seventh modification of the first embodiment of the present invention.

FIG. 26 is a diagram showing an example of data allocation in the dual port memory 32 according to the seventh modification of the first embodiment of the present invention. As shown in FIG. 26, a numeral of "C0" based on the hexadecimal notation is entered in a command region of the dual port memory 32 at an address of $1FF. Thus, an instruction for clearing print data is sent to the comparing unit 13.

According to the above arrangement, if the mechanism control unit 31 of the printing section 30 starts the printing operation, the mechanism control unit 31 sends data to be printed to the comparing unit 13. However, if a jam (paper jam) or the like is detected at the printing section 30 before starting the convey of the continuous paper 9, the continuous paper 9 is not conveyed but printing operation is halted.

Thereafter, if the next printing operation is started, the mechanism control unit 31 again sends the data to be printed to the comparing unit 13. However, the comparing unit 13 leaves the data to be printed regarding the page at which printing interruption has happened. In this way, the mechanism control unit 31 writes instruction that data to be printed utilized upon interruption of the printing operation shall be cleared, into the dual port memory 32 so that the comparing unit 13 does not use the data.

With the above arrangement, in addition to the ordinary printing and comparing operations, the mechanism control unit 31 writes instruction that data to be printed utilized upon interruption of the printing operation shall be cleared, into the dual port memory 32 when the printing operation is stopped. Then, the comparing unit 13 receives the instruction by means of the interruption signal, and deletes the data corresponding to the page in accordance with the instruction.

As described above, when the printing section 30 detects any abnormal operation such as a paper jam or the like, the printing section 30 sends to the comparing unit 13 an instruction that the data to be printed sent to the comparing unit 13 shall be canceled. Therefore, if the printing operation is stopped and hence the corresponding data to be printed have not undergone the printing operation in the printing section 30, and thereafter the printing operation is resumed, it can be expected that a proper comparing operation is continued. Further, as described above, it becomes possible to eliminate setting operation done by an operator and to prevent the printing efficiency from being lowered due to an erroneous setting.

(A8) Description of an Eighth Modification of the First Embodiment of the Present Invention The first instructing signal may be arranged to serve as a timing signal for starting printing operation of the printing section 30 after it is confirmed that the amount of light irradiated onto the continuous paper 9 reaches a predetermined amount in the reading unit 12. Also with the arrangement, it becomes possible to control the amount of light irradiated onto the printed image on the continuous paper 9 in the reading unit 12.

Also the present modification has the same arrangement as that of the continuous paper printing apparatus of the first embodiment (see FIG. 1). Therefore, the arrangement thereof will not be described further. The timing signal can be effected by writing predetermined information into the dual port memory 32 shown in FIG. 26 at the command region.

If a CCD camera is employed in the reading unit 12, in order to read the printed image with stability, it is necessary to irradiate light therefor stable in the light amount onto the printed image on the continuous paper 9. If a lamp for illumination is employed as the light irradiating means, it sometimes takes a time for the amount of light to reach a predetermined value after starting the emission of light. In this case, if the lamp for illumination starts light emission when the printing section 30 starts generation of a conveying signal of the continuous paper 9, the light emission will not in time for the start of comparing operation by the comparing unit 13. For this reason, the lamp for illumination starts light emission prior to the start of comparing operation by the comparing unit 13 by a predetermined time interval.

Also in this case, the command information region of the address of $1FF within the dual port memory 32 shown in FIG. 26 is utilized. If a numeral of "01" based on the hexadecimal notation is entered into the region, a print start instruction is sent to the comparing unit 13.

With the above arrangement, the mechanism control unit 31 writes the print start instruction into the dual port memory 32. Then, the instruction is sent to the comparing unit 13. In accordance with the instruction, the comparing unit 13 starts light emission. If the lamp for illumination becomes stable in the light amount and a predetermined time elapses after the light emission is started, the printing operation in the printing section 30 is started.

As described above, prior to the sending of the paper conveying signal, the printing section 30 supplies a signal instructing the preparation of the reading unit 12 or command information to the reading unit 12. The reading unit 12 starts the light emission of the lamp for illumination after receiving the instruction. Therefore, it becomes possible to prevent error in comparing operation. In this way, the printing section 30 can be prevented from being lowered in the processing speed and the reading unit 12 can carry out reading operation with stability.

(A9) Description of Ninth Modification of the First Embodiment of the Present Invention In the above-described various modifications of the first embodiment, the manner in which error is detected may be carried out by using parity check. Thus, the arrangement shall be make to cope with such a manner of error detection. Also the present modification has the same arrangement as that of the continuous medium printing apparatus 1 of the first embodiment (see FIG. 1). Therefore, the arrangement thereof will not be described further.

Figure 27A:
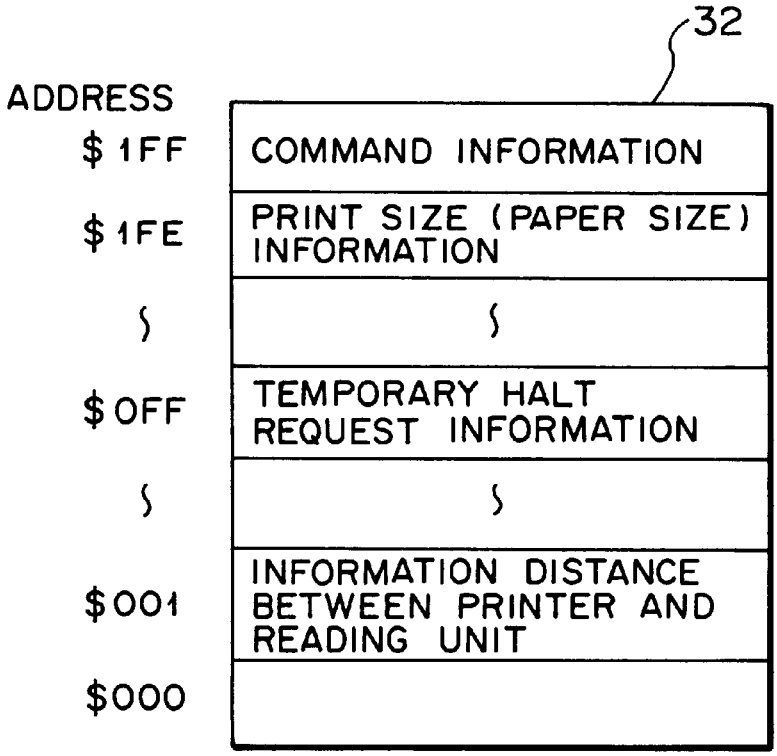
FIG. 27(*a*) is a diagram showing an example of data allocation in the dual port memory according to a ninth modification of the first embodiment of the present invention.
Figure 27B:
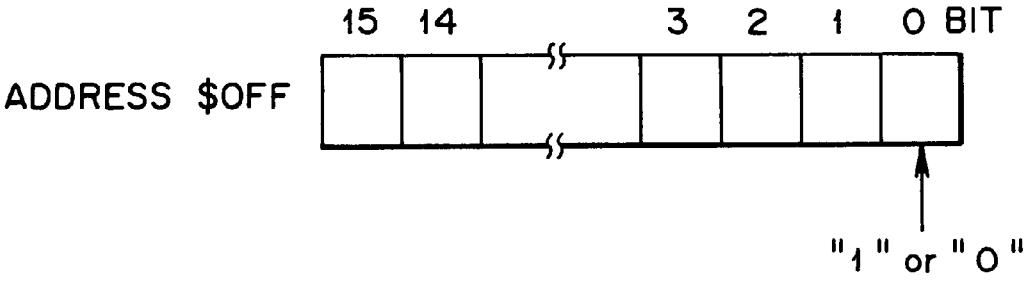

FIG. 27(*a*) is a diagram showing an example of data allocation in the dual port memory 32 according to the ninth modification of the first embodiment of the present invention. As shown in FIG. 27(*a*), temporary halt request information is written in a region at an address of $0FF of the dual port memory 32.

FIG.27(*b*) is a diagram showing an example of utilization of temporary halt request information according to the ninth modification of the first embodiment of the present invention. If a numeral of "1" is entered in the zero bit of the address of $0FF shown in FIG. 27(*b*), which means that a temporary halt request is effected. If "0" is entered in the same bit, which means that the temporary halt request is not effected. In this way, it becomes possible to prevent the slack amount of the continuous paper 9 from excessively increased between the printing section 30 and the reading unit 12, and hence probability of jam occurrence can be decreased.

That is, in the reading unit 12 and the comparing unit 13 provided within the determining section 11, when the first memory 14*a* and the second memory 14*b* are accessed, the access processing is carried out while parity check is effected. In this case, if abnormal operation is detected owing to the parity check and the access processing is retried, it becomes impossible for the comparing unit 13 to follow the printing operation of the printing section 30, with the result that the slack of the continuous paper 9 is increased between the printing section 30 and the reading unit 12. Which fact also causes folding of the continuous paper 9.

In order to avoid the above problem, the comparing unit 13 extracts information indicative of the length of the continuous paper 9 that is expected to be printed, from the first instructing signal. Further, the reading unit 12 counts the conveyed length of the continuous paper 9 based on the pulse signal sent at every ⅙ in. conveying of the continuous paper 9. Then, the comparing unit 13 calculates the difference between the length of the continuous paper 9 that is expected to be printed and the length of the same that has been conveyed, and generates the difference value. Furthermore, if the difference exceeds a predetermined value, the comparing unit 13 informs the mechanism control unit 31 of the printing section 30 of that the difference exceeds the predetermined value, so that the printing section 30 is temporary stopped in the printing operation.

Further, if the reading unit 12 has caught up in the reading operation with the conveying speed of the printing section 30, the comparing unit 13 informs the mechanism control unit 31 of the fact. If the mechanism control unit 31 is informed of that the reading unit 12 can catch up in the reading operation with the conveying speed of the printing section 30, the mechanism control unit 31 resumes the printing operation.

Accordingly, it follows that the comparing unit 13 is comprised of detecting means (not shown) which is capable of generating a difference value between the expected print length of the continuous paper 9 extracted from the first instructing signal and the length of the continuous paper 9 counted by the reading unit 12, and halting signal inputting means (not shown) for supplying a halting signal for halting the printing operation of the printing section 30 when the difference value generated from the detecting means exceeds a predetermined value.

The information from the comparing unit 13 to the mechanism control unit 31 is carried out such that the comparing unit 13 once writes the temporary halt request signal into the dual port memory 32 in a high mode, and then the mechanism control unit 31 reads the signal at the high state.

With the above arrangement, in addition to that the ordinary printing and comparing operations are carried out, the comparing unit 13 once writes the temporary halt request signal into the dual port memory 32 in a high mode, and the mechanism control unit 31 is informed of the indication of the signal.

In this way, if the reading unit 12 becomes incapable of following in its reading processing the printing operation of the printing section 30 or the comparing unit 13 becomes incapable of following in its comparing processing the printing operation of the printing section 30, the temporary halt request signal is sent to the printing section 30 so that the printing section 30 once stops the printing operation. Thereafter, if the reading unit 12 or the comparing unit 13 become capable of catching up the printing rate of the printing section 30, the temporary halt request signal is disabled. Moreover, if the printing section 30 detects that the temporary halt request signal is disabled, the printing section 30 resumes the printing operation. In this way, printing operation is automatically resumed.

As described above, the comparing unit 13 supervises the difference value between the expected conveying distance of the continuous paper 9 and actual conveying distance of the same detected by the reading unit 12. Therefore, it becomes possible to stop the printing operation before the continuous paper 9 slacks excessively in a paper reservoir.

In this way, it becomes possible to decrease the possibility of jam occurrence and prevent comparison error, with the result that the printing section 30 can be prevented from being lowered in its processing speed.

(A10) Description of Tenth Modification of the First Embodiment of the Present Invention The first instructing signal may be arranged to serve as a signal transmitting information concerning resolution.

Figure 28:
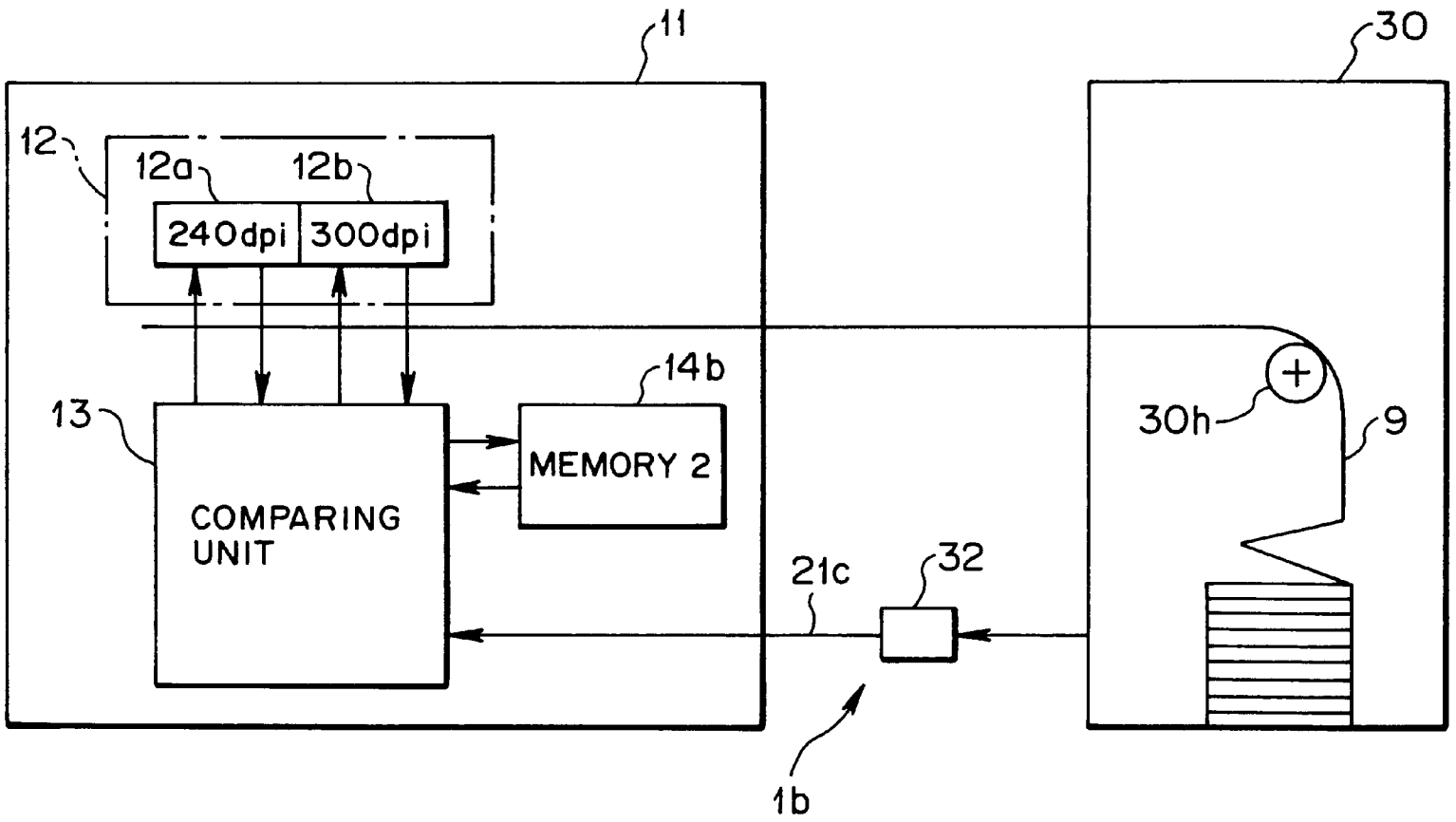
FIG. 28 is a diagram showing an arrangement of a continuous medium printing apparatus according to a tenth modification of the first embodiment of the present invention.

FIG. 28 is a diagram showing an arrangement of a continuous medium printing apparatus 1*b* according to the tenth modification of the first embodiment of the present invention. The continuous medium printing apparatus 1*b* shown in FIG. 28 functions as a print data comparing system in which data sent from the upper controller unit 33 is sequentially printed on the continuous medium such as continuous recording paper. As shown in FIG. 28, the overall arrangement of the continuous medium printing apparatus 1*b* is composed of the printing section 30, the determining section 11 and the dual port memory 32. In FIG. 28, parts attached with the same reference numeral as those of the above-described arrangement have the similar arrangement. Therefore, they will not be described further.

The reading unit 12 provided within the determining section 11 shown in FIG. 28 is arranged to include a first resolution processing unit 12*a* and a second resolution processing unit 12*b* so that the reading unit 12 can cope with a plurality of resolutions. The first resolution processing unit 12*a* is arranged as a CCD camera for photographing an image at a low resolution. Thus, the camera is arranged for photographing an image at a resolution of 240 dpi, for example. The second resolution processing unit 12*b* is a CCD camera for photographing an image at a high resolution. Thus, the camera is arranged for photographing an image at a resolution of 300 dpi, for example.

Figure 29A:
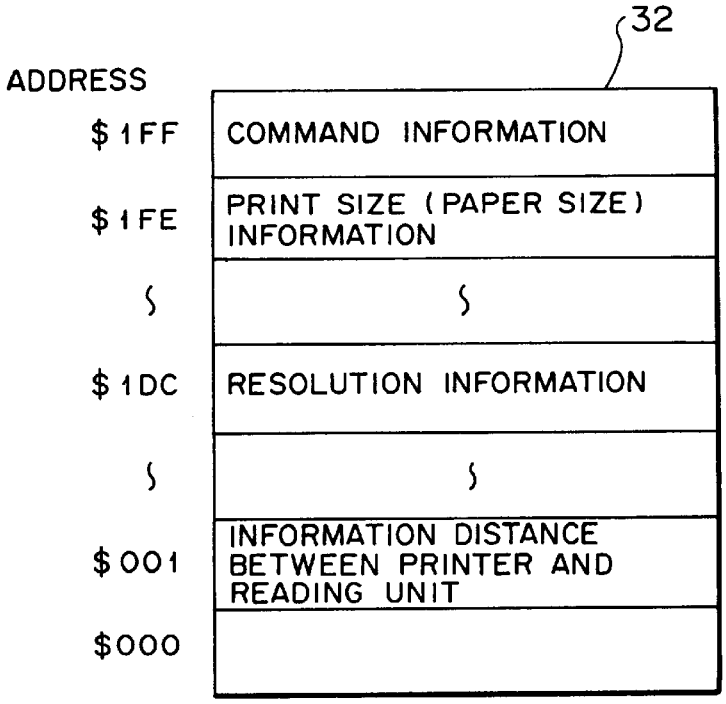
FIG. 29(*a*) is a diagram showing an example of data allocation in the dual port memory according to the tenth modification of the first embodiment of the present invention.
Figure 29B:
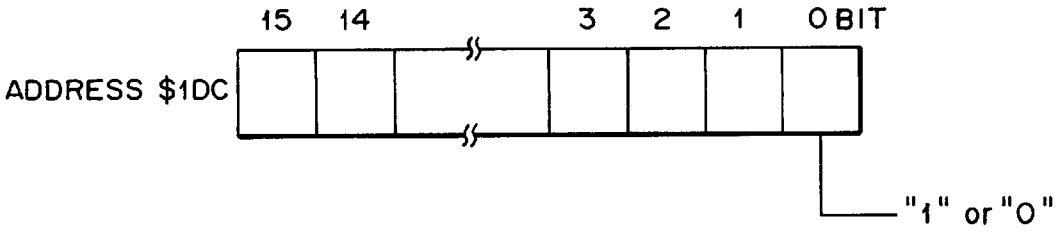

FIG. 29(*a*) is a diagram showing an example of data allocation in the dual port memory according to the tenth modification of the first embodiment of the present invention. As shown in FIG. 29(*a*), resolution information is written into a region of an address of $1DC.

FIG. 29(*b*) is a diagram showing an example of utilization of the resolution information according to the tenth modification of the first embodiment of the present invention. If a numeral of "1" indicative of the resolution information is entered into the zero bit of the region, which means that the resolution of 300 dpi is selected, while if a numeral of "0" is entered into the zero bit of the region, which means that the resolution of 240 dpi is selected. One of the two resolutions is selected in accordance with the first instructing signal sent from the comparing unit 13 by way of the data line 21*c*. Although in the present example there are prepared two kinds of resolutions, more kinds of resolutions may be prepared.

According to the above arrangement, the mechanism control unit 31 (see FIG. 1) of the printing section 30 writes the resolution information into the dual port memory 32, and the resolution information is sent to the comparing unit 13. Further, the comparing unit 13 selects one of the resolutions for the reading unit 12 upon reading the corresponding printed face in accordance with the resolution information. The reading unit 12 selects a sensor depending on the resolution information. The resolution switching is carried out even when continuous printing is carried out, and the reading and comparing on data are carried out at the selected resolution.

As described above, the printer system can cope with any data to be printed that is requested to be printed at various resolutions. Further, the present printer system allows an operator to set a resolution in accordance with the requested resolution of the data to be printed at a unit of page to be printed. In this way, it becomes possible for the reading unit 12 to read the printed image data at a designated, or selected resolution, with the result that the comparing operation can be appropriately carried out.

Figure 30:
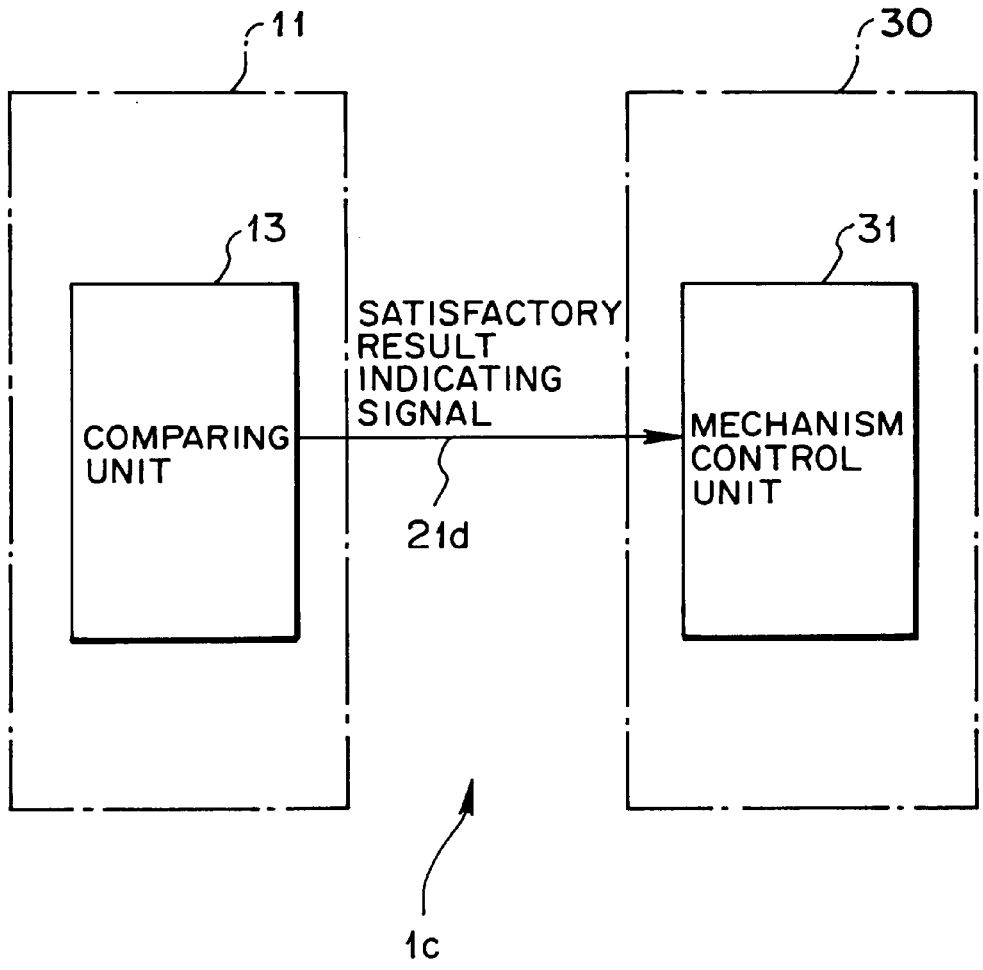
FIG. 30 is a diagram showing an arrangement of a continuous medium printing apparatus according to an eleventh modification of the first embodiment of the present invention.

(A11) Description of Eleventh Modification of the First Embodiment of the Present Invention FIG. 30 is a diagram showing an arrangement of a continuous medium printing apparatus 1*c* according to the eleventh modification of the first embodiment of the present invention. As shown in FIG. 30, the continuous medium printing apparatus 1*c* functions as a print data comparing system in which data sent from the upper controller unit 33 is sequentially printed on the continuous medium such as continuous recording paper. To this end, the continuous medium printing apparatus 1*c* is arranged to include the determining section 11 and the printing section 30, and the comparing unit 13 provided within the determining section 11 sends a satisfactory result indicating signal to the mechanism control unit 31 provided within the printing section 30.

The satisfactory result indicating signal is arranged to serve as a control signal for controlling the printing operation of the printing section 30. The satisfactory result indicating signal functions as the second instructing signal. Further, the satisfactory result indicating signal functions as a quality signal for indicating the comparing result of the comparing unit 13, and it is transmitted by way of the data line 21*d* (see FIG. 1).

Figure 31:
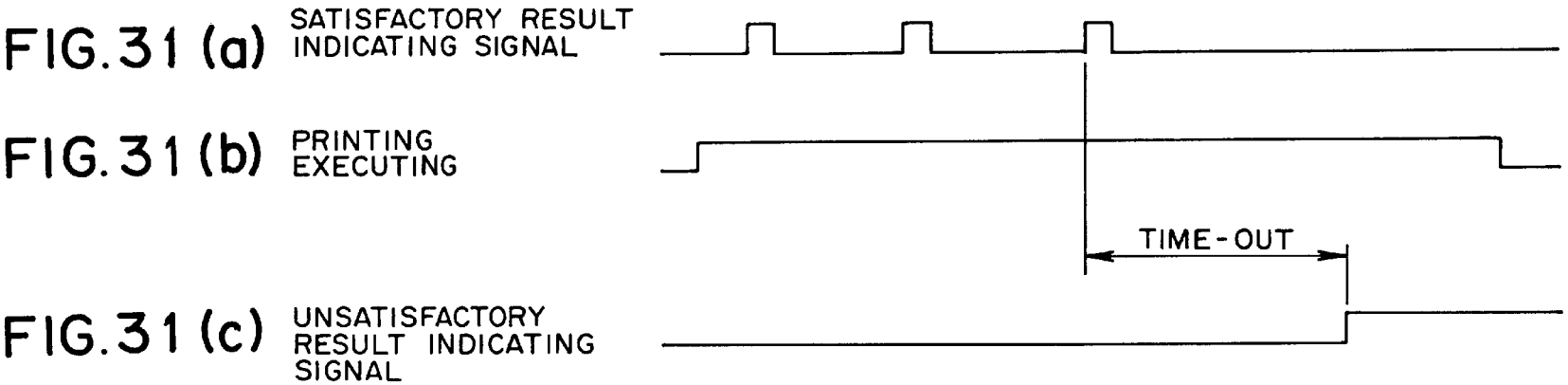
FIG. 31(*a*) is a timing chart of a satisfactory result indicating signal according to the eleventh modification of the first embodiment of the present invention.

FIG. 31(*a*) is a timing chart of the satisfactory result indicating signal according to the eleventh modification of the first embodiment of the present invention. FIG. 31(*b*) is a timing chart of a printing operation executing period indicating signal according to the eleventh modification of the first embodiment of the present invention. FIG. 31(*c*) is a timing chart of an unsatisfactory result indicating signal according to the eleventh modification of the first embodiment of the present invention.

The satisfactory result indicating signal shown in FIG. 31(*a*) is a signal supplied from the comparing unit 13 to the printing section 30 for informing of that the printing result is satisfactory for each page. As shown in FIG. 31(*a*), the status of the signal goes to high level at a regular interval. The printing operation executing period indicating signal shown in FIG. 31(*b*) is an enable signal of the printing section 30. When the status of the signal is in the high state, the printing operation is carried out. Further, if the satisfactory result indicating signal shown in FIG. 31(*a*) once becomes high and thereafter the next satisfactory result indicating signal is failed to be detected in the high state for a predetermined period, it is determined that time out is brought about. Thus, as shown in FIG. 31(*c*), the unsatisfactory result indicating signal is brought to the high state and the printing operation is halted.

Figure 32:
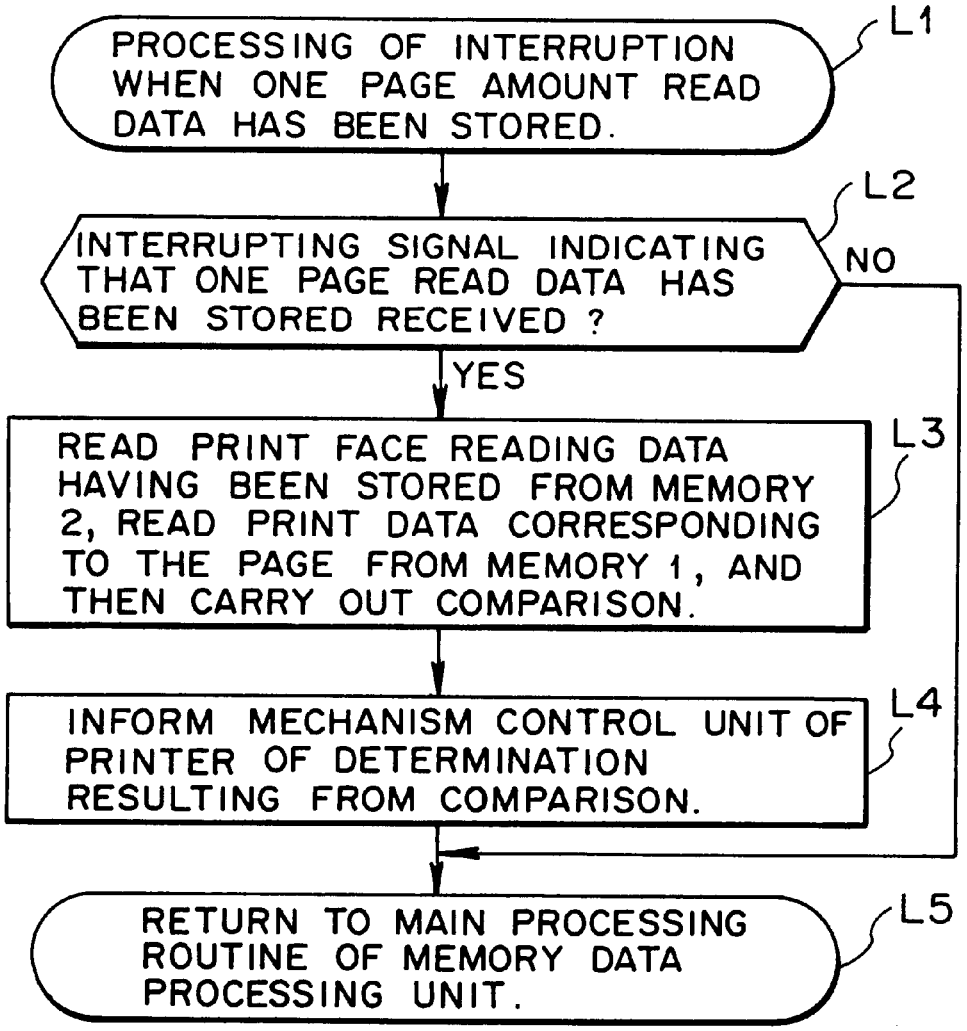
FIG. 32 is a flowchart showing the comparing operation of the comparing unit according to the eleventh modification of the first embodiment of the present invention.

With the above arrangement, control using the satisfactory result indicating signal is carried out. FIG. 32 is a flowchart showing a comparing operation in the comparing unit 13 according to the eleventh modification of the first embodiment of the present invention. The routine shown in FIG. 32 begins with step L1 when one page amount of read data has been stored into the second memory 14*b* and interruption processing is carried out.

At step L2, if the comparing unit 13 receives an interruption signal indicating that one page amount of read data has been done, YES route is taken to go to step L3. At step L3, the comparing unit 13 reads printed image data that has been stored, from the second memory 14*b*, and also reads data to be printed corresponding to the printed image data from the first memory 14*a*. Thus, the comparing unit 13 carries out comparison of these data. At step L4, the comparing unit 13 informs the mechanism control unit 31 of the printer of the determination on the comparing result. At step L5, the routine terminates to return to the main processing of the memory data processing unit.

At step L2, if the comparing unit 13 does not receive the interruption signal indicating that one page amount of read data has been stored, NO route is taken to go to step L5 and the processing returns to the main processing.

In this way, the second instructing signal is utilized as the satisfactory result indicating signal. If the satisfactory result indicating signal is not sent for a predetermined interval at which the satisfactory result indicating signal is generated for every successful printed page, the comparing unit 13 determines that any abnormal operation is carried out in the comparing unit 13. Thus, it becomes possible to retry printing upon detecting unsatisfactory printing and convey the continuous paper 9.

As described above, it becomes possible to carry out recovery printing operation, and the printing operation can be executed without delay. As has been described above, according to the first embodiment of the present invention, it becomes possible to combine various control data so that the operator of the printer system can appropriately set, in addition to the size of the continuous paper, the page partitioning position, the length and width of the continuous paper, the size of the data to be printed, the position of the data to be printed, and the degree of the resolution for each printer.

(B) Description of a Second Embodiment of the Present Invention

Figure 33:
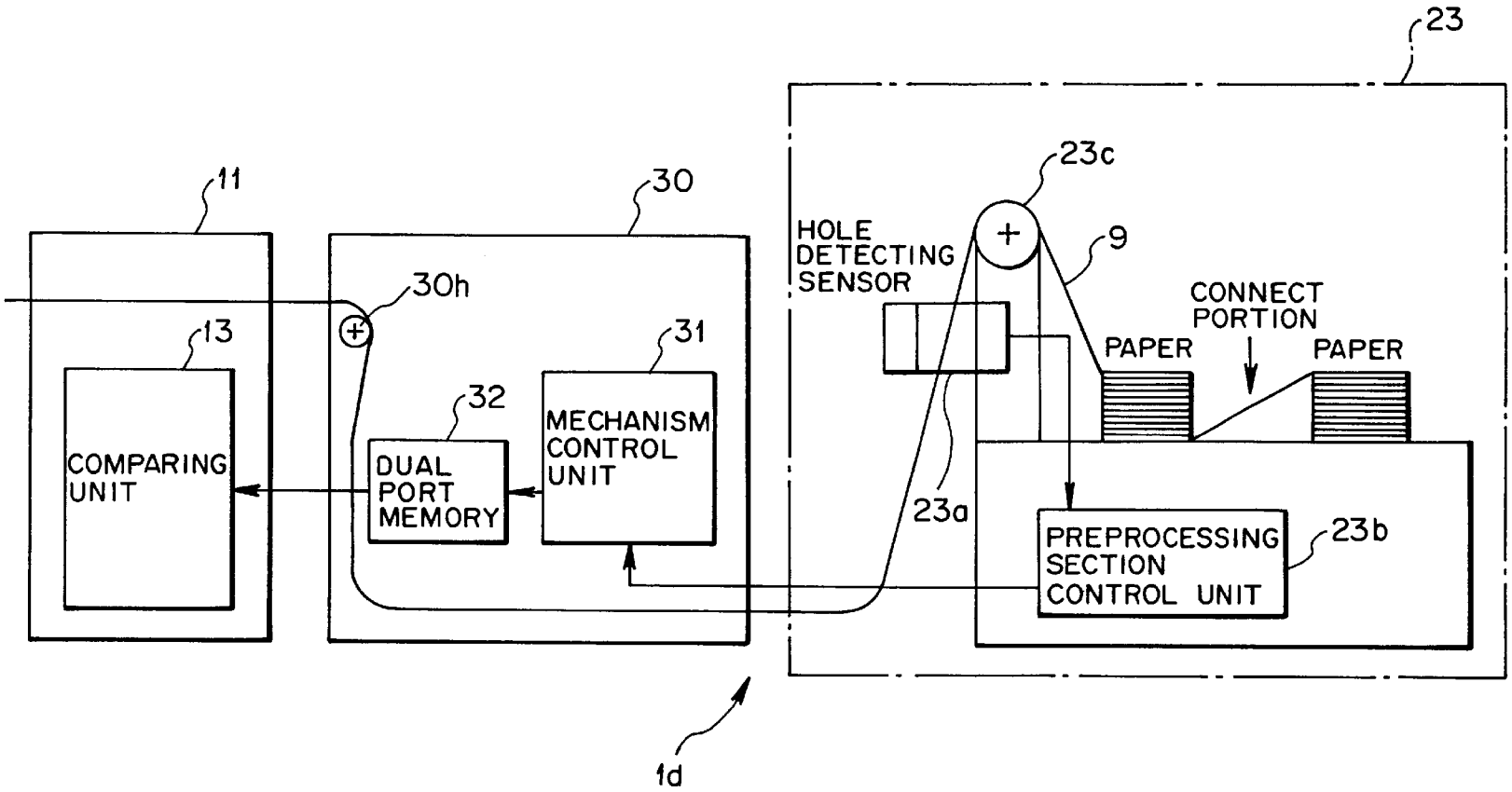
FIG. 33 is a diagram showing an arrangement of a continuous medium printing apparatus according to a second embodiment of the present invention.

FIG. 33 is a diagram showing an arrangement of a continuous medium printing apparatus 1*d* according to a second embodiment of the present invention. The continuous medium printing apparatus 1*d* shown in FIG. 33 functions as a print data comparing system in which data sent from the upper controller unit 33 is sequentially printed at a high rate on a continuous medium such as continuous recording paper. The continuous medium printing apparatus 1*d* is mainly composed of the determining section 11 and the printing section 30, and in order to supply the continuous paper 9 to the printing section 30, a preprocessing section 23 is provided.

In this case, the term "preprocessing" means that even when the continuous paper 9 reserved in a box is going to run out, the tail end of the continuous paper 9 that is just going to run out from the box is connected to the top end of the next continuous paper 9 with a tape so that the next continuous paper 9 can be continuously fed to the printing section 30.

To this end, the preprocessing section 23 is arranged to include a hole detecting sensor 23*a* and a preprocessing section control unit (preprocessing section control means) 23*b*, and a conveying mechanism 23*c*.

The hole detecting sensor 23*a* is utilized for detecting a connecting perforation indicating a position at which the tail end of the preceding continuous paper 9 is connected to the top end of the following continuous paper 9. The hole detecting sensor 23*a* also is arranged to generate a detecting signal when it detects the connecting perforation. Thus, the hole detecting sensor 23*a* functions as detecting means. The preprocessing section control unit 23*b* is arranged to inform the mechanism control unit 31 of the presence of the connecting perforation in accordance with the detecting signal from the hole detecting sensor 23*a*.

The mechanism control unit 31 controls such that the page attached with the connecting perforation is prevented from being printed. Also, the mechanism control unit 31 prevents the comparing unit 13 from carrying out comparison on a non-printed area of pages before and after the connecting perforation. Parts shown in FIG. 33 and attached with the same reference numeral as those of the parts described above are the same parts or parts having the same functions. Therefore, they will not be further described.

Figure 34:
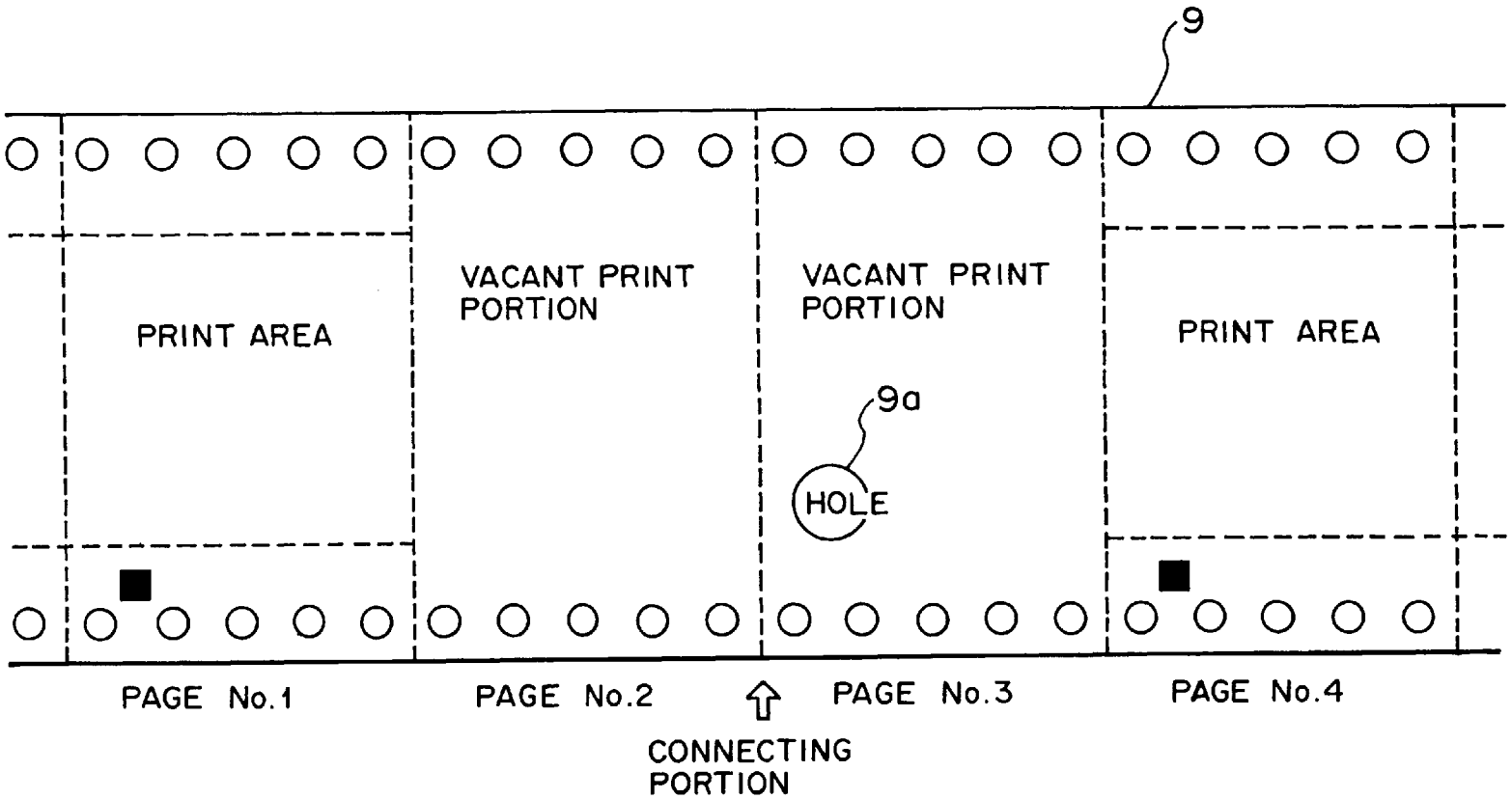
FIG. 34 is a schematic diagram of a perforation of continuous paper according to the second embodiment of the present invention.

FIG. 34 is a schematic diagram of a perforation of the continuous paper 9 according to the second embodiment of the present invention. The continuous paper 9 shown in FIG. 34 is formed of four pages of from NO. 1 page to No. 4 page.

The connecting perforation extends an edge between NO. 2 page and No. 3 page on which the pages are connected to each other with a tape. Since the tape is provided on the connecting perforation between the tail end of the preceding continuous paper 9 and the top end of the following continuous paper 9, both of them being subjected to printing operation, these pages are unsuitable as a printing region. That is, pages before and after the connecting perforation (No. 2 page and No. 3 page) are set to as a vacant printing region and not an object of printing.

No. 3 page is provided with a hole 9*a* and the hole 9*a* is utilized for detecting the connecting portion. The mechanism control unit 31 prohibits the page having the hole 9*a* from being printed and also prohibits the comparing unit 13 from carrying out comparison on the page with the hole 9*a* and the page preceding the page with the hole 9*a*.

Figure 35:
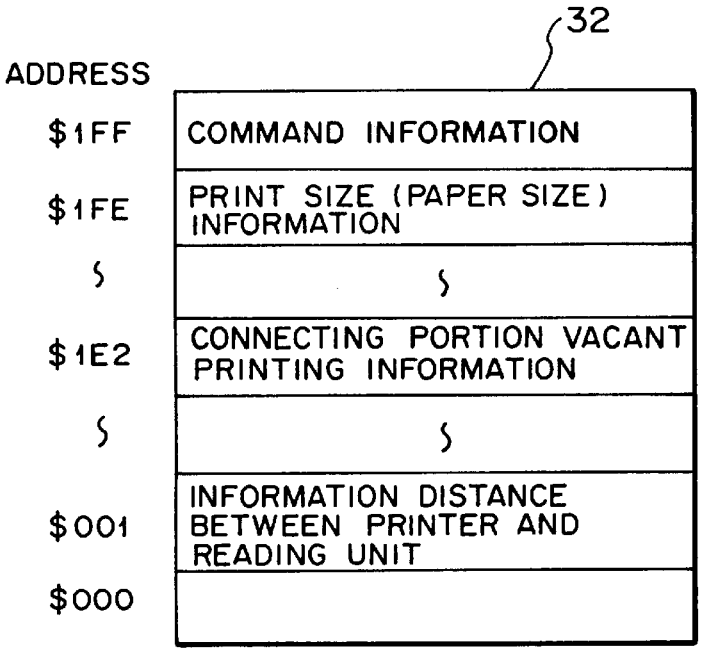
FIG. 35(*a*) is a diagram showing an example of data allocation in the dual port memory according to the second embodiment of the present invention.
Figure 35:
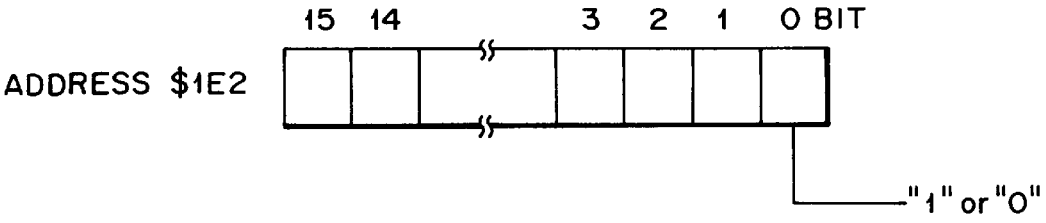

FIG. 35(*a*) is a diagram showing an example of data allocation in the dual port memory 32 according to the second embodiment of the present invention. As shown in FIG. 35(*a*), connecting portion vacant printing information is written into a region of an address of $1E2 of the dual port memory 32. The connecting portion vacant printing information is sent for each page.

FIG. 35(*b*) is a diagram showing an example of utilization of the connecting portion vacant printing information according to the second embodiment of the present invention. The region for the connecting portion vacant printing information is composed of 16 bits. If a numeral of "1" is entered into zero bit, which means the continuous paper includes a connecting portion on which vacant printing is effected. On the other hand, if a numeral of "0" is entered in the same bit, which means that the continuous paper does not include a connecting portion on which vacant printing is effected.

Figure 36:
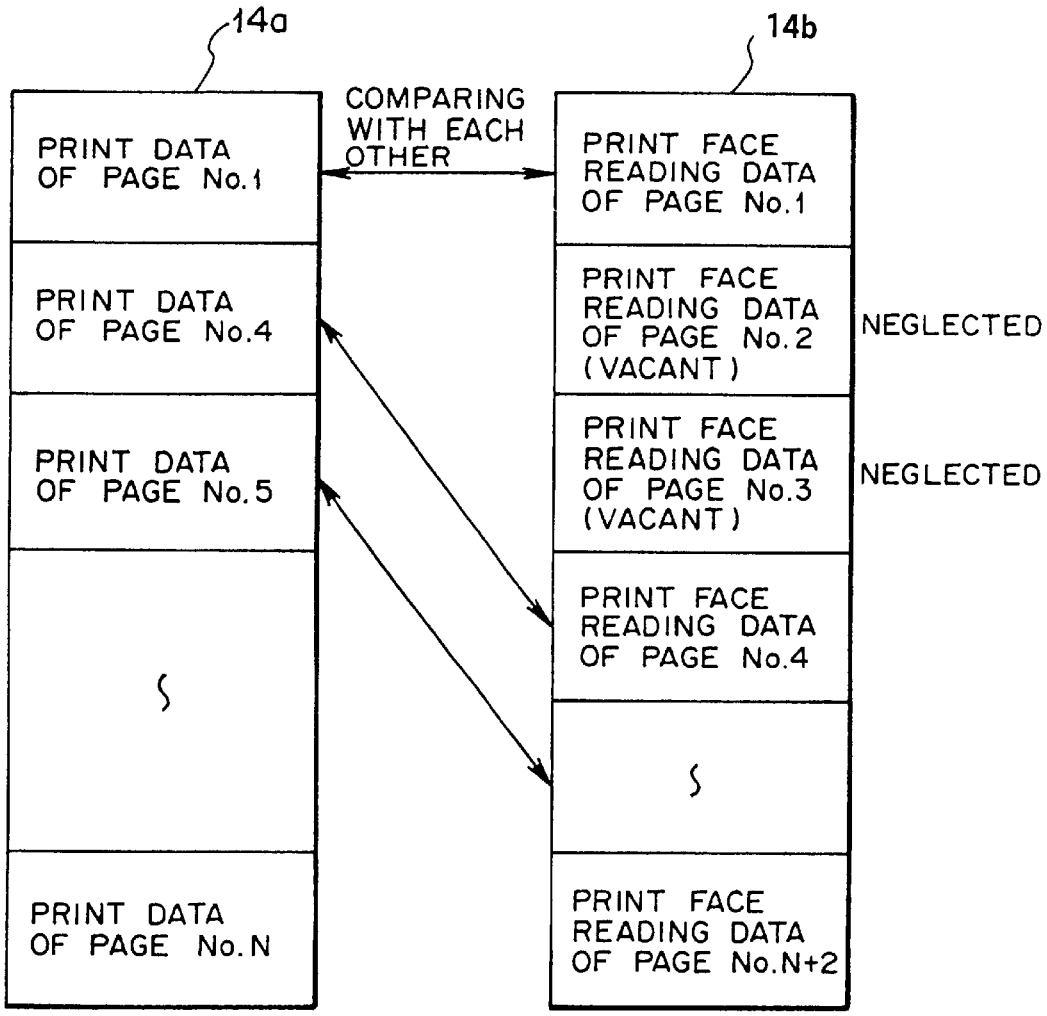
FIG. 36 is a diagram useful for explaining a method of comparison of the comparing unit according to the second embodiment of the present invention.

The concrete method of detecting the connecting portion is as follows. FIG. 36 is a diagram useful for explaining a comparing method of the comparing unit 13 according to the second embodiment of the present invention. As shown in FIG. 36, the first memory 14*a* has data to be printed for each page stored therein. After the print data (in this case, it means data to be printed) for No. 1 page, there are stored print data for No. 4 page, print data for No. 5 page, . . . , print data for No. N page (N represents a natural number) in the first memory 14*a*. In this case, since print data for No. 2 page and No.3 page are not sent from the upper controller unit 33, they are not stored in the first memory 14*a*.

On the other hand, the second memory 14*b* shown in FIG. 36 has printed image data read at every page stored therein. Then, the print face read data (in this case printed image data) for No. 1 page is compared with the print data for No. 1 page. The print face read data for No. 2 page and the print face read data for No. 3 page are regarded as a vacant region, and thus they are not subjected to comparison, or neglected. Comparing operation is again effected on the print face read data for No.4 page and data for the following pages. That is, the print face read data for No. 4 page is compared with the print data for No. 4 page. Thereafter, the similar operation is carried out.

In this way, the continuous paper 9 provided with the hole 9*a* at the connecting portion is loaded in the preprocessing section 23 (see FIG. 33). When the printing operation is started and the conveying mechanism 23*c* is rotated, the continuous paper 9 is conveyed. When the tail end of the preceding continuous paper 9 is going to reach the print end position, the hole detecting sensor 23*a* detects the hole 9*a* and generates a detecting signal. Then, the preprocessing section control unit 23*b* sends the connecting perforation information to the mechanism control unit 31 provided within the printing section 30 in accordance with the detecting signal from the hole detecting sensor 23*a*.

The printing section 30 does not effect light exposure on the pages before and after the connecting portion so that vacant printing is effected thereon, and carries out only convey of the continuous paper 9. The mechanism control unit 31 writes information indicating that the vacant printing is carried out on the pages near the connecting portion, into the dual port memory 32 so that the comparing unit 13 is informed of that the vacant printing is carried out on the pages near the connecting portion. At this time, the data to be printed is prevented from being sent from the upper controller unit 33 to the comparing unit 13. Also, the same data is prevented from being sent from the mechanism control unit 31 to the comparing unit 13-side.

In the comparing unit 13, read data of the printed image of the vacant printing portion is neglected. If the vacant print page has passed the comparing unit 13, the comparing unit 13 resumes comparing operation at the next page for comparing the printed image data with the data to be printed.

Figure 37:
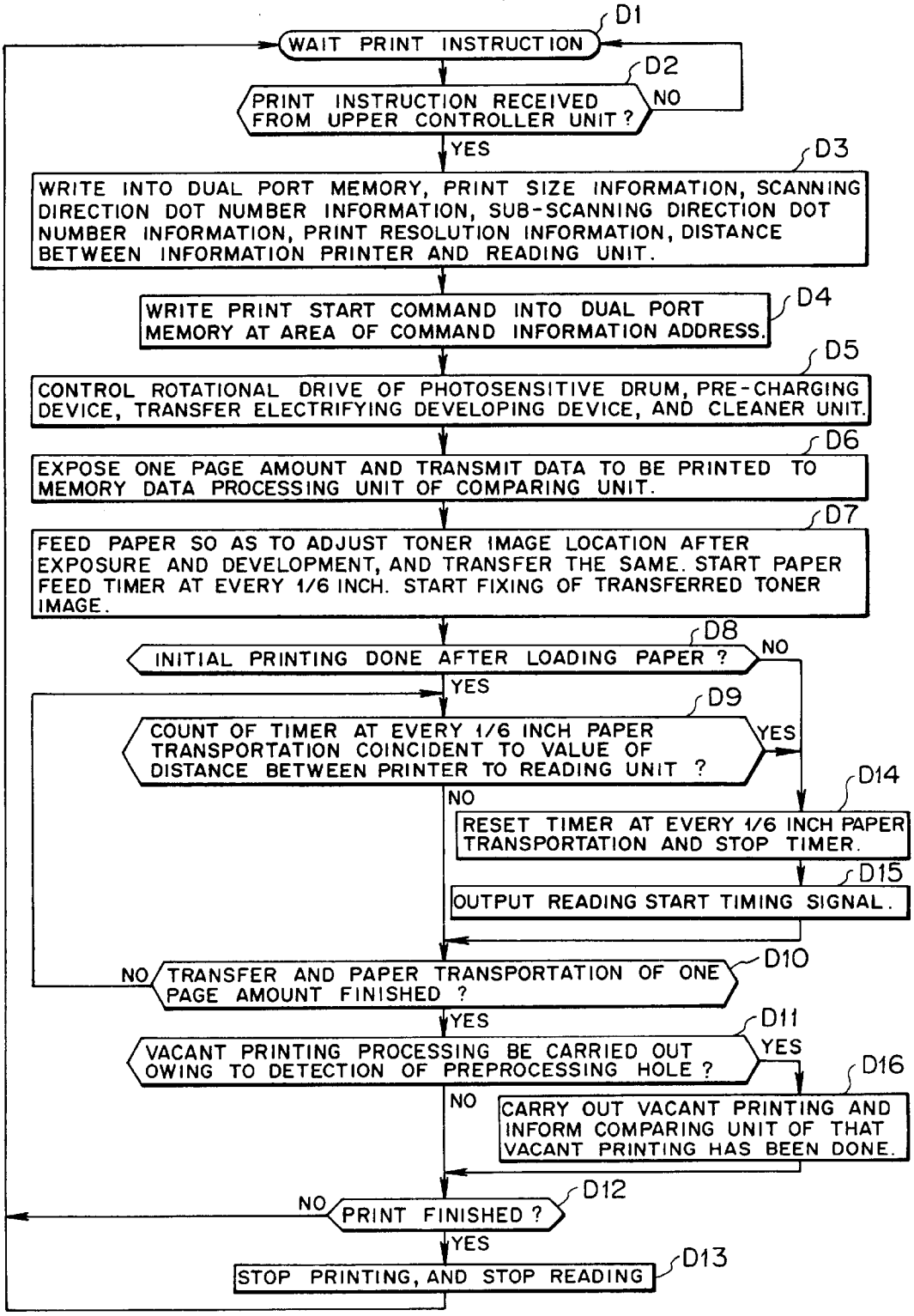
FIG. 37 is a flowchart showing operations of printing, reading and comparing carried out by the mechanism control unit according to the second embodiment of the present invention.

With the above arrangement, printing, reading and comparing operations are carried out. FIG. 37 is a flowchart showing operations of the printing, reading and comparing carried out by the mechanism control unit 31 according to the second embodiment of the present invention. At step D1, the mechanism control unit 31 is placed in the print instruction waiting mode. At step D2, if the mechanism control unit 31 does not receive any print instruction from the upper controller unit 33, NO route is taken to return to step D1. If the mechanism control unit 31 receives a print instruction from the upper controller unit 33, YES route is taken to go to step D3. At step D3, the mechanism control unit 31 writes various information such as print size information, dot number information in the scanning direction, dot number information in the sub-scanning direction, (information of) print resolution, distance information from the printer (printing unit 30) to the reading unit 12, and so on, into the dual port memory 32.

At step D4, the mechanism control unit 31 writes a print start command into the dual port memory 32 at an address of command information. At step D5, control is effected on the photosensitive drum 30*e* in its rotation, pre-charging device 30*c*, the transfer electrifying device 30*g*, and the cleaner unit 30*b*. Further, at step D6, the mechanism control unit 31 carries out exposing of one page amount and transmits data to be printed to the memory data processing unit 13*a* (see FIG. 3) provided within the comparing unit 13.

At step D7, the mechanism control unit 31 conveys the paper so as to adjust the location of the toner image having undergone the exposure and development process, and transfers the toner image onto the paper. Further, at step D7, the mechanism control unit 31 starts the timer of every ⅙ in. paper conveying and starts fixing of the transferred toner image.

At step D8, the mechanism control unit 31 determines whether or not the print operation is the first one after the paper is loaded. If it is determined that the print operation is the first one, YES route is taken to go to step D9. At step D9, the mechanism control unit 31 determines whether or not the counted value of the timer of every ⅙ in. paper conveying reaches the value of distance between the printer to the reading unit 12. If it is determined the value does not reach the distance, NO route is taken to go to step D10. At step D10, the mechanism control unit 31 determines whether one page amount of toner image transfer and paper conveying have been done or not. If it is determined that the paper conveying is done, YES route is taken to go to step D11. At step D11, it is determined whether the hole 9*a* (hole for preprocessing) is detected or not, so as to determine whether the vacant printing processing shall be done or not. If the hole 9*a* is detected, YES route is taken to go to step D16. At step D16, the printing section 30 carries out the vacant printing processing and informs the comparing unit 13 of that the vacant processing has been carried out. At step D12, the comparing unit 13 determines whether the printing operation has been completed or not. If it is determined the printing operation has been completed, processing goes to step D13 in which the comparing unit 13 carries out print halting processing and reading halting processing. Then, processing returns to step D1 and the whole routine is again started from the first step. At step D11, if the hole 9*a* is not detected, NO route is taken to go to step D12.

If NO route is taken at step D8 or YES route is taken at step D9, then processing proceeds to step D14. At step D14, the comparing unit 13 clears the value counted by the timer of every ⅙ in. paper conveying and halts the timer. Similarly, at step D15, the comparing unit 13 generates a reading start timing signal and the processing proceeds to step D10 in which process of step D10 is carried out.

Figure 38:
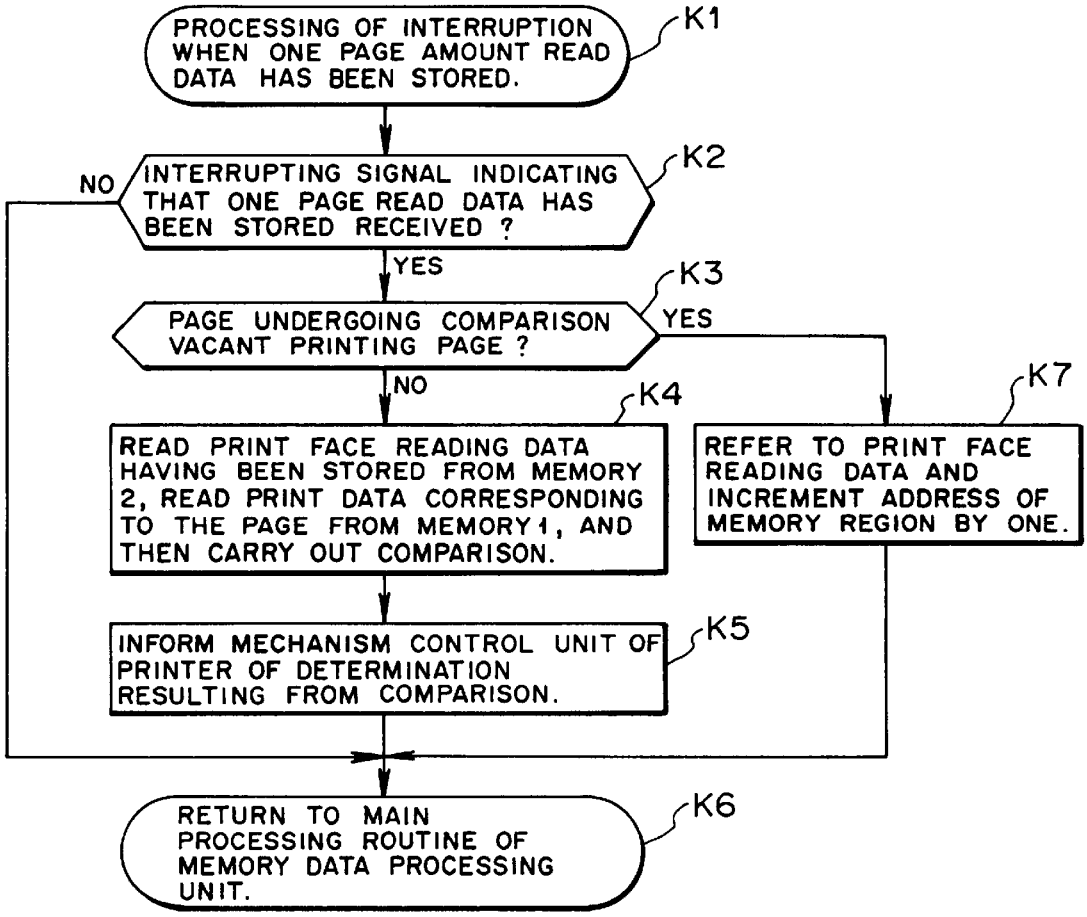
FIG. 38 is a flowchart showing an operation of a vacant print processing carried out by the comparing unit according to the second embodiment of the present invention.

The comparing unit 13 carries out the vacant printing processing as follows. FIG. 38 is a flowchart showing an operation of the vacant printing processing carried out by the comparing unit 13 according to the second embodiment of the present invention. The routine shown in FIG. 38 begins with step K1 upon interruption generated when the comparing unit 13 completes the storage of one page amount of read data (in this case data means the printed image data).

At step K2, if the comparing unit 13 receives an interruption signal, YES route is taken to go to step K3. At step K3, the comparing unit 13 determines whether the page under comparison is a page for vacant printing or not. If it is determined that the page shall undergo the vacant printing, YES route is taken to go to step K7. At step K7, the comparing unit 13 refers to the print face read data (printed image data) and increments an address of the memory region (region of second memory 14*b*) by one page amount. Then, the processing goes to step K6 to conclude the routine and returns to the routine of the main data processing unit 13*a*.

On the other hand, at step K2, if the comparing unit 13 does not receive an interruption signal, NO route is taken to go to step K6 and the processing returns to the main processing. At step K3, if the comparing unit 13 determines that the printed page under comparison is not a page for vacant printing, NO route is take to go to step K4. At step K4, the comparing unit 13 reads the printed face read data (printed image data) which has been stored, from the second memory 14*b*. At the same time, the comparing unit 13 reads data to be printed corresponding to the page from the first memory 14*a*, and compares both the data with each other. Further, at step K5, the comparing unit 13 informs the mechanism control unit 31 of the printer of the information indicative of the determination of the comparing result. Then, the processing proceeds to step K6 to return to the main processing.

As described above, according to the above embodiment, the comparing unit 13 can recognize the page for the vacant printing if present. Moreover, if the continuous paper 9 contains continuous vacant pages, the comparing unit 13 does not immediately determine printing is unsatisfactory. Therefore, accurate comparison can be expected.

Furthermore, according to the above second embodiment, the continuous paper 9 having the connecting portion can be appropriately processed, printing operation can be processed continuously.

(C) Description of a Third Embodiment of the Present Invention

The above described printer system may be connected to a post-processing section at the downstream of the reading unit 12 for cutting the continuous paper 9. Further, an offset instructing signal may be utilized for controlling the printer system so that after the continuous paper 9 is cut by the post-processing section, the cut continuous paper piece undergoes offset operation.

Figure 39:
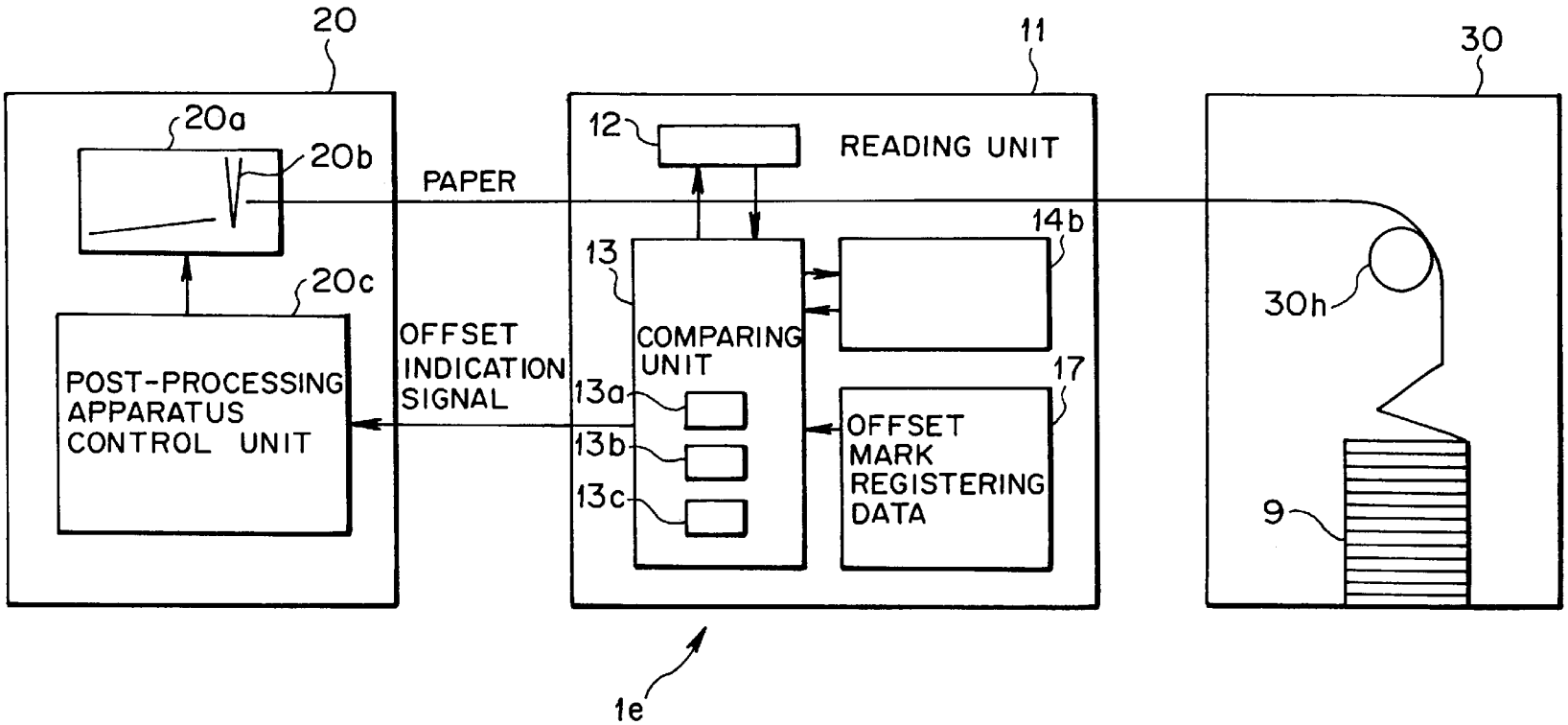
FIG. 39 is a diagram showing an arrangement of a continuous medium printing apparatus according to a third embodiment of the present invention.

FIG. 39 is a diagram showing an arrangement of a continuous medium printing apparatus 1*e* according to a third embodiment of the present invention. The continuous medium printing apparatus 1*e* shown in FIG. 39 functions as a print data comparing system in which data sent from the upper controller unit 33 is sequentially printed at a high rate on the continuous medium such as continuous recording paper. The continuous medium printing apparatus 1*e* is arranged to include the printing section 30 and the determining section 11, and further, provided with a post-processing section 20 in the downstream of the determining section 11 in the paper conveying direction.

The post-processing section 20 is arranged for cutting the continuous paper 9. To this end, the post-processing section 20 includes a cutting unit 20*a* having a cutter 20*b* and a post-processing section control unit 20*c*. The cutting unit 20*a* is utilized for cutting the continuous paper 9 at a regular interval by using the cutter 20*b*. Information concerning the interval is supplied thereto from the outside. Further, the post-processing section control unit 20*c* is arranged to receive an offset instructing signal from the comparing unit 13 provided within the determining section 11, and supply an offset control signal for controlling the offset of the continuous paper 9 having been cut into sheets of paper, to the above cutting unit 20*a*. The function thereof may be realized by, for example, a software. The post-processing section 20 is called a burster.

The determining section 11 is arranged to include the reading unit 12, the second memory 14*b*, the comparing unit 13, and further, offset mark registering data memorizing unit 17.

The comparing unit 13 includes an offset instructing signal generating unit (means) 13*c* in addition to the memory data processing unit 13*a* and the MPU 13*b*. The offset instructing signal generating unit 13*c* is arranged to generate the offset instructing signal so that after the continuous paper 9 is cut into sheets of paper in the post-processing section 20 and the sheets of paper undergo the offset operation. To this end, the offset instructing signal generating unit 13*c* generates the offset instructing signal for instructing offset operation of the continuous paper after the continuous paper 9 is cut into sheets of paper based on a control mark (offset instructing mark) and supplies the same to the post-processing section 20.

Further, the offset mark registering data memorizing unit 17 is utilized for registering a pattern of the offset instructing mark in advance. This function may be realized by, for example, a fourth memory (not shown) such as a hard disk. The offset instructing mark is a mark printed outside the region for printing of the printed image on the continuous paper 9, and it functions as a control mark.

The printing section 30 shown in FIG. 39 has substantially the same arrangement as that of the first embodiment described with reference to FIG. 1. However, FIG. 39 illustrates only components necessary for describing the arrangement of the present embodiment. Further, parts attached with the same reference numeral as those described above are the same parts or parts having similar functions.

Therefore, they will not be described. Furthermore, the printing section 30 shown in FIG. 39 has the same arrangement as that of the printing section 30 of the continuous medium printing apparatus 1 shown in FIG. 1. However, in FIG. 39, components concerning paper conveying, the mechanism control unit 31, the dual port memory 32, for example, are not illustrated. Also, the determining section 11 shown in FIG. 39 has the same arrangement as that of the determining unit 11 of the continuous medium printing apparatus 1 shown in FIG. 1. But it will not be described in detail.

With the above arrangement, the continuous paper 9 is printed in the printing section 30, the continuous paper 9 is conveyed by the conveying tractor 30*h*. When the continuous paper 9 reaches the reading unit 12 of the determining section 11, the continuous paper 9 undergoes reading of printed image formed thereon. Further, the continuous paper 9 is conveyed to the post-processing section 20 in which it is cut into sheets of paper at a predetermined interval by the cutting unit 20*a*.

The offset instructing signal generating unit 13*c* provided within the comparing unit 13 in the determining section 11 is arranged to send an offset instructing signal to the post-processing section control unit 20*c*. Thus, the post-processing section control unit 20*c* sends a control signal to the cutting unit 20*a* based on the offset instructing signal.

Figure 40A:
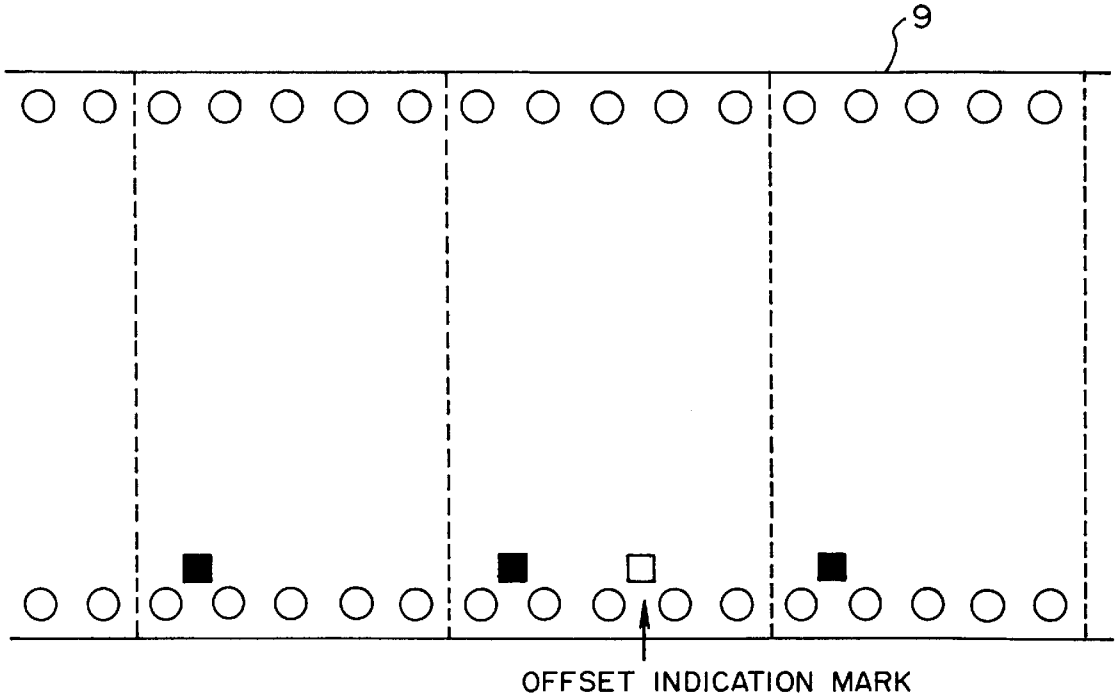
FIG. 40(*a*) is a schematic diagram showing a continuous paper according to the third embodiment of the present invention.
Figure 40B:
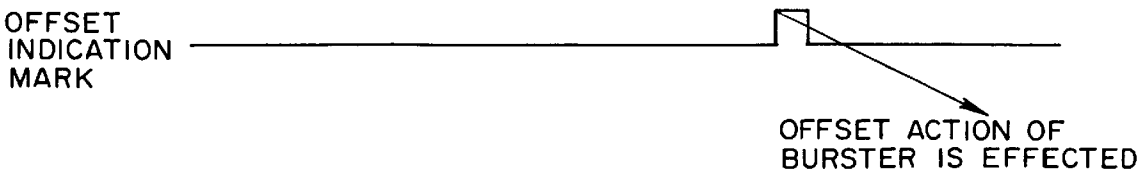

FIG. 40(*a*) is a schematic diagram showing the continuous paper 9 according to the third embodiment of the present invention. The continuous paper 9 shown in FIG. 40(*a*) has an offset instructing mark of a square form printed thereon. The offset instructing mark is printed outside the data region of the continuous paper 9 by the printing section 30. A solid square mark represents a control mark.

FIG. 40(*b*) is a timing chart of the offset instructing signal according to the third embodiment of the present invention. The offset instructing signal shown in FIG. 40(*b*) is generated when the offset instructing mark is detected in the comparing unit 13. In more concretely, when the status of the offset instructing signal becomes high, the post-processing section 20 carries out the offset processing.

With the above arrangement, the comparing unit 13 compares the printed image data stored in the second memory 14*b* with the offset instructing mark registered in advance in terms of pattern matching. In this case, if the offset instructing mark is detected, the offset instructing signal is sent to the post-processing section control unit 20*c* of the post-processing section 20.

In this way, if the printed face made by the printing section 30 is read by the reading unit 12, and the read printed image data contains the offset instructing mark, the post-processing section 20, which is provided in the downstream of the reading unit 12, can be instructed to carry out the offset operation. Therefore, it becomes possible to make an adjustment in regard to the cutting position of the continuous paper 9. Thus, even if another component such as the post-processing section or the like is added to the system, it is possible to conform the added component to the current control system, with the result that operability is improved.

(D) Description of Fourth Embodiment of the Present Invention

Figure 41:
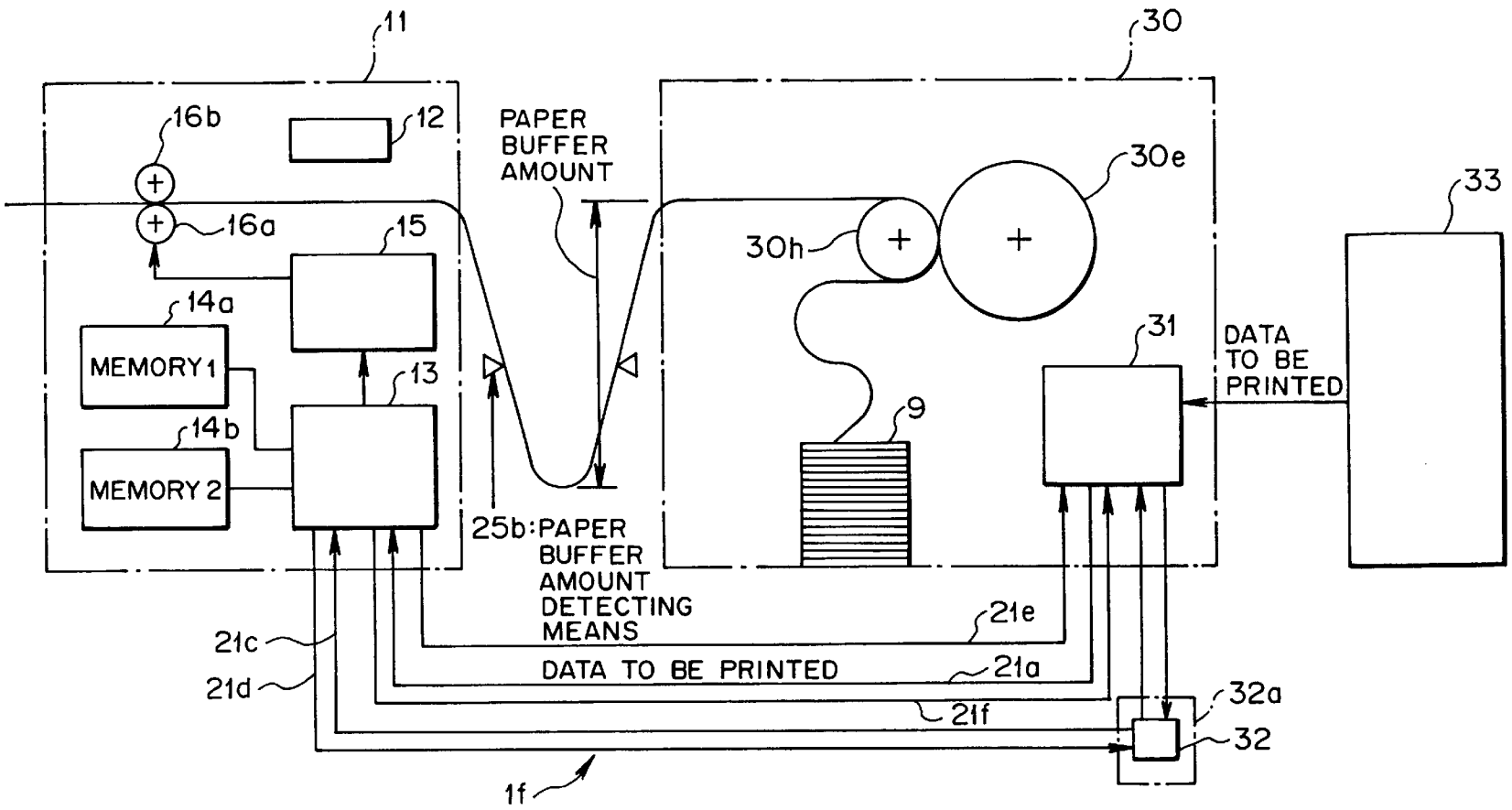
FIG. 41 is a diagram showing an arrangement of a continuous medium printing apparatus according to a fourth embodiment of the present invention.

FIG. 41 is a diagram showing an arrangement of a continuous medium printing apparatus according to a fourth embodiment of the present invention. With the present embodiment, printing, conveying and reading operations are controlled in accordance with a recognition mark attached to the continuous paper 9. The term "recognition mark" means a control mark. In the description of the present embodiment, it refers to as the recognition mark.

The continuous medium printing apparatus 1*f* shown in FIG. 41 functions as a print data comparing system in which data sent from the upper controller unit 33 is sequentially printed at a high rate on continuous medium such as continuous recording paper or the like. The continuous medium printing apparatus if includes the determining section 11, the printing section 30, designating means 32*a*, the upper controller unit 33. Further, the continuous medium printing apparatus if is provided with a paper buffer amount detecting unit (paper buffer amount detecting means) 25*b* between the printing section 30 and the determining section 11.

The designating means 32*a* is formed of the dual port memory 32. The designating means 32*a* has the data lines 21*a*, 21*c*, 21*d* and data lines 21*e* and 21*f*. The data lines 21*e* and 21*f*. connects the comparing unit 13 and the mechanism control unit 31 to each other. The data line 21*e* is utilized for transmitting a control signal while the data line 21*f* is utilized for transmitting read printed image data to the control section 30 when the reading unit 12 fails to read the printed image data. This data transmission retrying service is carried out so that the printing section 30 can retry printing.

Components shown in FIG. 41 attached with the same reference numerals as those having been described above are the same components. Therefore, they will not be further described.

The paper buffer amount detecting unit 25*b* is provided between the printing section 30 and the determining section 11, and utilized for detecting the slack amount of the continuous paper 9. This function is realized by, for example, a light projecting type sensor. That is, as shown in FIG. 41, the paper buffer amount detecting unit 25*b* detects the paper buffer amount by measuring the distance between the upper end and the lower end of the slack portion of the continuous paper 9. To detect the distance, light is projected onto the paper by using the light projecting type sensor. The buffer amount detecting unit 25*b* is arranged to absorb the difference between the paper conveying speed in the printing section 30 and the paper conveying speed in the determining section 11.

Figure 42:
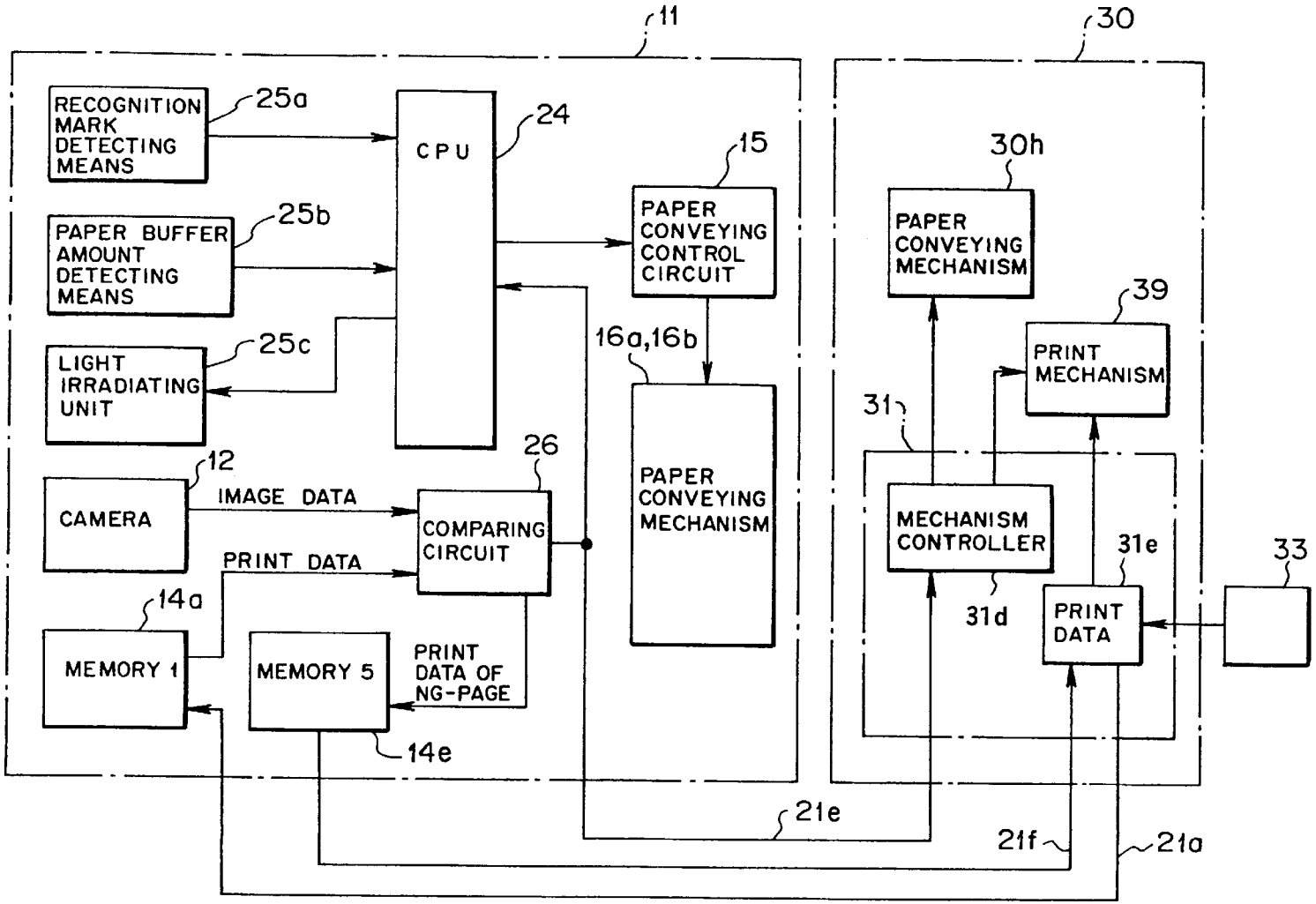
FIG. 42 is a function block diagram of the continuous medium printing apparatus according to the fourth embodiment of the present invention.

FIG. 42 is a function block diagram of the continuous medium printing apparatus 1*f* according to the fourth embodiment of the present invention. As shown in FIG. 42, the determining section 11 of the fourth embodiment is arranged to include a recognition mark detecting unit (recognition mark detecting means) 25*a*, a light irradiating unit 25*c*, a comparing circuit 26, a fifth memory 14*e*, a CPU (Central Processing Unit) 24, the paper conveying mechanisms 16*a*, 16*b*, the reading unit 12, the first memory 14*a*, a reading unit conveying control unit (paper conveying control circuit) 15, and the paper buffer amount detecting unit 25*b*.

The recognition mark detecting unit 25*a* is utilized for detecting a recognition mark from the printed image data acquired by the reading unit 12. This function may be realized by, for example, a software. The light irradiating unit 25*c* is a device for irradiating a predetermined intensity of light onto the printed image for acquiring printed image data. The light irradiating unit 25*c* is controlled based on a control signal supplied from the CPU 24. The comparing circuit 26 is arranged to compare the printed image data supplied from the reading unit 12 with the data to be printed supplied from the first memory 14*a* in terms of image matching. The comparing circuit 26 is further arranged to send information indicative of the result of the comparison to the CPU 24 and a paper conveying mechanism control unit 31*d*, which will be described later on, provided within the printing section 30, through the data line 21*e*.

The fifth memory 14*e* is utilized for holding print data of a page of NG (No Good), or a page containing error if it is determined that the page contains error as a result of the comparing circuit 26. The fifth memory 14*e* and the data line 21*f* are arranged to cooperate with each other to function as print data transmission retrying means. Thus, it follows that the determining section 11 is arranged to include the print data transmission retrying means which, when the comparing unit 13 reveals that the printing is unsatisfactory on a page, allows the determining section 11 to transmit data to be printed corresponding to the unsatisfactory printed page from the reading unit 12 to the printing section 30.

As described above, if the comparing unit 13 determines that the printing result is erroneous, the determining section 11 writes the data to be printed into the fifth memory 14*e*. Then, the mechanism control unit 31 is informed of that the data is written into the memory by means of interruption signal, for example. The printing section 30 reads the contents of the fifth memory 14*e* through the data line 21*f* so that the data to be printed is fed back to the printing section 30 to be printed again. Thus, the data to be printed, which has been failed to be printed, is recovered to be printed swiftly.

Further, the paper conveying mechanisms 16*a*, 16*b* are controlled in their paper conveying speed in a manner independent of the paper conveying speed of the conveying tractor 30*h* provided within the printing section 30. In this case, the paper conveying mechanism 16*a*, 16*b* are controlled so that the paper conveying speed thereof becomes lager than the paper conveying speed of the conveying tractor 30*h*. Further, since the rate of comparison is greater than the paper conveying speed of the printing section 30, the reading unit conveying control unit 15 stops the comparing operation upon detecting the next recognition mark when the paper buffer amount becomes smaller than the predetermined value.

The reading unit 12 of the determining section 11 is formed of a CCD camera and also has an optical sensor. If the buffer amount detecting unit 25*b* detects that the slack amount becomes smaller than the predetermined value, the reading unit 12 stops reading operation upon detecting the first recognition mark after detecting that the slack amount becomes smaller than the predetermined value. It is advantageous for the CCD camera to be controlled in the physical position by a manner in which the position thereof is changed at every FCB (Forms Control Block) length. This method can be realized by fixing the position of the CCD camera with a high precision.

When the printing unit 30 stops printing, the continuous paper 9 is conveyed in the reverse direction until the reading unit 12 detects the first recognition mark. In this case, the reading unit 12 conveys the continuous paper 9 in a cooperative manner with the paper conveying mechanisms 16*a*, 16*b*.

That is, the reading unit 12 reads the periodically provided recognition mark together with the print image, the comparing unit 13 carries out comparison in a regular unit on the basis of the recognition mark, and when the printing operation is stopped during the printing and comparing operation, then the continuous paper 9 is conveyed in the reverse direction until the just preceding recognition mark is detected.

Figure 43:
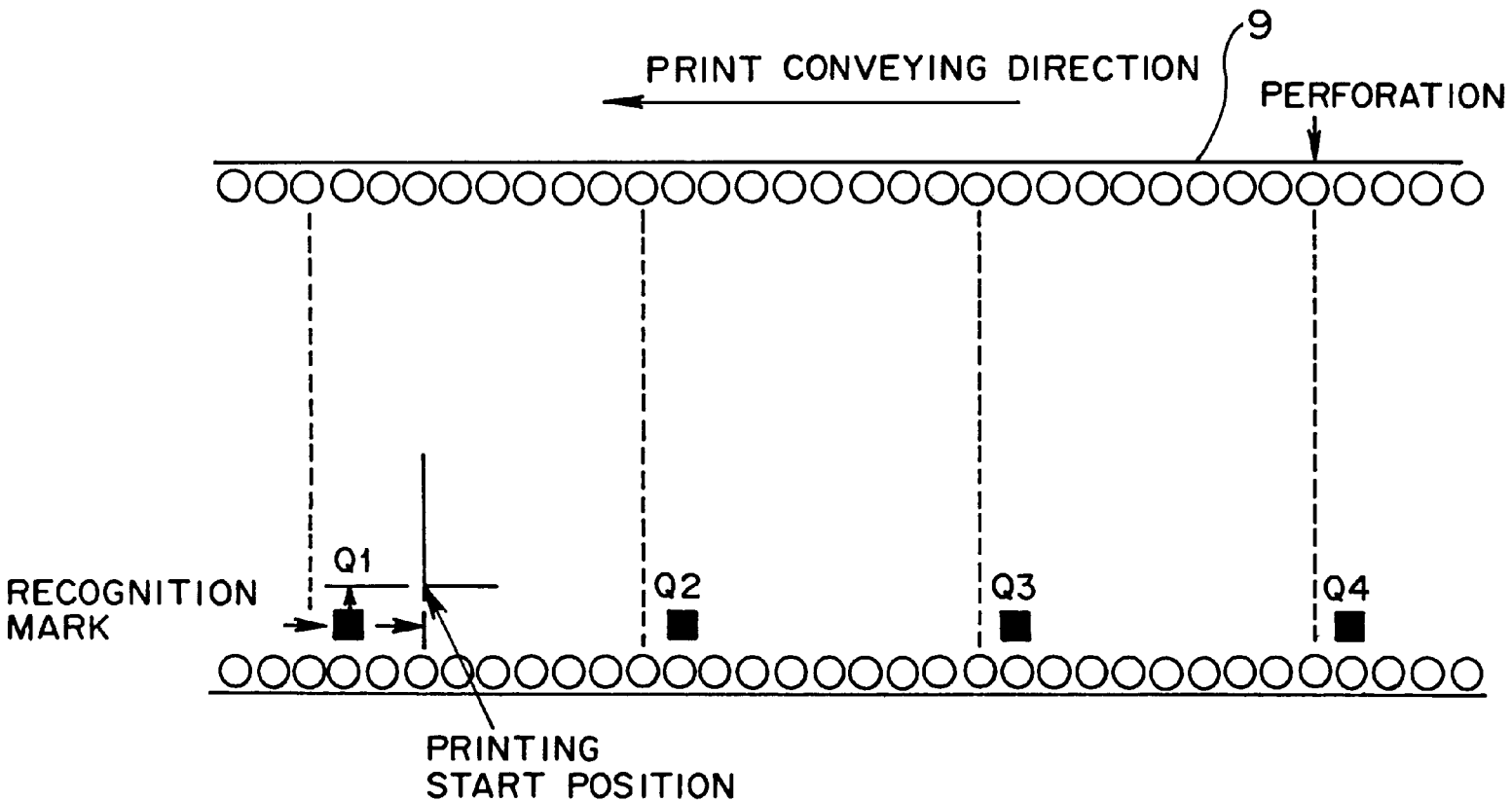
FIG. 43 is a schematic diagram of continuous paper according to the fourth embodiment of the present invention.

FIG. 43 is a schematic diagram of the continuous paper 9 according to the fourth embodiment of the present invention. In FIG. 43, the direction from the right to the left is the print conveying direction. As shown in FIG. 43, the continuous paper 9 of the fourth embodiment has a recognition mark (solid square) provided in each page at every position of Q1, Q2, Q3, Q4. The determining unit 11 conveys the continuous paper 9 in the reverse direction and specify the position of the printed image to be read on the basis of the recognition mark.

For example, if the printing operation is stopped when the continuous paper 9 undergoes the conveying between the recognition marks Q2 and Q3, the paper conveying mechanism control unit 15 conveys the paper in the reverse direction until the recognition mark Q2 is again detected, and then stops the conveying of the continuous paper 9. When the printing section 30 resumes the printing operation, the determining section 11 also resumes conveying the continuous paper 9. When the recognition mark Q2 is detected, the operations of printing and comparing are again started.

Figure 44:
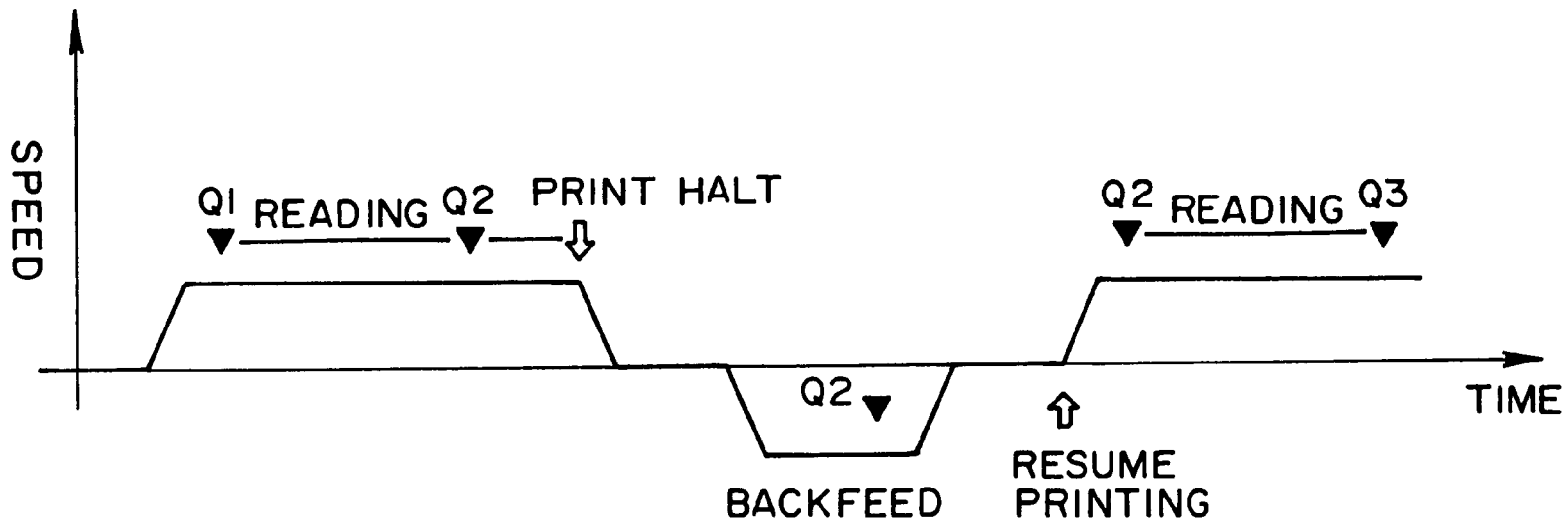
FIG. 44 is a diagram showing a paper conveying speed of the continuous medium printing apparatus according to the fourth embodiment of the present invention.

FIG. 44 is a diagram showing the paper conveying speed of the continuous medium printing apparatus if according to the fourth embodiment of the present invention. In FIG. 44 time (second) is plotted in abscissa and speed (millimeter/second) is plotted in ordinate. The speed takes a positive value in the area above abscissa, and the paper is conveyed in the paper conveying direction. On the other hand, the speed takes a negative value in the area below abscissa, and the paper is conveyed in the direction reverse to the paper conveying direction. The paper conveying speed is controlled by the paper conveying mechanism control unit 15. The reference symbols Q1, Q2, Q3, Q4 shown in FIG. 44 correspond to the reference symbols Q1, Q2, Q3, Q4 shown in FIG. 43, respectively.

In the time interval between Q1 and Q2 shown in FIG. 44, the paper is conveyed in the print conveying direction. If the printing operation is stopped between the interval between Q2 and Q3, the value of the paper conveying speed decreases linearly to go to zero level. Then, the paper conveying mechanism control unit 15 conveys the continuous paper 9 in the reverse direction until the recognition mark Q2 is again detected. Thus, the value of the paper conveying speed decreases linearly to take the negative minimum value. If the recognition mark Q2 is again detected, the paper conveying speed in the reverse direction again increases to zero. If the printing section 30 resumes the printing operation, the determining section 11 resumes the conveying of the continuous paper 9. If the recognition mark Q2 is detected, the printing and comparing operations are again started.

As described above, when the continuous paper 9 is conveyed in the reverse direction, the continuous paper 9 overruns a length of paper corresponding to the rising time of a motor for paper conveying provided in the determining section 11. Accordingly, when the printing and comparing operations are again started, it becomes possible to avoid the loss of length of the continuous paper 9 due to the rising time of the motor for paper conveying. Thus, the printing and comparing operations can be carried out within a time duration in which paper conveying is effected at a constant speed.

The reading unit conveying control unit 15 has the same arrangement as that of the above described one.

The printing section 30 shown in FIG. 42 is arranged to include the conveying tractor (paper conveying mechanism) 30*h*, a print mechanism 39, and the mechanism control unit 31. The print mechanism 39 is comprised of the photosensitive drum 30*e*, the pre-charging device 30*c*, the exposing unit 30*d*, the developing device 30*g*, the transfer electrifying device 30*f*, the conveying body 30*i*, the fixing device 30*a*, and the cleaner unit 30*b*.

The mechanism control unit 31 includes a paper conveying mechanism control unit (mechanism controller) 31*d* and a print data buffer 31*e*. The paper conveying mechanism control unit 31*d* is utilized for controlling the conveying motion of the conveying tractor 30*h* and the printing operation of the print mechanism 39. The paper conveying mechanism control unit 31*d* is connected to the comprising circuit 26 provided within the determining section 11 through the data line 21*b*. The print data buffer 31*e* is utilized for holding data to be printed sent from the upper controller unit 33, and sends the data to be printed to the exposing unit 30*d* provided within the print mechanism 39, and also holds print data of an NG page sen from the fifth memory 14*e* within the determining section 11. The function of the print data buffer 31*e* may be realized by, for example, a RAM.

Figure 45:
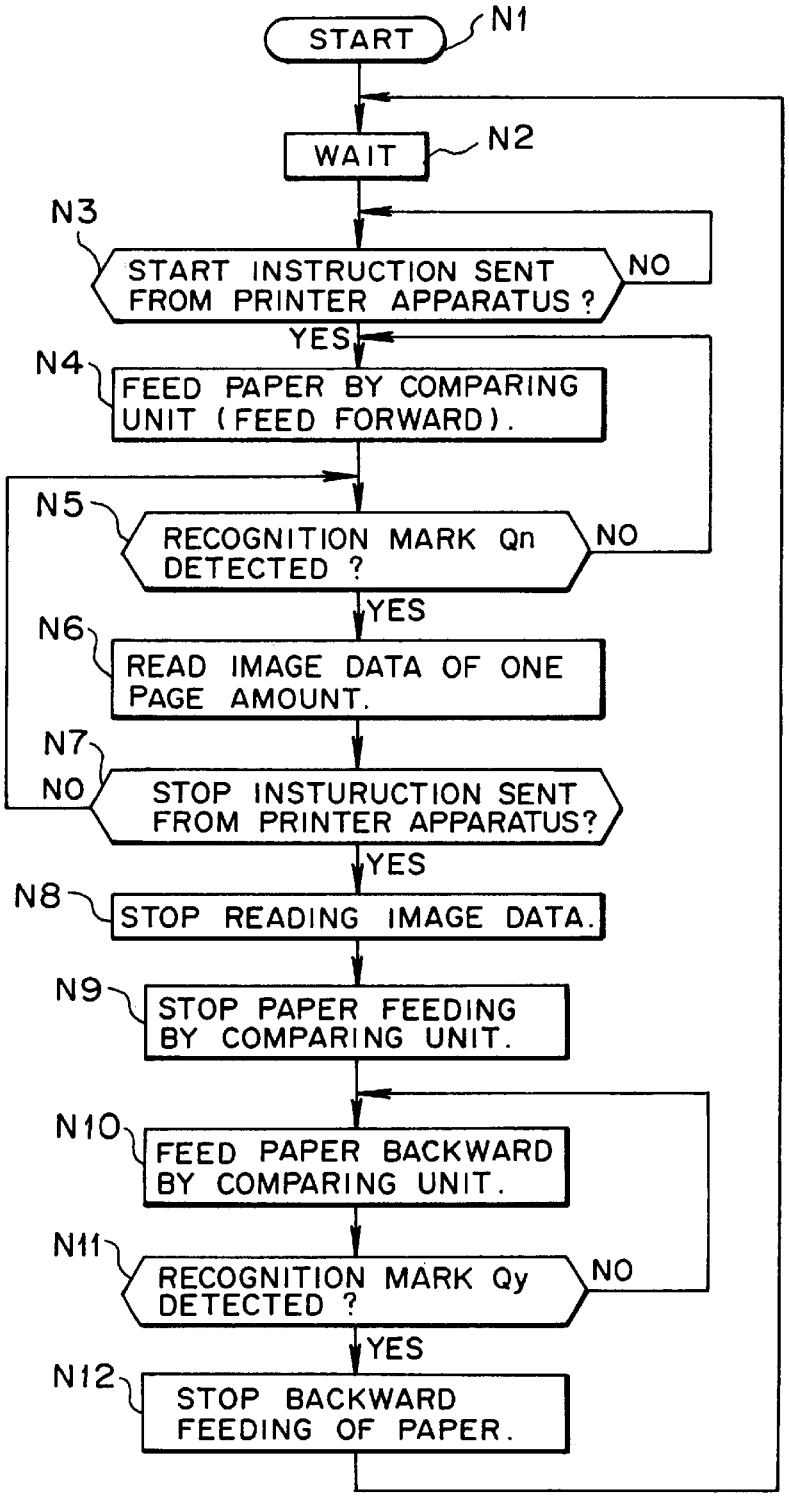
FIG. 45 is a flowchart showing operations of printing, reading and comparing carried out by the determining unit according to the fourth embodiment of the present invention.
Figure 46:
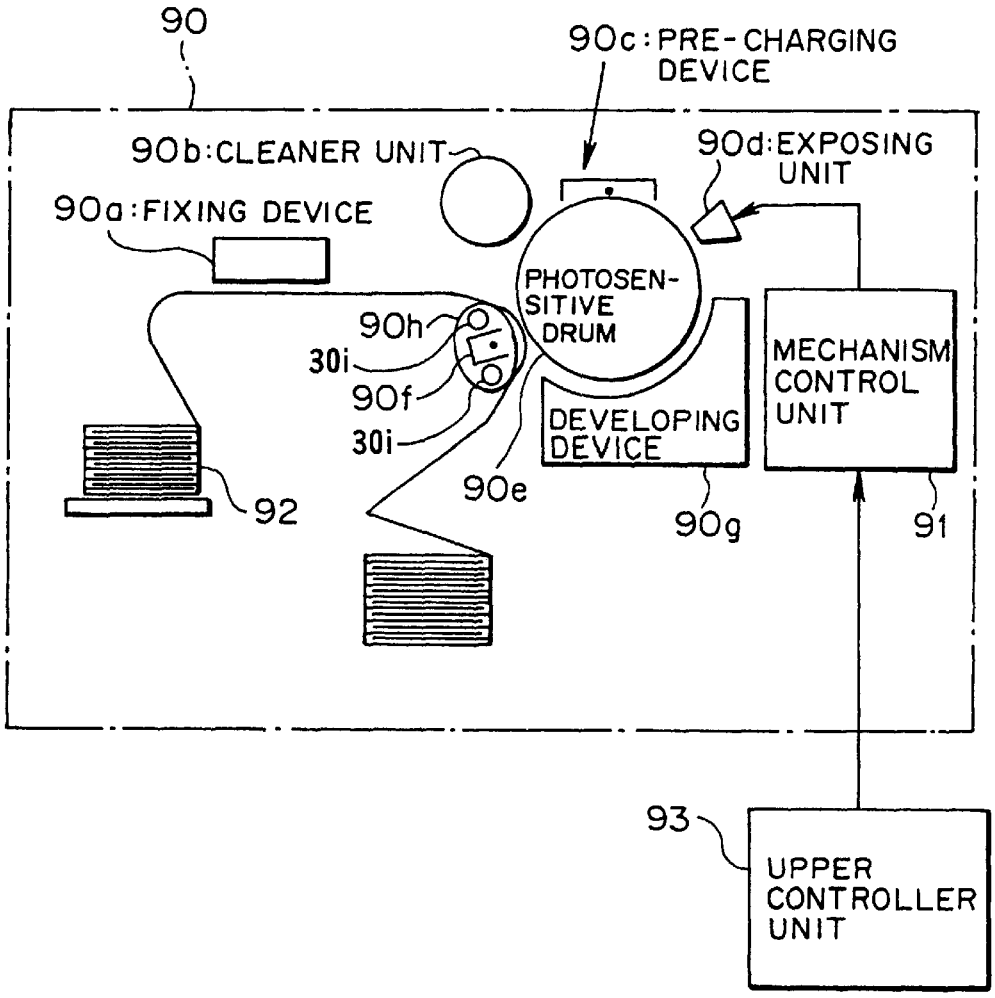
FIG. 46 is a schematic diagram of a continuous medium printing apparatus in which an electrophotograph system is employed.
Figure 47:
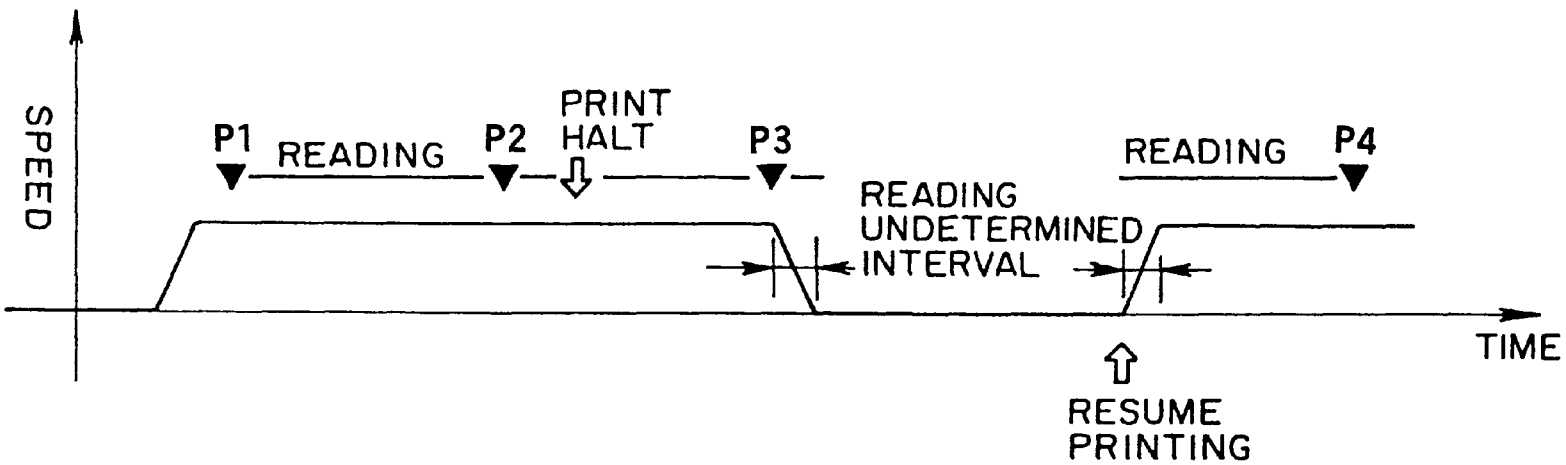
FIG. 47 is a diagram showing the paper conveying speed of a printer in which the paper conveying speed of the printer is synchronous with the paper conveying speed of a print comparing unit.

With the above arrangement, the operations of printing and comparing can be carried out. FIG. 45 is a flowchart showing the operations of reading and comparing carried out by the determining section 11 in conjunction with the printing according to the fourth embodiment of the present invention. The routine shown in FIG. 45 begins with step N1. Initially, at step N2, the determining section 11 is placed in the waiting mode. At step N3, the comparing unit 13 determines whether or not a start instruction is received from the printer. If the comparing unit 13 does not receive the start instruction, n route is taken to return to step N3. If it is determined that the start instruction is received, y route is taken to go to step N4. At step N4, the reading unit conveying control unit 15 drives the paper conveying mechanisms 16*a*, 16*b* to convey the paper forwardly.

At step N5, the determining section 11 determines whether a sensor of the reading unit 12 detects a recognition mark Qn or not. If it is determined that the sensor does not detect the recognition mark, n route is taken to return to step N5. If it is determined that the recognition mark Qn is detected, y route is taken to go to step N6. At step N6, the reading unit 12 reads an image of one page amount. At step N7, the reading unit conveying control unit 15 determines whether or not a stop instructing signal is received from the printing section 30. If it is determined that the signal is not received, n route is taken to repeat the processing beginning with step N5.

At step N7, if the reading unit conveying control unit 15 receives the stop instructing signal from the printing section 30, then at step N8, the reading unit conveying control unit 15 stops the reading unit 12 from reading an image. At step N9, the reading unit conveying control unit 15 stops a comparing machine (in this case it means the paper conveying mechanisms 16*a*, 16*b* ) from doing conveying motion. Further, at step N10, the reading unit conveying control unit 15 drives the comparing machine in the backward direction. Thereafter, at step N11, the determining section 11 determines whether the sensor of the reading unit 12 detects a recognition mark Qy or not. If it is determined that the sensor does not detect the recognition mark, n route is taken to return to step N10. Conversely, if it is determined that the sensor detects the recognition mark, y route is taken to go to step N12. At step N12, the reading unit conveying control unit 15 stops the comparing machine from backward conveying. Then, the processing beginning with step N2 is carried out.

As described above, according to the fourth embodiment of the present invention, the operations of printing and comparing are carried out in the unit of page. Therefore, even if the printing operation is stopped in a midway of a page, the operations of printing and comparing are carried out when the operations of printing and comparing are brought into a constant conveying speed mode. Therefore, the operations of printing and comparing can be carried out at a high precision. Further, if the printing operation is stopped and thereafter the printing operation is started again in a manner described above, the operations of printing and comparing can be carried out accurately even on the page at which the stop of the operations of printing and comparing are brought about.

(D1) Description of a Modification of the Fourth Embodiment of the Present Invention.

The above-described fourth embodiment can be modified in various manners. Also the present modification has the same arrangement as that of the continuous medium printing apparatus 1*f* (see FIG. 41) of the fourth embodiment. Therefore, the arrangement thereof will not be described.

In the determining section, if data to be printed sent from the printing section 30 is compared with the printed image data read by the reading unit 12, and it is revealed that the result of comparison is erroneous, the result may be sent to the printing section 30 and the printing operation may be immediately stopped so that unsatisfactory printing on the continuous paper 9 is suppressed at a minimum level.

In a similar fashion, according to the present modification, the reading unit 12 is arranged such that, if it is revealed that the comparing result of the comparing unit 13 is erroneous, the reading unit 12 conveys the continuous paper 9 in a direction from the inside of the comparing unit 13 to the outside of the same so that the corresponding portion of the continuous paper 9 is shifted to a position where the operator is allowed to inspect the printed face with the eyesight. In this case, to shift the continuous paper 9 to the position where the operator is allowed to inspect the printed face with the eyesight, means that the continuous paper 9 is shifted from the inner part of the paper conveying mechanisms 16*a*, 16*b* to the outer part of the same where the operator is allowed to confirm the printed face with the eyesight.

In this way, after the paper is conveyed to the position the printing operation where the operator is allowed to confirm the printed face with the eyesight, the printing operation is stopped. Thus, the operator can confirm and remove the erroneous print page jamming at the inner part of the mechanism with ease. Moreover, according to the above arrangement, operability is improved. In other words, the erroneous page can be removed while operations of printing and comparing are continued.

(E) Other Disclosure

The present invention is not limited to the above-described embodiments and modifications thereof but various kinds of variations can be effected without departing from the gist of the present invention.

For example, it is possible to implement a combination of a plurality of control modes of the embodiments. Further, while the above-introduced flowcharts employ a positive logic, a negative logic may be employed instead of the positive logic.

While in the above-described embodiments and modifications, the dual port memory 32 is provided on the side of the printer section 30, the dual port memory 32 may be provided separated from the printing section 30, and also may be provided on the side of the determining section 11.

Further, in the above description, a term "print" is utilized as a notation of the name of each function block or function module. However, the term is merely a notation for the component, and hence the term may be understood in a different manner if it is utilized for describing the function, operation or the like of the component.

While in the first embodiment the second memory 14*b* is utilized for a memory into which the control mark for effecting the pattern matching is written. However, the memory into which the control mark for effecting the pattern matching is written is not limited thereto but the first memory 14*a* or other memory maybe utilized. Further, in the seventh modification of the first embodiment, the detecting signal may be arranged for notifying jam at the preprocessing section 23.

Further, the relationship between the print image creating means of the first embodiment and the print mechanism 39 of the fourth embodiment is as follows. That is, the print image creating means is formed of the print mechanism 39, the mechanism control unit 31 and the conveying tractor 30*h*. The print mechanism 39 is formed of the photosensitive drum 30*e*, the pre-charging device 30*c*, the exposing unit 30*d*, the developing device 30*g*, the transfer electrifying device 30*f*, the fixing device 30*a* and the cleaner unit 30*b*.

Furthermore, the status of the determining section 11 in which transmission is carried out by using the second instructing signal includes, in addition to a status of the reading unit 12 in the reading mode and a status of the comparing unit 13 in the comparing mode, status of other components provided within the determining section 11 in the operating mode.

Although various embodiments and modifications have been described above, these embodiments or modifications should be embraced within the spirit and scope of the claims appended hereto.

What is claimed is:

1. A continuous medium printing apparatus comprising:

printing means for putting data to be printed into print on a continuous medium, conveying the continuous medium in a print conveying direction, and capable of generating the data to be printed and a first instructing signal regarding the data to be printed;

determining means provided in the downstream of the printing means in the print conveying direction of the continuous medium, for reading a printed image on the continuous medium, comparing printed image data read from the printed image with the data to be printed supplied from the printing means, and generating a second instructing signal regarding at least the printed image data; and instructing means connected to the printing means and the determining means, for supplying the data to be printed and the first instructing signal sent from the printing means to the determining means, and capable of supplying the second instructing signal from the determining means to the printing means, wherein the determining means is controlled in a reading operation, the reading operation is a one which the determining means reads a printed image on the continuous medium, based on the first instructing signal from the instructing means, and the printing means is informed of at least the status of the determining means in accordance with the second instructing signal from the instructing means or controlled in a printing operation, the printing operation is a one which printing means prints image data on the continuous medium.

2. A continuous medium printing apparatus according to claim 1, wherein the printing means comprises print image forming means for forming a print image on the continuous medium and conveying the continuous medium in the print conveying direction, and mechanism control means for sending the first instructing signal.

3. A continuous medium printing apparatus according to claim 2, wherein the mechanism control means comprises printing data receiving means for receiving the data to be printed, mark data creating means for creating data regarding a control mark useful for controlling the start and stop of the reading operation and holding the mark data, and printing data adding means for synthesizing the data to be printed and the data regarding the control mark into a single printing image.

4. A continuous medium printing apparatus according to claim 2, wherein the first instructing signal is arranged to contain any or all of information indicative of a page partitioning position of the continuous medium, information indicative of a length or a width of the continuous medium, information indicative of a size of the data to be printed, information indicative of a location of the data to be printed, and resolution information.

5. A continuous medium printing apparatus according to claim 2, further comprising a preprocessing section for conveying the continuous medium to the printing means, wherein the preprocessing section comprises detecting means for detecting a connecting perforation indicating a position where the tail end of the preceding continuous medium and the beginning end of the following continuous medium are connected to each other and capable of generating a detecting signal, and preprocessing section control means for sending information of the connecting perforation to the mechanism control means in accordance with the detecting signal from the detecting means, wherein the mechanism control means prohibits the printing means from printing a page attached with the connecting perforation while prohibits the comparing means from doing comparison in at least non-printed areas of the preceding and following pages of the connecting perforation.

6. A continuous medium printing apparatus according to claim 1, wherein the determining means comprises reading means provided in the downstream of the printing means in the print conveying direction of the continuous medium and for reading the printed image while conveying the continuous medium, first memory means for holding the data to be printed, second memory means for holding the printed image data, and comparing means connected to the reading means and the second memory means and capable of comparing the printed image data with the data to be printed in terms of image coincidence.

7. A continuous medium printing apparatus according to claim 6, wherein the instructing means comprises third memory means connected to the printing means and the determining means so as to allow the printing means and the determining means to access the third memory means to read and write data.

8. A continuous medium printing apparatus according to claim 7, wherein the instructing means comprises control data sending means for sending a pulse signal composed of pulses with a predetermined time interval.

9. A continuous medium printing apparatus according to claim 6, wherein the first instructing signal is arranged as a control signal for controlling the reading operation of the determining means.

10. A continuous medium printing apparatus according to claim 9, wherein the first instructing signal is arranged as a timing signal making the printing means start a printing operation after an amount of light irradiated on the continuous medium reaches a predetermined value in the reading means.

11. A continuous medium printing apparatus according to claim 9, wherein the first instructing signal is arranged as an informing signal for prohibiting the comparing means from doing comparing operation on a perforation portion formed at a regular interval for folding the continuous medium.

12. A continuous medium printing apparatus according to claim 9, wherein the first instructing signal is arranged as a comparing determination reference information useful when the comparing means compares the data to be printed with the printed image data supplied to the comparing means.

13. A continuous medium printing apparatus according to claim 12, wherein the comparing determination reference information is set for each of a plurality of regions deriving from partitioning the continuous medium in the print conveying direction and the direction perpendicular to the print conveying direction.

14. A continuous medium printing apparatus according to claim 9, wherein the first instructing signal is arranged as a halting condition notifying signal for notifying the comparing means of the halting condition when the comparing means detects unsatisfactory printing by a comparing result.

15. A continuous medium printing apparatus according to claim 9, wherein the first instructing signal is arranged as a data deletion notifying signal for notifying the comparing means of deletion of the data to be printed when the printing means stops printing.

16. A continuous medium printing apparatus according to claim 9, wherein the first instructing signal is arranged as a start signal which the printing means sends to the reading means for notifying the reading means of the start of reading the printed image when the printing is achieved by a predetermined length on the continuous medium.

17. A continuous medium printing apparatus according to claim 6, wherein the reading means detects a control mark for controlling the start and stop of the reading operation from the printed image of the continuous medium so that the printing means controls the reading means.

18. A continuous medium printing apparatus according to claim 17, wherein the comparing means comprises detecting means for generating a difference value indicative of a difference between a planed printing distance of the continuous medium extracted from the first instructing signal and a distance actually printed on the continuous medium and counted by the reading means, and halting signal inputting means for inputting a halting signal for halting the operation of the printing means to the printing means when the difference value sent from the detecting means exceeds a predetermined value.

19. A continuous medium printing apparatus according to claim 17, wherein a post-processing section for cutting the continuous medium is provided in the downstream of the determining means in the print conveying direction, and the comparing means comprises offset instructing signal generating means for generating an offset instructing signal instructing the offset operation of the continuous medium based on the control mark after cutting the continuous medium and supplying the offset instructing signal to the post-processing section.

20. A continuous medium printing apparatus according to claim 17, wherein when the printing means halts a printing operation, the reading means reads the continuous medium which was conveyed to a position indicated by the control mark in the direction inverse to the print conveying direction.

21. A continuous medium printing apparatus according to claim 17, further comprising buffer amount detecting means for detecting a slack amount of the continuous medium between the printing means and the determining means, wherein the reading means is arranged such that when the slack amount detected by the buffer amount detecting means becomes equal to or smaller than a predetermined value, then the reading means halts the reading operation upon a first detection of the control mark after the detection of that the slack amount becomes equal to or smaller than a predetermined value.

22. A continuous medium printing apparatus according to claim 6, wherein the comparing means is arranged to compare data regarding the control mark detected by the reading means with data regarding the control mark sent from the printing means.

23. A continuous medium printing apparatus according to claim 6, wherein the second instructing signal is arranged as a control signal for controlling a printing operation of the printing means.

24. A continuous medium printing apparatus according to claim 23, wherein the second instructing signal is arranged as a quality signal indicative of the result of comparison made by the comparing means.

25. A continuous medium printing apparatus according to claim 23, wherein the reading means is arranged such that when the comparing means reveals unsatisfactory comparing result, the continuous medium can be moved back from the inside of the comparing means to the outside of the same to a position where an operator is allowed to examine printed material with his eyesight and stops the printing operation of the printing means.

26. A continuous medium printing apparatus according to claim 6, wherein the determining means comprises print data transmission retrying means arranged to transmit the data to be printed of an unsatisfactorily printed page from the determining means to the printing means when the comparing means issues a comparing result indicating that the printing quality is unsatisfactory.

27. A continuous medium printing apparatus according to claim 6, wherein the determining means comprises preprint information storing means capable of holding data of a plurality of printed images containing preprint information of at least ruled lines, characters, symbols, and preprint information registration designating means for inputting one kind of preprint information selected by an operator from the plurality of printed images stored in the preprint information storing means, and the comparing means is arranged to make comparison by using the selected one kind of the preprint information, the data to be printed and the printed image data.

28. A continuous medium printing apparatus according to claim 27, wherein the preprint information storing means is arranged such that, after the continuous medium is loaded in the printing means and the reading means, the preprint information storing means acquires the printed image of the preprint information of the loaded continuous medium.

* * * * *